US005316341A

United States Patent [19]

Schwartz

[11] Patent Number: 5,316,341

[45] **Date of Patent: * May 31, 1994**

[54] HYPERTEXT BOOK ATTACHMENT

[75] Inventor: David C. Schwartz, Southborough, Mass.

[73] Assignee: Productive Environments, Inc., Southborough, Mass.

[ * ] Notice: The portion of the term of this patent subsequent to Sep. 17, 2008 has been disclaimed.

[21] Appl. No.: 490,828

[22] Filed: Mar. 8, 1990

Related U.S. Application Data

[63] Continuation-in-part of Ser. No. 324,417, Mar. 16, 1989.

[51] Int. Cl.[5] ..... B42D 1/00

[52] U.S. Cl. ..... 281/15.1; 281/16; 281/21.1; 281/51

[58] Field of Search ..... 281/15.1, 16, 21.1, 281/51

[56] References Cited

U.S. PATENT DOCUMENTS

| | | | |
|---|---|---|---|
| 229,046 | 6/1880 | Low . | |
| 383,543 | 5/1888 | Rigby . | |
| 392,066 | 10/1888 | Razall . | |
| 408,260 | 8/1889 | Pratt . | |
| 432,700 | 7/1890 | Gregg . | |
| 724,849 | 4/1903 | Gresham . | |
| 744,598 | 11/1903 | Norton | 281/20 |
| 1,193,590 | 8/1916 | Napp . | |
| 1,256,868 | 2/1918 | Bergendahl . | |
| 1,316,039 | 9/1919 | James . | |
| 1,469,163 | 9/1923 | Mallina . | |
| 1,736,384 | 11/1929 | Wright . | |
| 1,778,766 | 10/1930 | McMichael . | |
| 1,810,440 | 6/1931 | Shedd . | |
| 1,891,376 | 12/1932 | Furlong . | |
| 1,913,818 | 6/1933 | Petrick . | |
| 2,190,438 | 2/1940 | Vogt | 281/2 |
| 2,270,015 | 1/1942 | Wright | 150/35 |
| 2,278,143 | 3/1942 | Matthews | 45/61 |
| 2,283,584 | 5/1942 | Sloan | 281/16 |
| 2,431,472 | 11/1947 | Fistell | 150/39 |
| 2,467,656 | 4/1949 | Broughton | 281/19 |
| 2,490,147 | 12/1949 | Minton . | |
| 2,541,735 | 2/1951 | Albrecht, Jr. | 281/42 |
| 2,687,313 | 8/1954 | Pisano | 281/42 |
| 2,848,163 | 8/1958 | Serrell | 235/61.12 |
| 2,909,202 | 10/1959 | Rook | 150/35 |
| 3,016,036 | 1/1962 | Jorgensen | 116/119 |
| 3,071,395 | 1/1963 | Essman | 281/42 |

(List continued on next page.)

FOREIGN PATENT DOCUMENTS

| | | | |
|---|---|---|---|
| 53336 | 5/1912 | Australia . | |
| 1181313 | 1/1985 | Canada . | |
| 887940 | 8/1953 | Fed. Rep. of Germany . | |
| 1022036 | 2/1953 | France . | |
| 55-100173 | 12/1980 | Japan . | |
| 20015 | 11/1909 | Norway . | |
| 215159 | 9/1967 | Sweden | 281/16 |
| 567314 | 9/1975 | Switzerland . | |
| 1115040 | 9/1984 | U.S.S.R. . | |
| 7338 | 12/1896 | United Kingdom . | |
| 643124 | 9/1950 | United Kingdom . | |
| 975183 | 11/1964 | United Kingdom . | |
| 1131761 | 10/1968 | United Kingdom . | |

OTHER PUBLICATIONS

Masco Catalog, Feb. 1989, pp. 825–841.

*Primary Examiner*—Paul A. Bell

*Attorney, Agent, or Firm*—Laurence S. Rogers; Jeffrey H. Ingerman

[57] ABSTRACT

A blank book attachment having a mark and sweep leaf with a fold out feature is provided. The leaf is pivotally retained along one edge on a frame, and the frame is pivotally retained at the binding spine of the host blank book. Pulling outward on the leaf causes the leaf to extend out and beyond the pages of the book allowing the pages to turn freely. When the leaf is placed within the host book, with the book open or closed, the leaf can be turned as a page, in which case it also acts as a mark to identify a specific position in the host book. Alternatively, the leaf may be pivoted on the frame to allow the host book pages to be turned past it in either direction.

14 Claims, 40 Drawing Sheets

U.S. PATENT DOCUMENTS

| | | | |
|---|---|---|---|
| 3,565,462 | 2/1971 | Gottlieb | 281/3 |
| 3,737,178 | 6/1973 | Tjernlund et al. | 281/42 |
| 3,883,971 | 5/1975 | Weiss | 40/119 |
| 4,138,143 | 2/1979 | Lawes | 281/47 |
| 4,294,029 | 10/1981 | Holson | 40/388 |
| 4,350,195 | 9/1982 | Viesturs et al. | 150/39 |
| 4,420,271 | 12/1983 | Zabielski | 402/80 L |
| 4,479,733 | 10/1984 | Segal | 402/79 |
| 4,706,396 | 11/1987 | Nomura | 40/124.2 |
| 4,794,713 | 1/1989 | Yang | 40/152.1 |
| 4,838,724 | 6/1989 | Spence, Jr. | 402/79 |
| 4,840,406 | 6/1989 | Pitts | 281/1 |
| 4,848,948 | 7/1989 | Pitts | 402/29 |
| 4,869,452 | 9/1989 | Bennett | 248/441.1 |
| 4,940,353 | 7/1990 | Osono et al. | 402/79 |
| 4,981,386 | 1/1991 | Beleckis | 402/73 |

192
190
191

161
180
30
250
35
170
70
171
73
172
60
62
74
20
61
G
H
1
2
3
173

FIG. 29
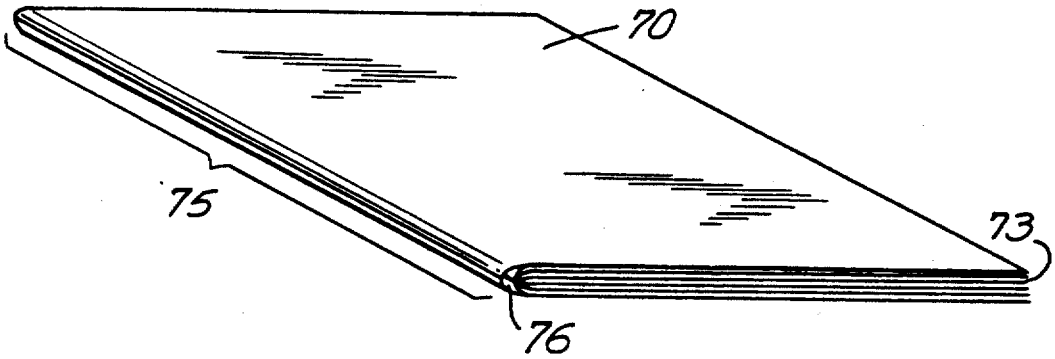
FIG. 30
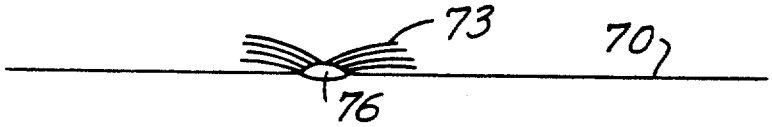
FIG. 31
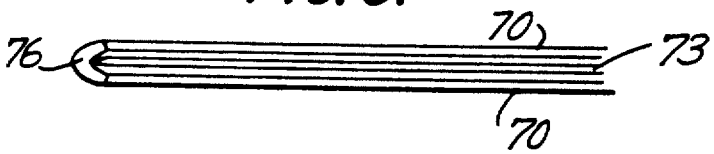
FIG. 32
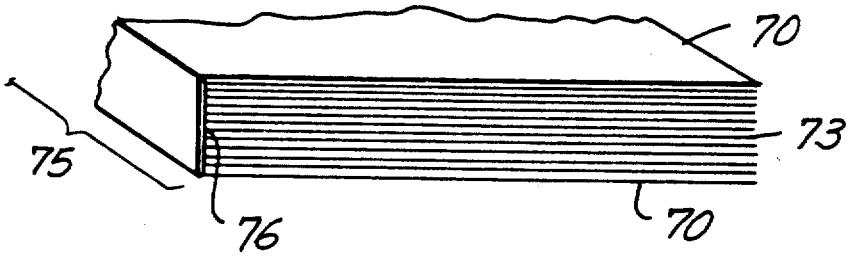
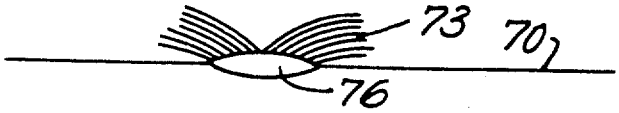
FIG. 33

FIG. 62a
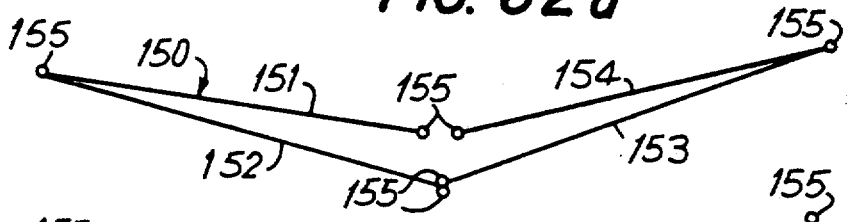
FIG. 62b
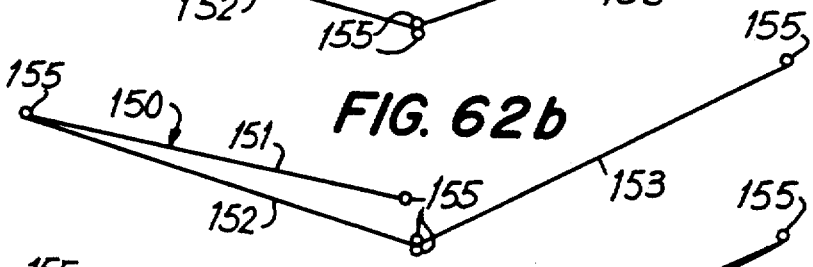
FIG. 62c
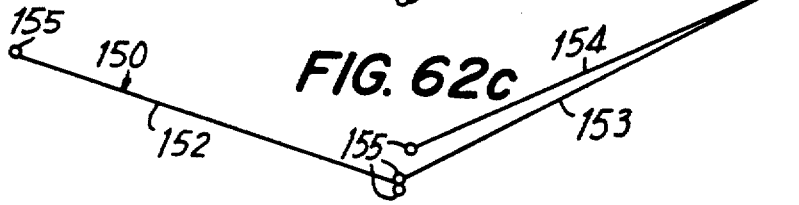
FIG. 62d
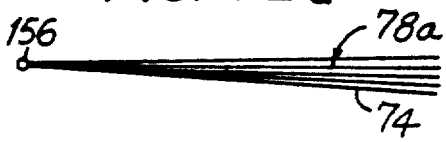
FIG. 62e
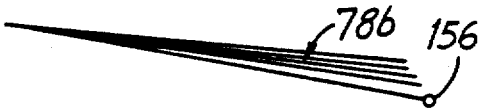
FIG. 62f
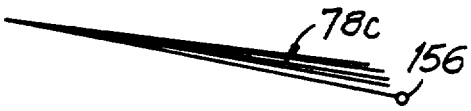
FIG. 62g
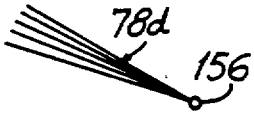
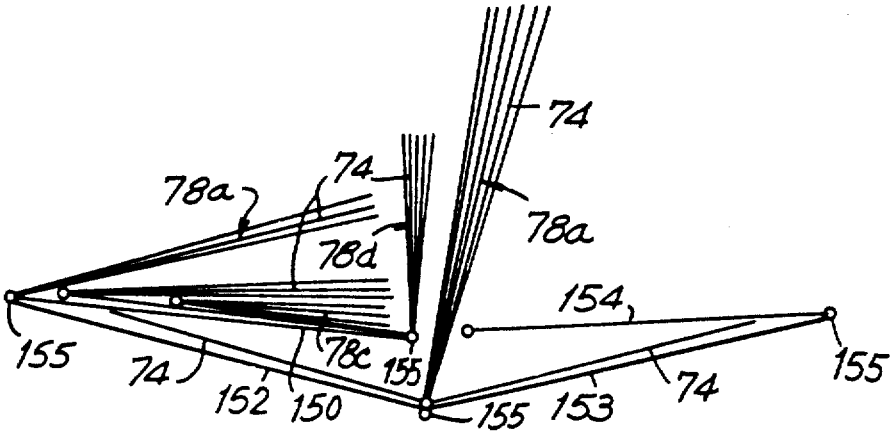
FIG. 63

HYPERTEXT BOOK ATTACHMENT

CROSS-REFERENCE TO RELATED APPLICATION

This application is a continuation-in-part of copending, commonly-assigned United States patent application Ser. No. 07/324,417, filed Mar. 16, 1989.

BACKGROUND OF THE INVENTION

This invention relates to "host books" with a fixed or variable number of pages including spiral bound note books, multi-ring bound books, staple-, tape-, or glue-bound books, plastic finger clasp bound books, and the like, add-in leaves in the form of mounting surfaces with additional pages, and particularly, a repositionable mounting surface with a fold-out feature. The add-in components act as a mechanical means for adding "a window system to the host object" and may be configured from a set of building blocks. Entirely new information handling metaphors may be developed from the add-in components in the form of books as well as other objects. The other objects would be objects typically used for representing and accessing information, such as calendars, record keeping devices and the like. In addition to "host books" of the conventional variety, this invention relates to electronic notebooks of the notebook and palm size, which themselves may have software/electronic window systems.

The invention further relates to toys and games and the use of the configurable add-in window system parts as knowledge processing objects for store and order scripting. The toys and games may be mechanical in composition or may rely on a host object with electronic information handling properties. The host object may itself have a software/electronic window system of its own.

Host books are typically sold in a variety of forms including glue- or tape-bound with cover, staple-bound with cover, spiral-bound with cover, and ring-bound with cover. They may have a fixed or variable number of pages or no pages, and the pages may be blank pages, pages with text or pictures, where the text may be formatted or unformatted. Typically, host books with pages that are intended for writing or which contain text and or pictures in any form do not easily allow for the insertion of notes, except for use of margins, specially identified format blocks, or spaces between lines or pictures. Arbitrary notes must be taken on loose pages which themselves can be retained in the host book in a variety of ways as marks. Host pages that have pre-defined formats support structured entry of information but often do not support arbitrary input or output notes very well.

Host books have pages which are typically bound in a sequential order. If the pages can be repositioned, it requires opening of the binding and the removal and reinsertion of the pages to be repositioned. Tagging these pages or marking them for reentry requires (a) folding the page, (b) placing a loose mark in the page which could fall out, or (c) binding a mark that attaches to the page and stays on the page unless physically removed and replaced at another point. Noting or marking in this way either damages the book or covers the written material. Additionally, this type of marking does not easily allow for the continuous collection of information on the mark as the mark is moved through successive pages.

Electronic, computer-based text has been developed which can be accessed on-line via a personal computer or through a shared information utility and which addresses the issue of flexible information manipulation. The basic technology is known as hypermedia, and specifically, as it relates to textual information, hypertext. This capability provides the individual the ability to attach new information to any context he or she is working with, and to view that portion or chunk of specially tagged information out of context from its location in relation to other such specially tagged information, or in context with its location in the body of the text. In this sense, "hyper-access" means that one may view the tagged information dynamically out of context as well as in relationship to the source item or items. The mechanism provided for viewing information on the computer is known as "multiple-windowing". This feature has proven very powerful and has opened up entirely new applications for computers in desktop publishing, computer-aided design, project management, and the like.

This capability of multiple windowing has been unavailable to users of blank books due to the inherent limitation of physically bound surfaces and their supporting bindings. The lack of windows in conventional books has made the context-independent access of information available only through the limited means of fold-out pages.

Previously known add-in page systems do not offer the important feature of windows, the key feature of which is the ability to maintain the face and perimeter orientations of the add-in surface in all of its possible context-independent, floating positions.

Other add-in facilities that may offer additional writing surfaces offer limited positioning of the surface, restricting the add-in to the front or the back of the book and restricting the interleaving of the surface with other surfaces the book may itself hold. Other add-in facilities assist in the page turning process but do not offer any additional facilities for note-taking. The previous alternatives that suggest the use of a frame use dual-arm frames that enclose the entire host object in a brace. That approach is cumbersome and unnatural for the host object and represents an obstruction for the user. Additionally, the frames of that variety add additional weight to the host and in the case of books, obstruct multiple indexing. Multiple indexing involves the indexing of a plurality of edges of the host books leaves.

In the case of notebook- and palm-size computers, the window system is restricted to the size of the screen the host electronic device contains. In the smaller sized notebook- and palm-sized computers, this visual space is restrictive and does not enable a plurality of contexts to be viewed at one time.

Furthermore, in the case of books, configurability is usually limited to forms and add-in leaves. Forms presume the structure of the information that is to be collected and the way in which it is to be collected. Books of this type do not reflect the information map of the user's mind, the frequency of access to certain types of information, the time value of that information, or the linking of that information to other information of related properties. These types of books offer limited robustness, typically providing ring mechanisms for extending the information architecture of the book. They require eye, hand, and mind to restructure or prepare for access, often interrupting the dynamics of the capture-and-represent process of information handling. Books have not been able to provide users with facilities comparable to the interactive windows of computers, limiting the development of an appetite for non-linear information handling among users of conventional books. Computer vendors have been unable to offer users the familiar metaphor of a page, requiring the user to process information in metaphorical window pages. The thinking and learning process is facilitated by the combined use of the eye and the hand. Although the mouse has offered a very large advantage in this area, the page turning metaphors that have been offered mirror the use of a page of a conventional book in a similar but much more limited way and do not adequately reflect the visual/manual restructuring of knowledge inherent in solutions like the mouse.

Toys and game scripting metaphors exist to facilitate the process of a game. These tools are often game-constrained—i.e. offer utility only in relation to the game itself—or, if useful outside of the game, do not support knowledge-intensive activities. Dice are an important gaming metaphor but do not assist the user in a robust knowledge-specific fashion. A blank drawing pad and pencil can be used in creative ways in both games and the real world, but do not offer sufficient robustness in the sense being discussed here. Currently, there are no known puzzles or games that allow for the use of functionally equivalent, let alone identical, tools of the nature of the present invention, within the game and outside in real life. Specifically, tools that can function in a similar fashion, being directed at deeper, multiple-level inferencing, and knowledge-based information processing in both the game and in the real world application. Games and toys exist where the ideas are useful in multiple realms, but not the actual physical object that the game is played with. An excellent example of a case where the object of the invention can be used in both environments is LOGO©. The physical metaphor, when made available, is a moving object which offers body syntonic learning opportunities, but the object itself is not typically intended for use outside of the game. Making the LOGO© object a robot or a factory system begins to bridge this gap of utility. However, although computers offer promise in this area, i.e., where the computer is played as a game and then used as a device, computers are limited in availability, expensive, and suffer from the lack of broadly useful eye-hand metaphors as discussed earlier.

SUMMARY OF THE INVENTION

The invention, therefore, relates to frames, leaves, additional pages for a book, fold-out surfaces, and particularly to book marking and more particularly to a special purpose binding that offers dynamic book marking with a fold-out mounting surface capable of supporting additional foldable surfaces offering a mechanical windowing capability for traditional books.

This invention also relates to new book metaphors wherein the book is composed of frame leaves, surface attachments, suprafolded leaves, and hyperfolded leaves. These books being advantageous for, but not limited to, use with repositionable notes. The books offer a new architecture for information handling in which the input, processing, and output of information is coordinated by the configuration of the book and in which information processing is "object oriented". In this architecture, centers are identified for the representation and processing of categories of situations and information is passed to these centers in the form of messages. The messages are partial information structures that carry information or trigger actions which are implemented according to the methods of processing segregated within each center.

This invention further relates to special purpose bindings that provide window facilities for conventional books and electronic objects which may be books, toys, or other objects that are typically used for the purpose of information handling. It relates particularly to knowledge directed construction kits of the components of the invention—i.e., construction architectures which are determined by the type of problem to be solved—and systems whose configuration depends on the application, its complexity, and the degree of portability required in the final solution.

The invention is a special purpose binding which can be attached to a host book in a variety of ways, and which offers the arbitrary placement of a single surface or a set of surfaces which act as windowing surfaces such that each independent surface positions to insert itself within the host book or alongside the host book while remaining attached to the host at all times.

The invention further relates to special bindings that offer "hyper-extending" frames that provide a mechanical analog of a hypertext system and in this manner offer the facility of a new page for a blank book that can "float" from context to context within the book and be viewed independently of any page of the book, in sequence with any page of the book, or at the same time as any page of the book, while retaining an attachment to the book.

In addition, the invention relates to electronic add-ins for information-oriented host objects, books, toys, and the like where the electronic add-ins provide additional surface area for visual window processing, have the facility to record their motion and their position relative to one another and to the host object, enabling a multitude of artificial intelligence facilities to be provided in support of the host object, such facilities being dependent on the category and frequency of use of the add-in frame and folding modules.

It is the object of this invention to provide a form of "mechanical hypertext system" which provides a repositionable surface with a plurality of folding surfaces on it. The plurality of surfaces, viewed as floating pages, behave as pages of the blank book when positioned within the host book, turning as would the pages of the enclosing book. The floating surface then allows for the arbitrary collection of information in the form of notes, lists, etc. Additionally, the surface operates as a "host book mark" to allow the location of any page position in the host book. The mechanical binding offers a cluster of surfaces for the purpose of abstracting and classifying information. Additionally, it offers a means for the information to be accessed, and reused in a more flexible manner by providing a "floating" blackboard-like system that can be continually positioned and repositioned to support the state of use of the host book, while staying continually attached to the host book. In this way, a surface intensive area may be deployed, which contains a large reusable space packaged in the effective area of a page of the host book, compactly provided on a repositionable frame. The method enables the reconfiguration of folding surfaces such that they may be placed in arbitrary position with respect to one another or may be removed, substituted, or reconfigured to suit the user's end application. Thus, the mechanism allows for the continuous collection and depositing of information on its surface as it is swept through the pages of the host book. This enables the filtering and selection of information from the host book onto the surface, the abstracted information of which may be used in an ad hoc fashion out of the context of the original source materials, effectively offering the equivalent of hypermedia in a mechanical form of hypermedia(hypertext) surface.

The blackboard facility may be implemented as a surface intensive area using conventional means for the manipulation of information or electronic means employing software, windows, and visual manipulation facilities available in such embodiments. In this way a computational system with windows for associating information objects in the electronic device with other such objects in the device as well as information objects in the host is provided. This system, whether paper-based or electronic, offers a means for the non-linear representation and organization of information. In the case of the electronic device, the linking of objects can be further supported by pointers. The grouping of objects in the paper system can emulate the pointer linking and in this way a hypertext attachment for a blank book may be provided. Since the implementation is not limited to text, but may include pictures, graphics and the like—and in the case of the electronic module, sound, animation, digitized speech, audio recordings, film clips, sensations, pictures, etc.—the system is truly a hypermedia attachment.

Additionally, the ability to position the surfaces within the host book enables a new form of information processing where messages, typically in the form of removable adhesive notes (which may be positioned, removed and repositioned an indefinite number of times) are used in conjunction with the surfaces to allow for the rapid manipulation of classified and typed data. It is preferable for maximum usefulness of such a system that this type of message passing be accomplished within a very short time—e.g., within four seconds. The present invention supports message passing on such a time scale. A complete message passing system can thus be added to a conventional book, allowing the message passing system to operate as a complementary facility without interfering with the original application and use of the host book.

The message passing can be implemented in a paper-based medium, an electronic medium, or a combination of the two. The accumulation of messages is accomplished according to a method of use which is called HyperFlow TM. In HyperFlow TM, there is a user interface defined by the manipulation of repositionable notes into groups. This is called HyperLook and is comprised of a method for grouping notes (HyperNote TM) into lists (HyperList TM) and lists into forms (HyperForm TM). Messages are passed from leaf to leaf in the system. This is facilitated by the types of leaf contained in the system among which include the HyperBinding TM facilities of the frame attachments according to the invention, the surface attachments, the hyperfold leaves, and the supra-folding modules according to the invention. This system offers a new way to implement common applications, among them time management, project management, and the like. The idea is so fundamental to the way one thinks and uses information, that it is applicable in almost any information handling situation and particularly lends itself to educational games, toys, and any knowledge processing systems.

It is the further object of this invention to provide a configurable construction set of knowledge representation components which themselves can be applied to a multiplicity of problems and applications. These add-ins may be used to construct any number of game scripts in which the storing and ordering, accessing, and communicating of information is of central importance to the game objective. It is also the object of the invention to provide a means whereby the physical metaphor of visually and mechanically positioning a leaf or a set of leaves of a variety of types may be used in both a mechanical embodiment and electronic embodiment wherein the same or very similar information handling process is utilized. The advantage this intends to offer is a means to improve the manipulation of information across a broad spectrum of configurations, within effective cost ranges and to make the process of information handling more enjoyable.

In accordance with this invention, a host book configuration could include a host book with a cover, a spine, and pages, and a frame-leaf member bound to the host book in such a way that the host book pages could turn freely and independently of the frame-leaf member, which itself could be manipulated independently of the pages. An alternative host book configuration would include as a host book a simple cover and spine, the pages of the host book comprised solely of frame-leaf members, in which case the book acts in stand-alone fashion as a mechanical hypertext system, with notes and messages passed among the pages of the book thus formed.

In accordance with the invention, a mechanical binding system is provided having a fold-out leaf. The mechanical binding system has a leaf, a frame, and an adapter with means to combine frames into frame sets, as well as a means for attaching the frame to the host blank book. In the preferred embodiment, the leaf has a plurality of folding surfaces, a mounting surface, and an orientation structure formed as an orientation flap. The orientation flap is connected, i.e. pivotally hinged, to the back of the mounting surface leaving a free edge. The frame has an outer arm, a lateral connector arm serving as an extension structure, and an inner arm. The adapter acts as a coupler for retaining the inner arm of the frame and also functions to connect frames into frame sets as well as for attaching the frame or frame sets, as the case may be, to the host book.

The mounting surface of the leaf is a plane that is rectangular in shape and whose width is at most equal to the width of the frame. The orientation flap hinges to its back along a line defined by points equidistant from the parallel lateral edges of the mounting surface. The free edge of the orientation flap is pivotally hinged to the outer arm of the frame allowing it to rotate freely about the arm. The connector arm of the frame is of length at most equal to the width of the cover of the book, and extending greater than the widest page of the book, and the inner arm is of length at most equal to the length of the back or binding of the host book, such that the mounting surface and orientation flap can be positioned within or alongside the host book to the right or to the left. The adapter has a means for pivotally and removably retaining the frame and joining one or more additional frames, and has a length substantially equal to the book binding and allowing the inner arm to frictionally fit within the book binding. The adapter has a means for fixing itself to the host book in such a way that it is semi-permanently attached to the book and translationally stationary, allowing the inner arm to rotate 360° around the host book. The leaf member may be positioned within the closed book arbitrarily between any pages, or extended outward to either side of the book and placed on a work surface lying flat such that the pages of the book are in plain view with the mounting surface placed to either side of the book in plain view. Plain view offers visual access to the manipulated surface in the same orientation in each position to which it is moved. The orientations of the face and perimeter features are preserved relative to the host and to themselves from position to position. For example, an object viewed and read from left to right, will be seen in its left to right position whether lying on the surfaces of the book, preserving the "foot print" of the book (as when opened while carrying the book), or to either side edge of the book (as when operating with the book on a desk).

Other leaf types would implement the mounting surface and orientation flap with an extension flap in place of the frame, as an add-in HyperFold TM module, in and of itself. This module (i.e. the mounting surface and orientation flap) would be attached to a second mounting surface serving as an extension structure(a frame implemented as a rectangular surface). These embodiments of surface attachments could be attached to a binding structure, i.e. a spine, ring, staple seam, glue back, cover jacket, or like attachment location, as detailed to follow, or could be cascaded on leaves which themselves are bound to host objects directly or to frames.

Variations on the leaf member would allow for the mounting of a plurality of folding surfaces on the mounting surface. This plurality of folding surfaces could have a variety of folded configurations and could contain various means for retaining loose pages such as envelopes, pouches and the like, and on whose surface might be placed an array of stacks of paper. One type of stack would employ removable adhesive notes on which information could be recorded, where the notes could be removed and posted to other pages of the leaf or of the host book. Another leaf variation would be a leaf as a mounting surface comprising one or more coupling structures for attaching leaf sets on frames, as well as for directly attaching pluralities of leaves in various lengths and widths. Another element which could be mounted on the mounting surface might be an electronic device capable of electronic recording of information, such as a computer device. The electronic device could be any variety and could possess the ability to capture, store, access, display, and transmit electronic information. The mounting surface might itself comprise an electronic device. A variation of the electronic surface and frame would enable the frame to couple to the host through a host coupling structure wherein all parts comprising the surface, frame, and coupling structure are capable of the bi-directional transmission of electrical signals. An electronic device with infrared radio wave capabilities would provide the ability to bi-directionally transmit electrical signals without the need for a direct backplane connection, i.e. a wirefree connection. An electronic host with infrared could also be coded with algorithms that could determine the position of each electronic device mounted as part of the host configuration system enabling a variety of features that would utilize knowledge about the relationship of the windows to one another and to the host. Such an electronic leaf could support a window system that could provide a means for displaying electronic information from an electronic host as well as from other equally suited leaves. A leaf could be fitted with an optically sensitive device which could recognize when the leaf was turned to and could facilitate the counting of leaf turns. A leaf could be fitted with a scanning device which could also house a word processing facility. In this way another form of interactive hypertext facility could be added to a published book and facilitate the process of reading and developing written materials.

A special type of hyper- or supra-folded module would offer significant advantage in implementing an object oriented notebook system. Such a supra-folding module would be configurable from a set of leaf components. When combined, the module could operate in a stand-alone fashion as a notebook. A more powerful idea would be to combine the modules into a book as an add-in or leaf mounting facility according to the invention. The supra-folded module itself would comprise a base with one of three variations. The base would receive one of four types of leaf sets, one with a binding on the left, two with bindings on the right and sized to leaf past one another if coupled together at their respective binding points, and a fourth "one-half style leaf set" that would allow for a partial list management surface if used alone, or if mounted side-by-side could provide dual list facilities on a single surface as in the multi-frame surface attachment. When configured, a set of pages in a leaf set could be placed in the center fold of the base allowing for the selective viewing of one or more of the pages of the leaf set, along with the selective viewing and manipulation of information on the other folded surfaces. The base can be mounted to a leaf or a frame enabling the progressive engineering of more and more robust object-oriented, agency-based, knowledge-oriented information handling systems.

Host book spines come in a variety of types for which the invention is intended to be compatible. One type of host book is a multi-ring binder; another type is a finger clasp binder. A third is a spiral binding. A fourth is a glue-bound type. A fifth is a staple-bound variety with a cover mounted over the staple binding forming a cylindrical gap. A sixth is a glue-bound type with a cover mounted over the binding forming a cylindrical gap. A seventh type of book spine would be formed by a post element which would enable the attachment of frames with inner arms that mate to the post. A spine that would be of particular use with the leaf inventions proposed here would be one that allowed the suitable configuration of the above-mentioned leaf types while retaining a flat composure. A clip system or reusable tape binding system could provide this capability. A host book spine could be implemented that itself housed a single arm frame. The spine would itself provide the hyper-extending facility that allows for the plurality of positions of the face of the leaf mounted thereon. A spine could be fitted with microcircuits that could sense the mechanical positioning of the frames fitted within it, or could itself be an electronic backplane with suitable facilities for the bi-directional transmission of electrical signals with frames, capable of extending the backplane after this fashion, thereby forming an electronic bus structure.

Other embodiments include various other embedded versions, i.e., versions that fit within a conventional host book of the varieties mentioned. With the appropriate adapters, the embedded versions provide hybrid bindings enabling the combination of the host book spine and its pages in conjunction with a configurable set of hypertext book attachments according to the invention.

One set of embedded embodiments utilizes various forms of the inner arm post as a means for attaching directly to a host book spine. In one variation, the inner arm is a post that fits frictionally into the spine. In another variation, the post is formed with a cap which is used as a retaining means. In a third variation the retaining means is a convex hook attached to the end of the post. A fourth variation would use an ear hook mounted along the post. A fifth variation would have the inner arm formed as a hollow tube offering a female socket for joining to the book spine.

If desired, a retention tube may be fitted and retained within a spiral (or other type) binding of the host book. This tube would have an inner diameter sized to frictionally and pivotally receive the inner arm of the frame. Alternatively, two frames could be used, with shorter inner arms fitting within the retention tube from the top and the bottom. These could be used to hold one frame both from the top and from the bottom or to hold two separate frames.

Another embodiment would include having two frame inner arm members shaped to mate telescopingly, so that one could be inserted from the top of the binding and the other from the bottom. They would telescope together within the binding and so be held in position by friction.

Multi-frame books can be comprised by taking the single arm frames and coupling them to various host object coupling structures, thus forming a book with only frame pages, where the frames can be moved to facilitate access to any surface. The preservation of orientation would be useful in a number of such configurations; however, simple frame leaf combinations would also offer advantage.

Various means could be employed for retaining the leaf orientation flap on the outer arm of the frame. One variation would provide an adhesive, permanent mount on said free edge of said orientation flap. Another variation would include a set of clamps on the leaf orientation flap which is snapped onto the outer arm post. Yet another variation would provide means for the post to snap into a tube connected to the leaf's orientation flap binding edge. Two frictional variations would include one in which the post fits snugly within a tube attached to the leaf; the other would have the outer arm of the frame kinked slightly such that, upon insertion in a flexible tube attached to the leaf, the friction is increased by direct pressure on the walls of the flexible tube.

A rotating and sliding configuration would enable the movement of a leaf into four positions preserving the orientation of the face surface in all four positions and offering unobstructed access to either surface in any of the four positions.

There are many variations of adapters. One embodiment would be a simple hollow tube which could be attached to a book spine. A second variation would have spurs on the hollow tube. A third variation would have a slim clip for sliding into a cylindrical gap in the host book spine. Another variation would have a broad clip for attaching to a book cover of a paperback glue-bound book. A fifth variation would include a hollow tube with ear hooks along its edge. Yet another variation would include a hollow tube with rivets. A seventh variation would include a hollow tube mounted on a card wherein the card could be a plain stock, a stock with multiple holes punched or a stock element with a folding crease defining the position for mounting the tube. Any variety of hybrid bindings may also be formed by combining the hollow tube adapter with, for instance, a multi-ring binding. Two variations of this type of hybrid would include a version with the tube mounted on the spine of the multi-ring binder, or a version in which the tube/multi-ring assembly is mounted on a card.

An adapter for a spiral clasp would mold a retaining tube along the length of the spine so as to let the clasps engage freely while allowing the frame to be attached from above or below. The retaining tube could alternatively be positioned within the inner area of the clasps in such a way as to allow the clasps to engage while allowing the pages to turn freely, as in the case of the spiral.

Another adapter would be a card of rectangular shape one edge of which houses the retainer for the frame. The retainer might be a tube as in the case above and the card might alternatively have a multi-ring binding on it as well. This hybrid binding would be able to be slipped into the jacket of a host book cover allowing the entire complement of bound leaves and host spine bindings to be moved from cover to cover.

In the case of multi-ring bindings, another embodiment would allow an adapter to be fitted into the rings as a page would be inserted. In this case, the adapter would position the retaining means within the inner area of the ring set allowing the frames to be attached without impacting the mechanism for opening or closing the rings.

An adapter could be implemented that itself housed a single arm frame. The adapter would telescope and itself provide the hyperextending facility that allows for the plurality of positions for the face of the leaf mounted thereon. A spine could be fitted with such an adapter, thereby offering the ability to laterally translate a leaf while allowing the leaf to rotate on it as a page. The adapter could be fitted with microcircuits for the positional sensing of mechanical frames or could itself facilitate the bi-directional transmission of electrical signals as part of an electronic backplane system.

A variation that implements frame sets would have the inner arms of two frames joined in a hollow tube adapter which itself was attached to the host book spine. Another frame set variation would have the inner arms of the two frames join as male-female connectors. A third variation would have the inner arms of each frame attach pivotally to the host book through a direct frictional engagement.

Frame sets could comprise simple frame leaf pairs or frame leaf pairs that provide the facility of retaining the facial orientation of the leaf as well as providing for the ordinal repositioning of the frame/leaf members of the set. The ordinal maintaining means may be a property of the fixed, physical length of the connector arms, the ability of the frame to "stretch" allowing frames to by-pass one another, or the property of the adapter that allows the frames to be repositioned by lateral movement.

Another embodiment would form a new, stand-alone type of book with or without conventional pages. In a stand alone embodiment, the frames would be housed in an adapter which became the book spine in and of itself, with the pages of the book including various forms of retained mounting surfaces, each having one or a plurality of folding surfaces mounted thereon.

Various other book metaphors can be constructed from the basic elements of this invention. In one variation that employs a leaf set on a frame, the frame is coupled to a book cover with top and base covers. The top cover itself has a folding feature. The top cover can be positioned to the left of the base cover, exposing the leaf set. The top cover can house a note-taking reservoir in one of its folds. The leaf set itself enables the ordinal repositioning of each of its leaves. As a leaf is repositioned, it may be "flipped under" so as to become available on the bottom of the stack, or it may be flipped over and back to the left, and placed below the note carrying reservoir. In this way, when the book is closed, all the leaves thus placed will be flipped and returned back onto the stacked leaf set. The leaves can themselves be removable and thus, can be transferred to another, conventional binding.

A book with a frame or set of frames attached to a host book in one or more locations, one of which could include the book spine itself would offer various advantages in different applications. Equally, a host book comprised of the supra-folded modules constructed in a variety of hyperfolds, in combination with the orientation flap leaf attached thereon or attached to the host book covers would also offer significant advantage over current book configurations. A third type of book that combined the supra-folded modules and the frames would provide unique advantages not provided by either of the other types alone. For example, a face orientation preserving frame-leaf pair could be fitted with a reservoir of repositionable notes as well as with a supra-folded item categorizer, which could then be moved to each object-centered agency in an object oriented notebook architecture, each agency provided by another supra-folded module, providing the means for message generation and transmission among object agencies.

A construction kit could be provided enabling the building of any suitable configuration. This system could be provided as a game metaphor or directly as a puzzle. As a game metaphor, the system would be comprised of various component pieces that would be able to be fitted to one another and to a host object at a variety of coupling structures.

As a computational version, a computer system with a keyboard and windows provided on the floating leaves, each with orientation and ordinal enabling facilities, could be fitted with conventional paper as well. This type of system would be particularly useful as a personal information management system.

Equally important is the case where the book metaphor according to this invention is represented as a set of "visual algorithms" on a computer screen, each leaf of said book being represented by a window and each such window behaving according to its folding constraints as constructed in the particular configuration of the physical book. In this case, the windows reflect the strategy of operation of the book and can be developed for use separately (e.g., via a software tool kit) or can be used in conjunction with the actual physical embodiment. The strategy of organization may reflect a variety of organizations, not limited to representing a flow (HyperFlow), defining input, processing and output of information, time and category factoring of surfaces, and the like.

BRIEF DESCRIPTION OF DRAWINGS

The above and other objects and advantages of the invention will be apparent from consideration of the following detailed description, taken in conjunction with the accompanying drawings, in which like reference characters refer to like parts throughout, and in which:

FIG. 29 shows a perspective view of a book spine with a gap formed by the staple- or glue-bound insert and the cover;

FIG. 30 shows a side view of the book spine of FIG. 29 with the book open;

FIG. 31 shows a side view of the book spine of FIG. 29 with the book closed;

FIG. 32 shows a perspective view of another style of glue-bound book binding with a cover;

FIG. 33 shows a side view of the gap formed when the glue-bound book binding of FIG. 32 is in the open position;

FIG. 62*a* show a side view of the first of eight components of a supra-folded or hyperfold module, having a base module with four surfaces supporting six possible attachment locations;

FIG. 62*b* shows a side view of a three-surface version of a base module with five possible attachment locations;

FIG. 62*c* shows an alternative embodiment of a three-surface version of a base module with five possible attachment locations;

FIG. 62*d* shows a leaf set with a simple flat binding at the left with one attachment location;

FIG. 62*e* shows a "major" leaf set mounted on a card with its binding location to the right;

FIG. 62*f* shows a "minor" leaf set mounted on a card with its binding location to the right;

FIG. 62*g* shows a one-half leaf set with one possible binding location;

FIG. 63 shows a side view of one possible configuration constructed from the components of FIGS. 62*a–g*;

DETAILED DESCRIPTION OF THE INVENTION

Figure 1:
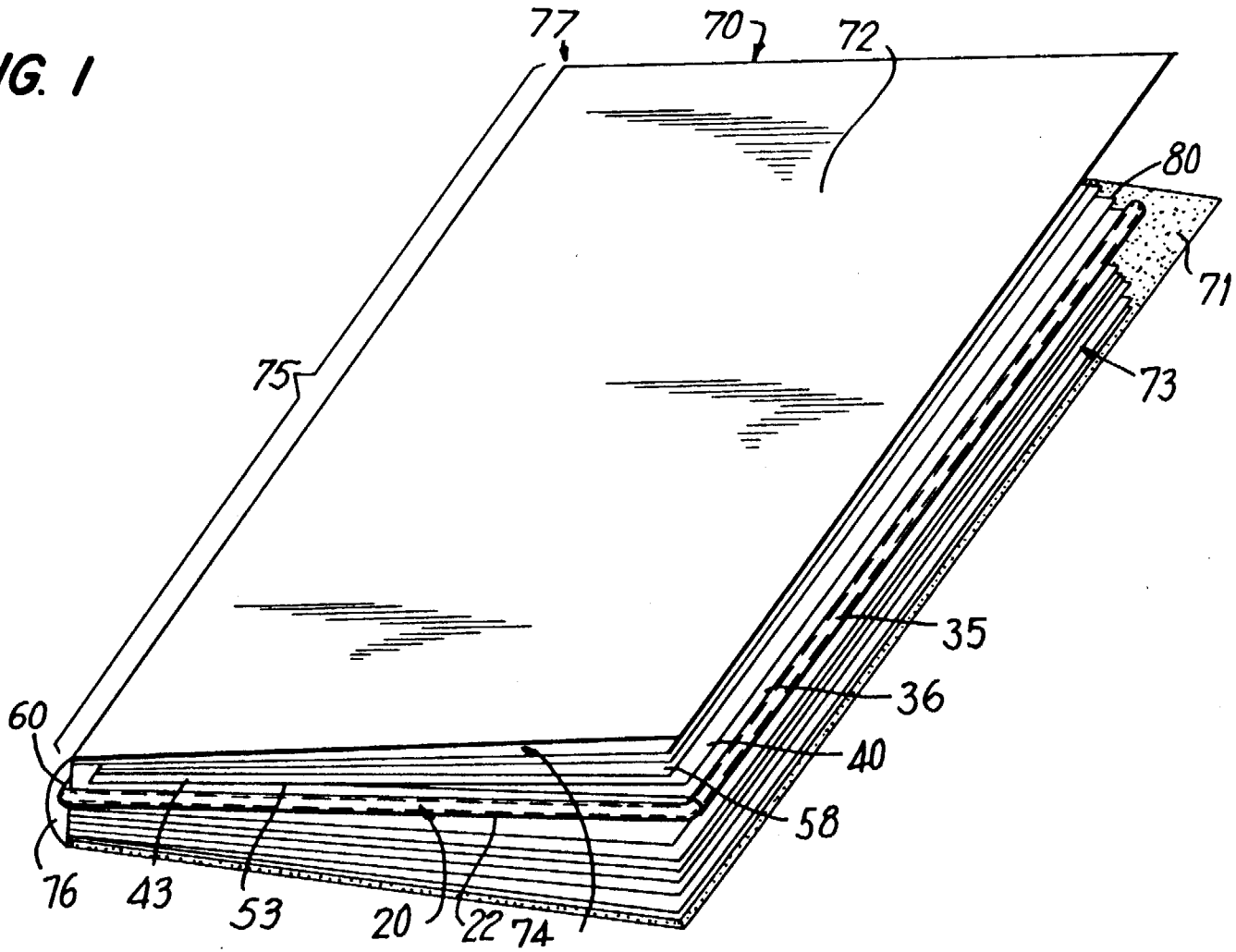
FIG. 1 is a front perspective view of a preferred embodiment of a note book with the attachment binding according to the invention, in the closed position.

A preferred embodiment of the book attachment of the present invention is the leaf and frame pair shown in FIGS. 1–7. A mechanical (hypertext) attachment 80, for a book is provided. As seen in FIGS. 1–7, the attachment has a leaf 50 having a plurality of pages 55–57, a mounting surface 40, an orientation flap 30, a frame 20, and a means for attaching the frame to a blank book 70 at the binding point of the book. An edge 32 of the mounting surface orientation flap 30 is attached to frame 20 via a retaining tube 35, and the frame 20 is attached to the book by means of an inner arm 23 and an adapter 60, where the inner arm 23 fits into the bottom of the adapter 60 through opening 61, with the adapter inserted into the book spine 75 through gap 76.

The mounting surface 40, has an orientation flap 30 having a width substantially half the width of mounting surface 40. Orientation flap 30 is pivotally attached to mounting surface 40 laterally along the back of mounting surface 40 on a line defined by the points midway in from the parallel edges of mounting surface 40, with its outer edge 32 free to be bound to the outer arm 21 (connected by connector arm 22 to inner arm 23) of frame 20 by a suitable hinge to enable it to rotate about the outer arm 21.

Figure 2:
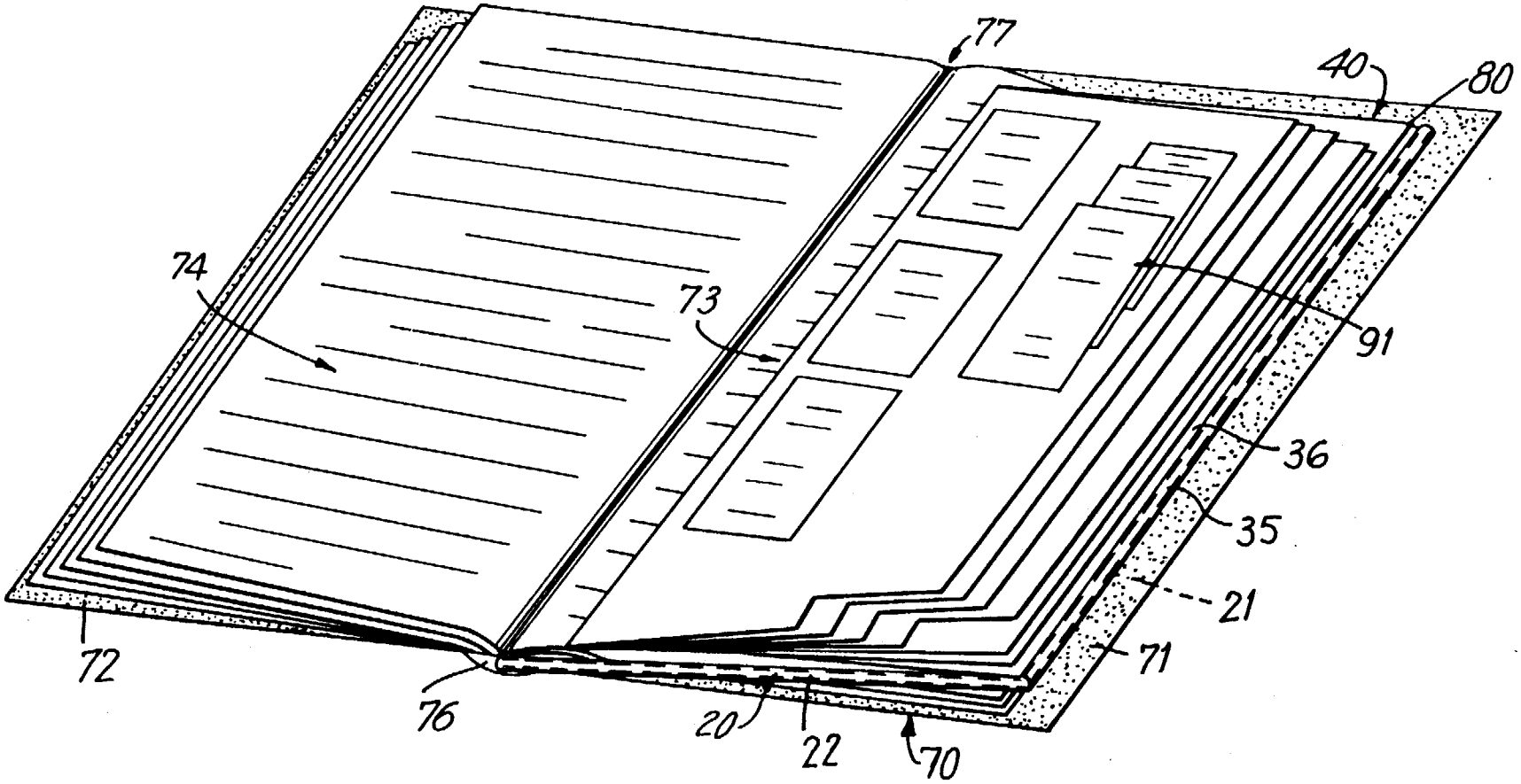
FIG. 2 is a front perspective view of the book attachment of FIG. 1 in the open position with the attachment positioned within the book.
Figure 3:
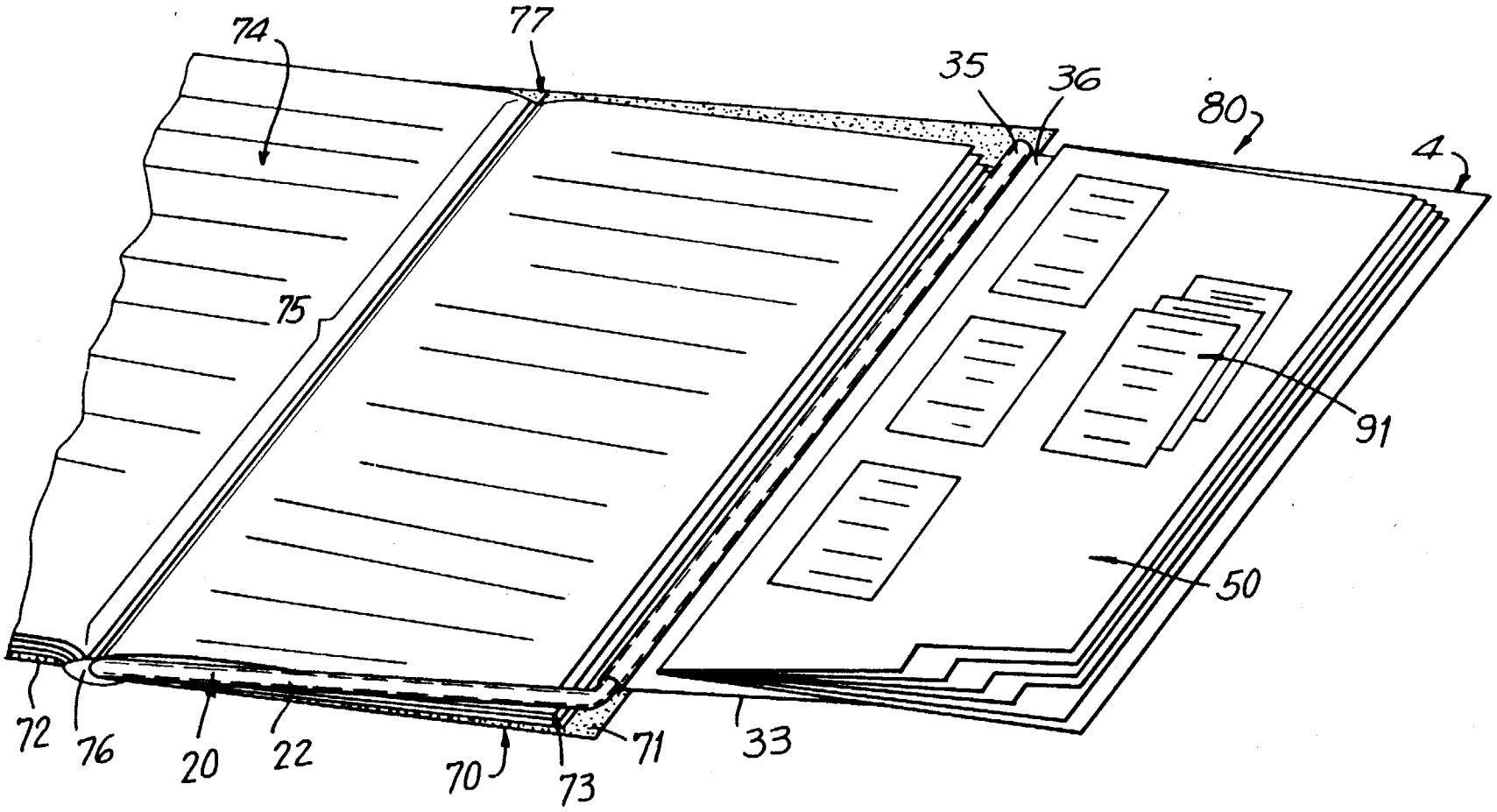
FIG. 3 is a front perspective view of the book attachment of FIG. 1 in the open position, with the attachment extended to the right along side the book.
Figure 4:
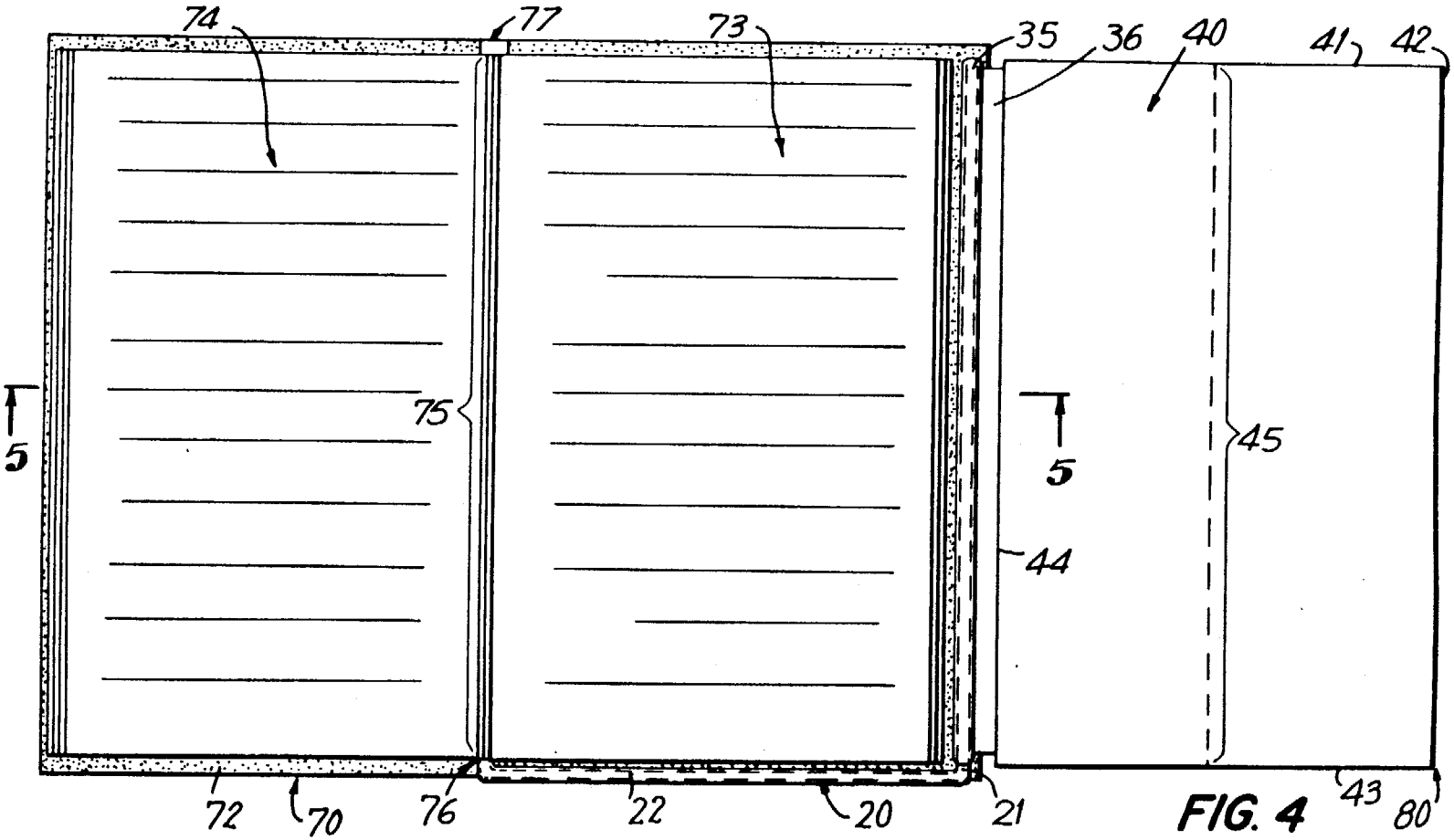
FIG. 4 is a front elevational view of FIG. 3.
Figure 5:
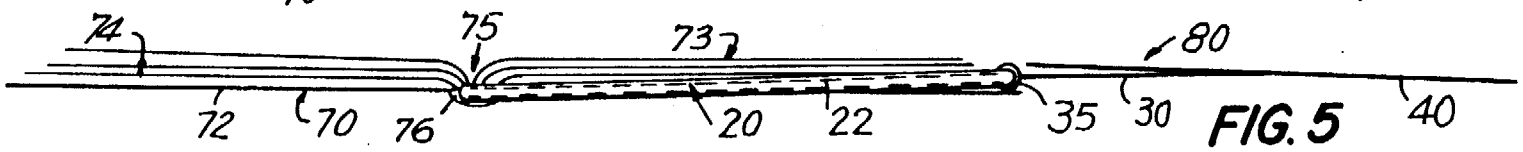
FIG. 5 is a cross-sectional view of the attachment of FIGS. 1–4, taken on line 5—5 of FIG. 4.
Figure 6:
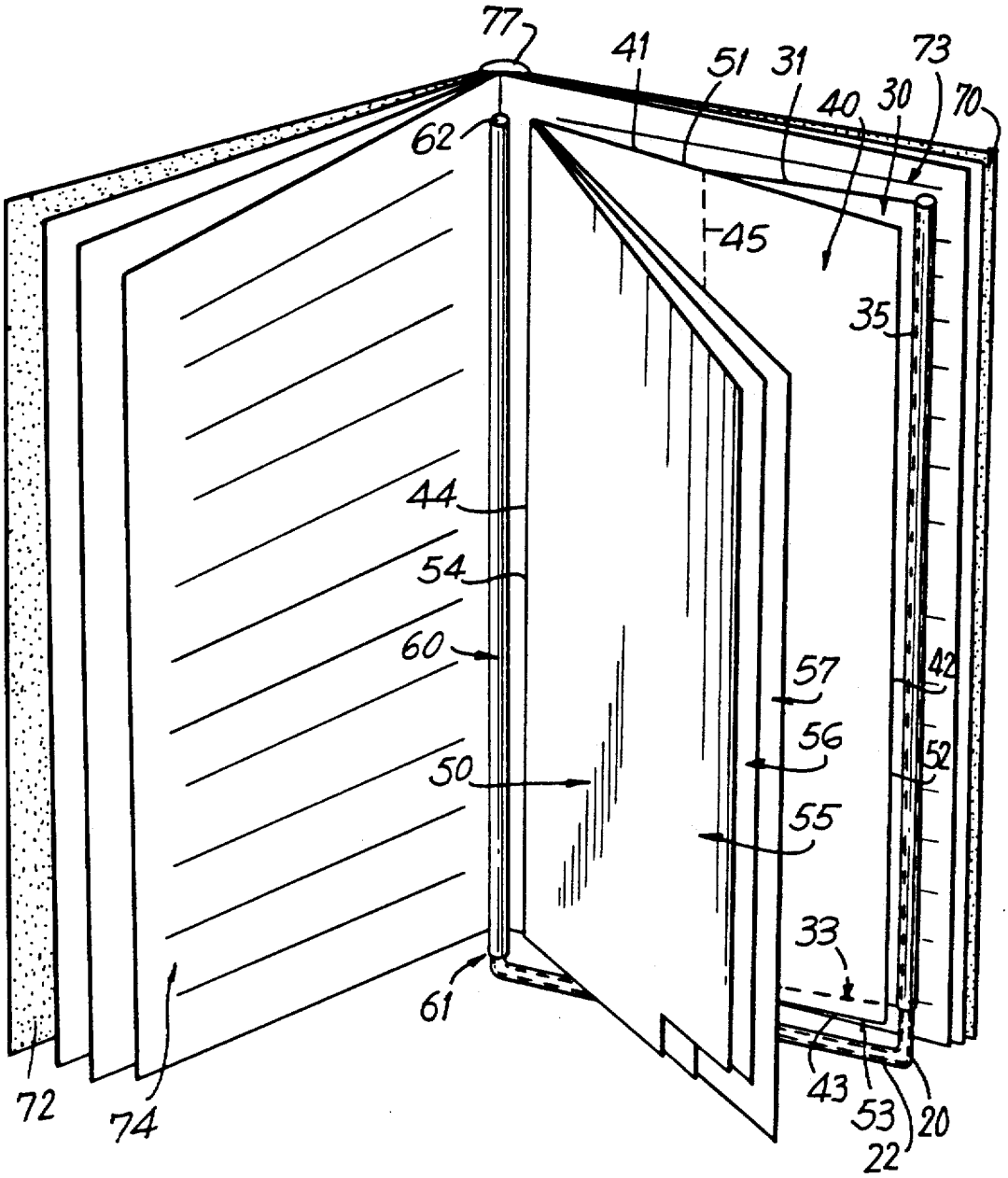
FIG. 6 is a front perspective view of the book and book attachment of FIG. 1 with the book open and the adapter mechanism exposed along with its frame and leaf attachment.

Mounting surface 40 hinges on the orientation flap 30 which rotates about outer arm 21 so as to position the flap surface out of the way of the pages of host book 70 allowing for the pages of host book 70 to be turned freely and enabling mounting surface 40 to be reinserted arbitrarily at any point in host book 70 like a book mark, and allowing book 70 to close flatly with the connector arm of frame 20 seated within the perimeter of the covers of host book 70 and not interfering with any of the pages of the host book. The plurality of pages 55–57, attached to mounting surface 40, thus become an add-on to the host blank book 70, and include one or more folded surfaces, envelopes, pouches, or the like capable of holding or storing information, notes, lists, removable adhesive notes, or loose pages of any type, each plane offering a plain view of its contents when opened to. And as shown in FIGS. 2 and 3, with inner arm 23 of frame 20 attached to the host blank book 70 by means of a suitable adapter 60 that allows the combination of frame 20, orientation flap 30, and mounting surface 40 to rotate about the binding point of host book 70 to which it is attached. The leaf can be rotated about outer arm 21 of the frame 20, and the entire frame and leaf can be rotated about spine 75. The leaf mounting surface 40 is so attached to frame 20, and the frame 20 so attached to book 70, that mounting surface 40 and its plurality of surfaces 50, may be positioned on either side of blank book 70, to be extended to either side of book 70 or, as shown in FIG. 1, to be folded into the book on either side while retaining the same orientation of the mounting surface 40. This property, enabled by the orientation flap, permits retention of the orientation of the mounting surface in a plurality of positions, not only with respect to a host book but with respect to the different positions of the mounting surface itself, and enables the property referred to earlier as windowing.

In this way the plurality of pages 55–57 may be placed in a position allowing their outer edges 59 to be accessible in the same fashion of the pages 73 of book 70. If mounting surface 40 is flipped on orientation flap 30 so that the edges 59 of the floating pages 55–57 are adjoining book spine 75, the retaining edge 35 of orientation flap 30, the edge 44 of the mounting surface 40 and the flat binding edge 54 of the plurality of pages form a single edge. The single edge formed by these surfaces is accessible as a single page operating as a marker. Orientation flap 30 and mounting surface 40 may be semi-permanently joined at that single edge using hook-and-loop-type fasteners, magnets, tape and the like, or by a spring or clip mechanism. The purpose of providing a joining means is to allow mounting surface 40 and orientation flap 30 to join and operate cohesively as a single surface when desired, while not restraining their separation and free motion, and allowing for the reconfiguration of the mounting surface to a position on either side of the book, either within or along side the host book.

Figures 4, 5:
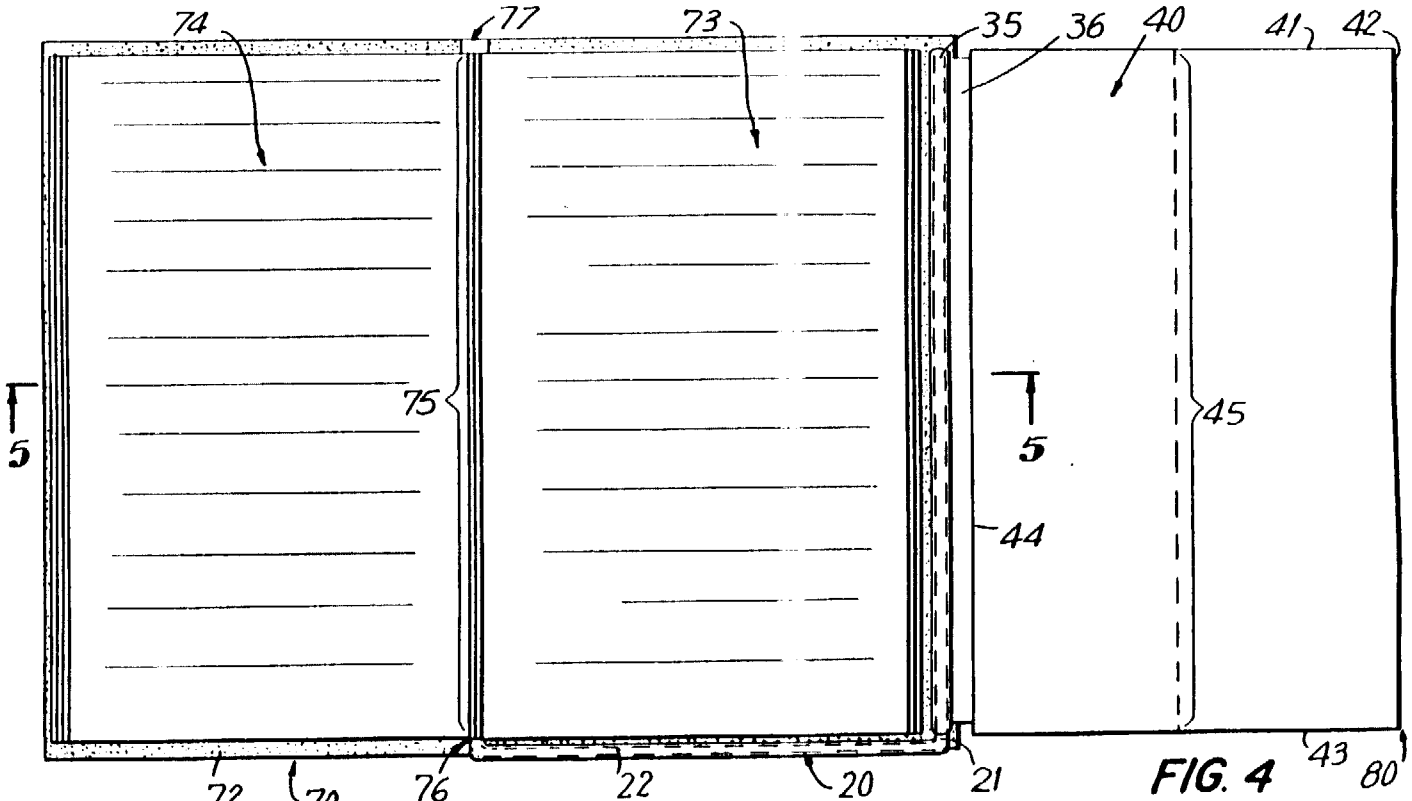
Figures 4A, 5A:
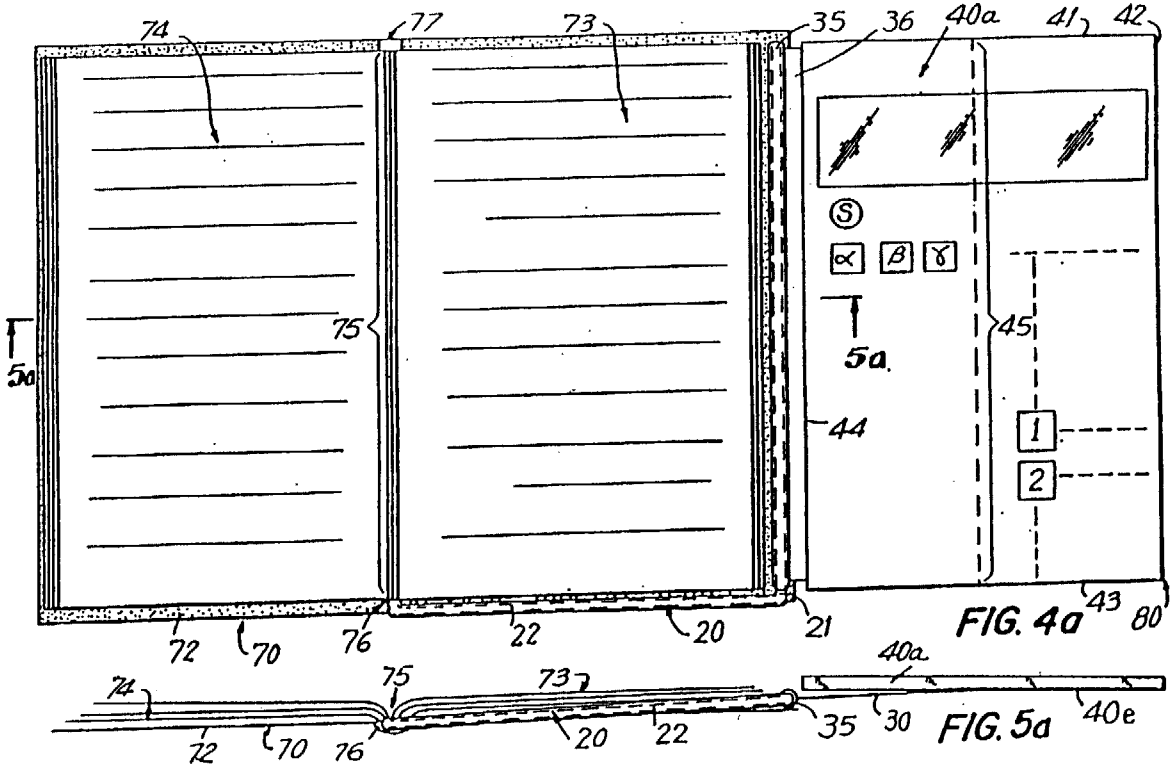
FIG. 4*a* is a front elevation view of a leaf mounting surface with an electronic device mounted thereon.
FIG. 5*a* is a cross sectional view of FIG. 4*a* taken along line 5*a*—5*a;*
Figure 6:
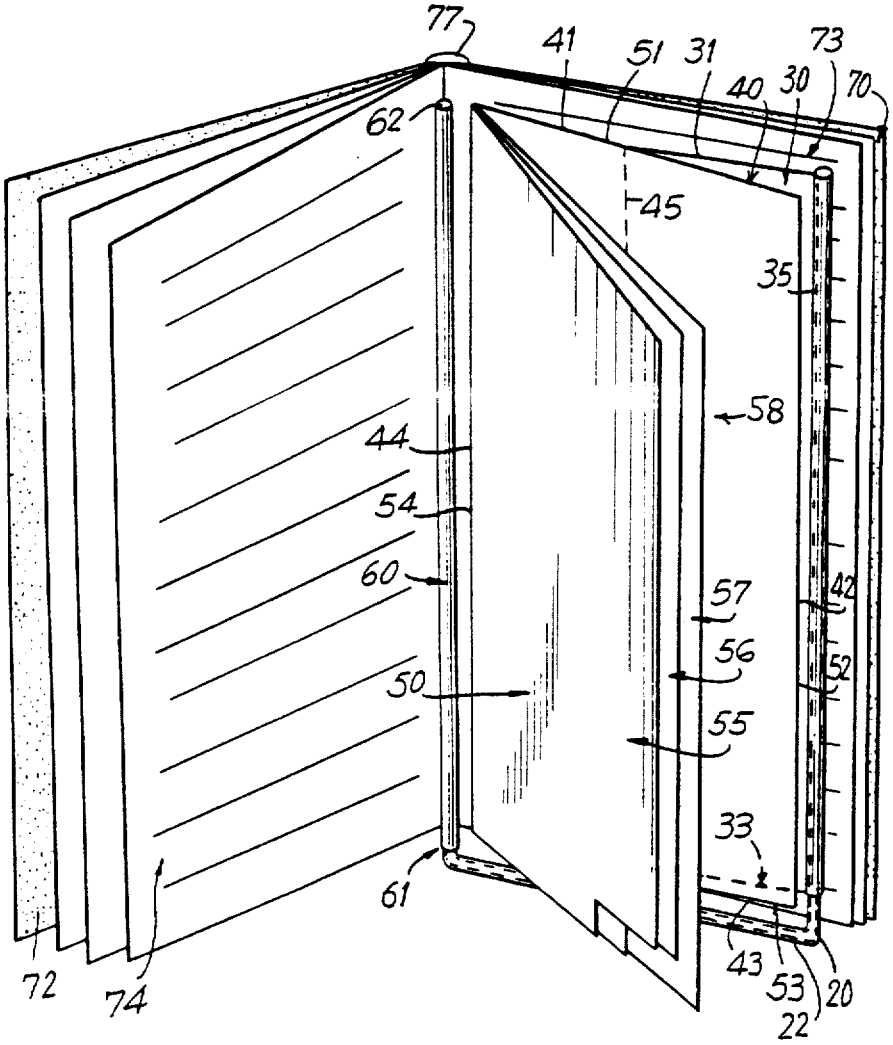
Figure 7:
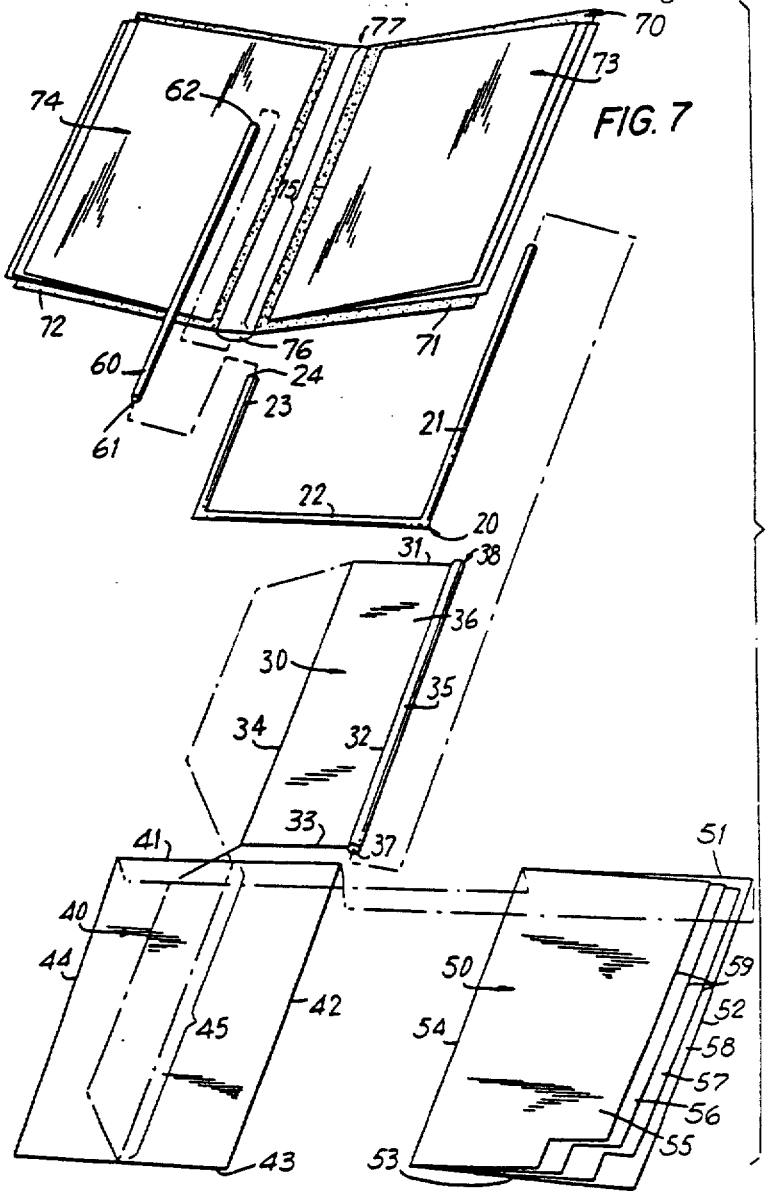
Figure 8:
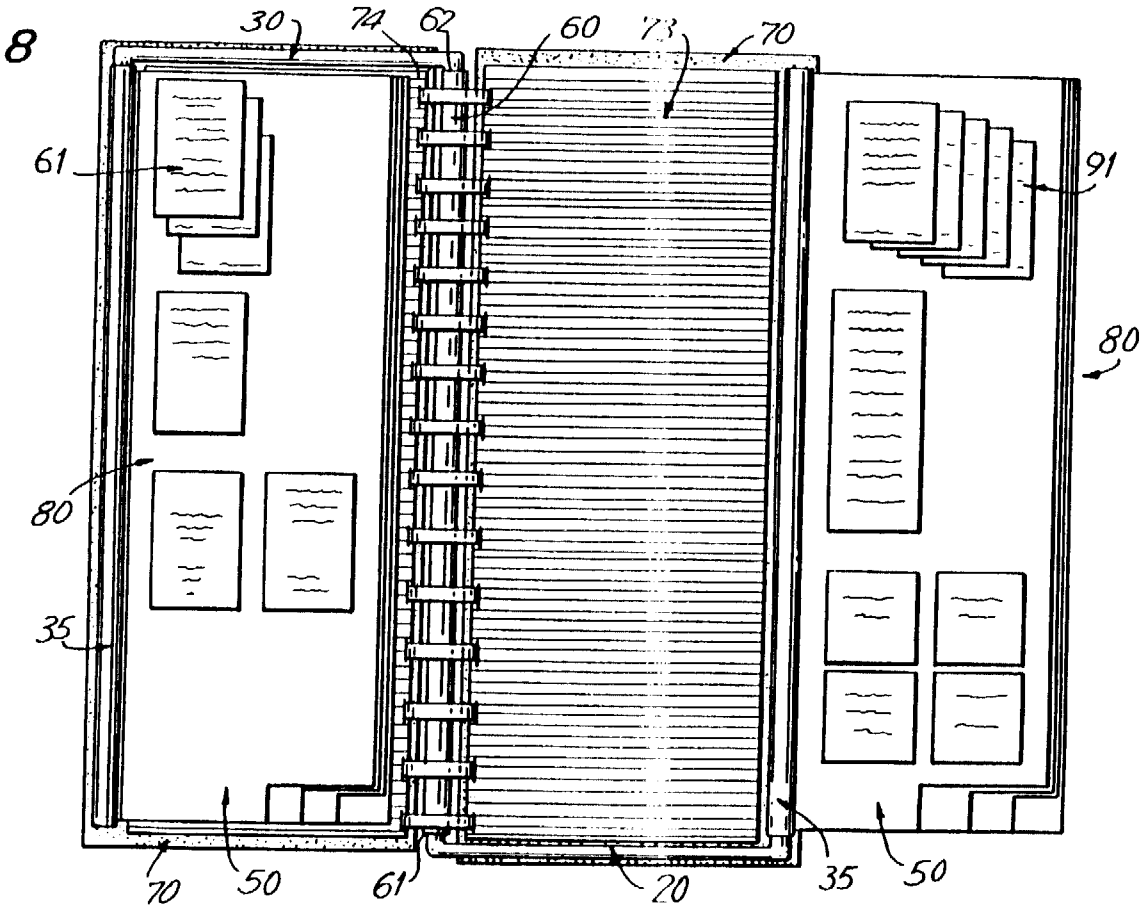
Figures 8A, 8B:
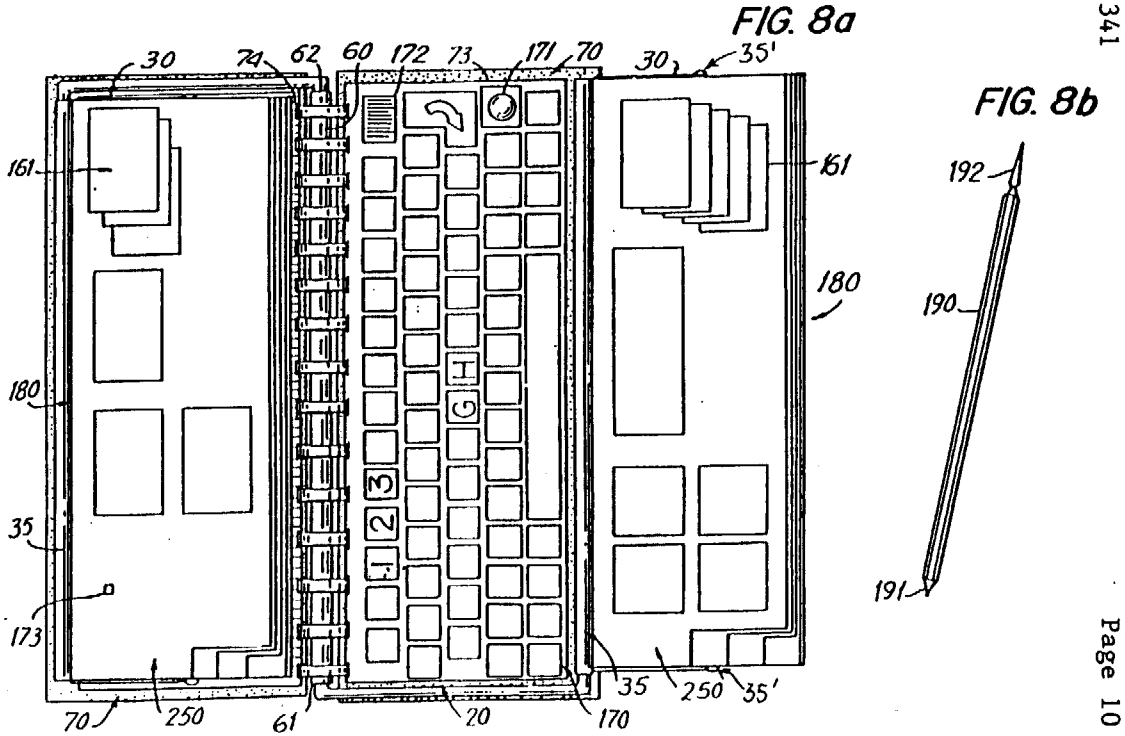
Figure 8C:
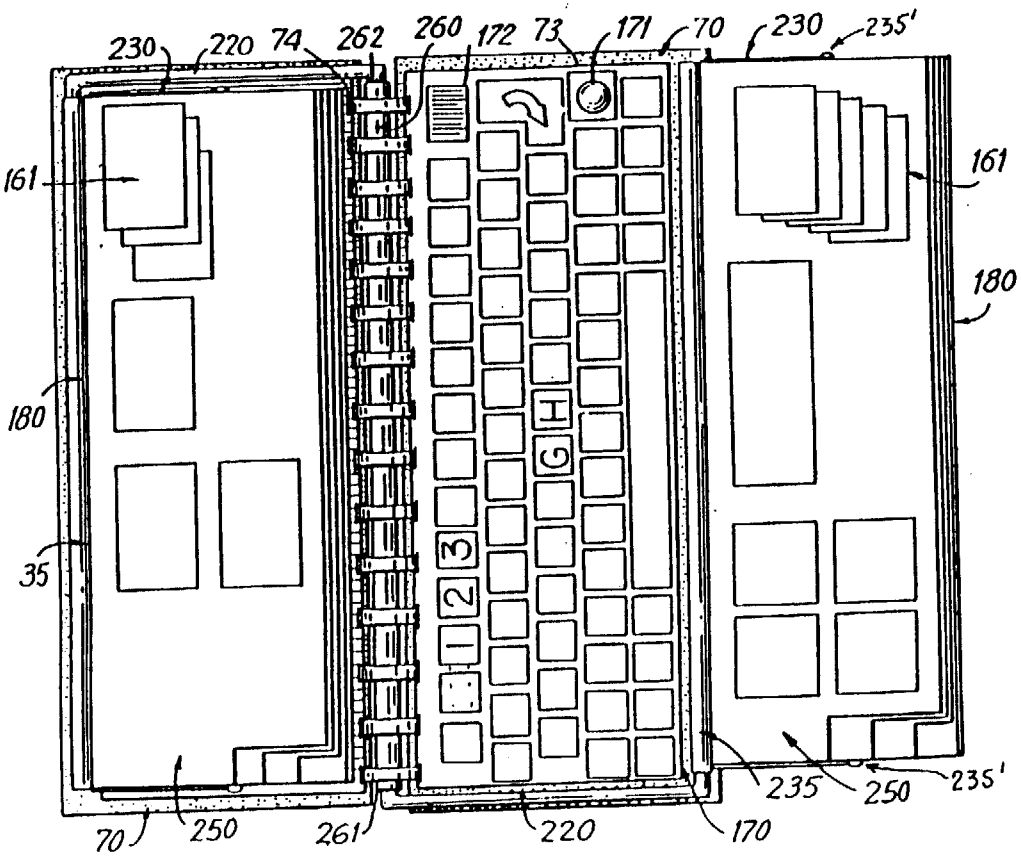
Figure 12A:
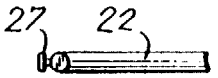
Figure 12:
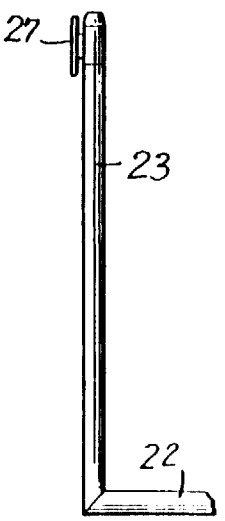
Figure 11A:
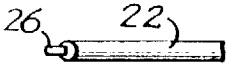
Figure 11:
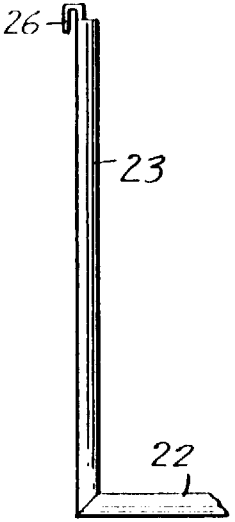
Figure 10A:
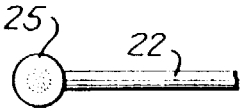
Figure 10:
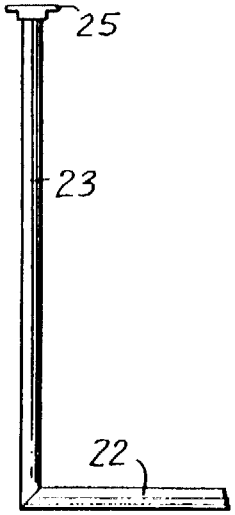
Figure 9A:
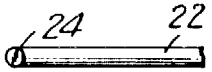
Figure 9:
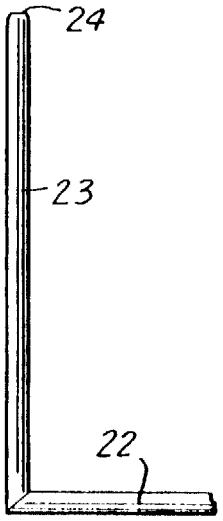
Figure 13:
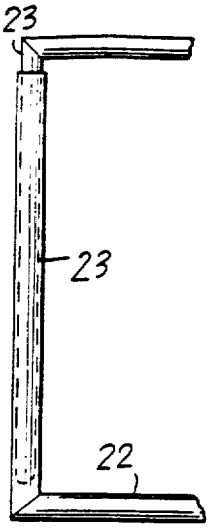
Figure 14:
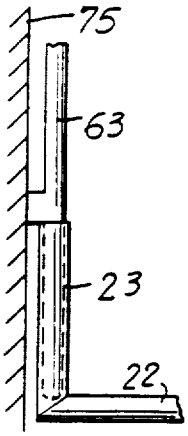
Figure 15:
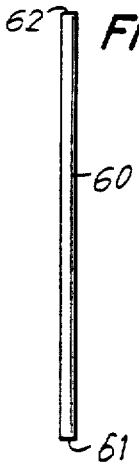
Figure 15A:
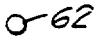
Figure 16:
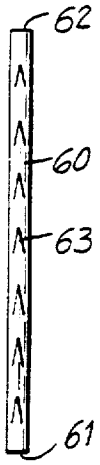
Figure 17:
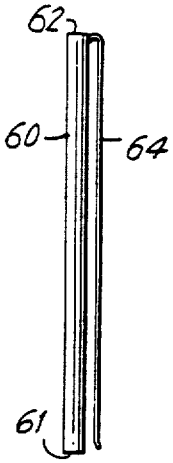
Figure 18:
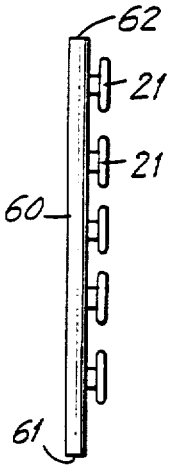
Figure 19:
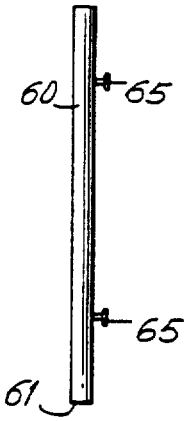
Figure 16A:
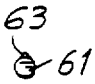
Figure 17A:
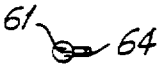
Figure 18A:
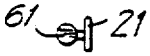
Figure 19A:
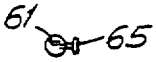
Figure 20:
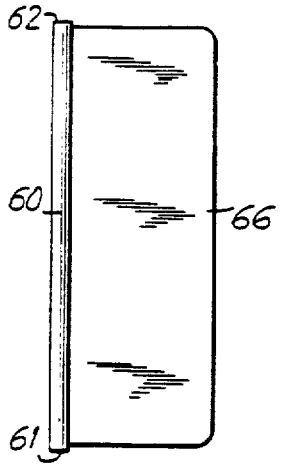
Figure 21:
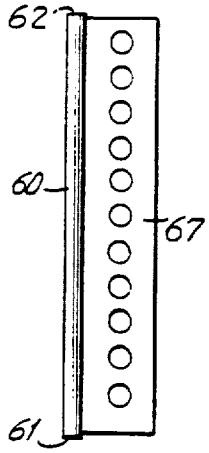
Figure 22:
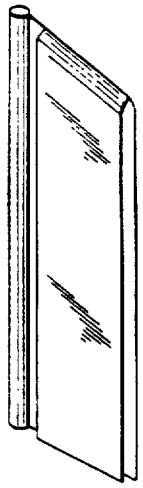
Figure 20A:
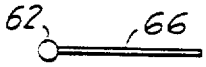
Figure 21A:
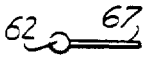
Figure 23:
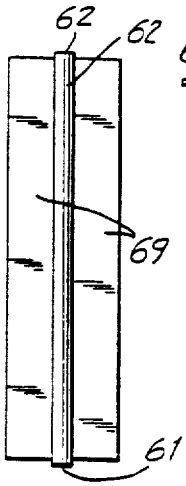
Figure 23A:
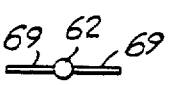
Figure 24:
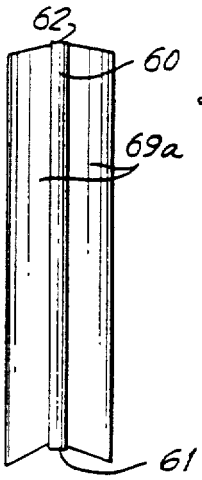
Figure 24A:
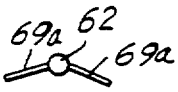
Figure 25:
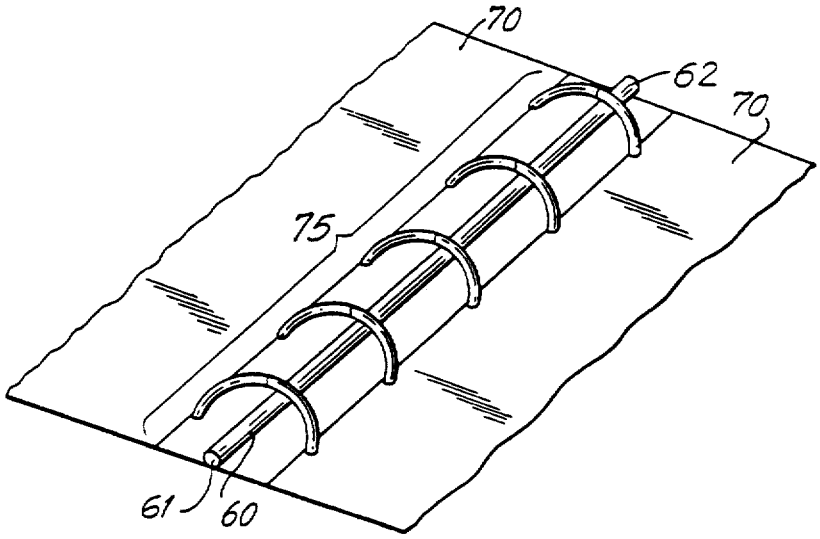
Figure 26:
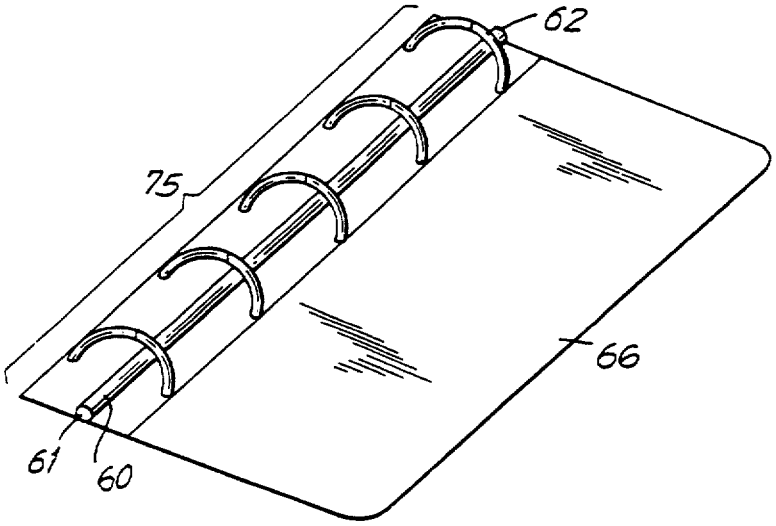
Figure 27:
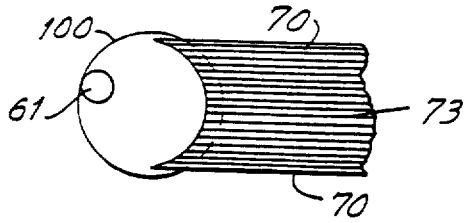
Figure 28:
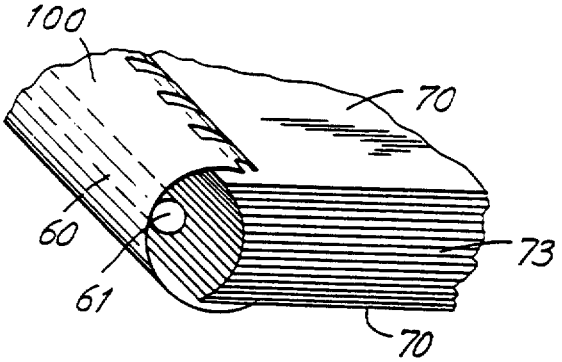
Figure 34A:
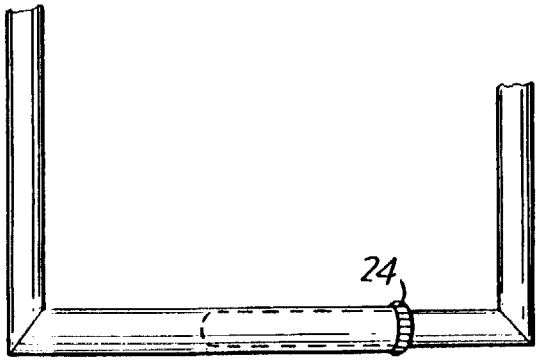
Figure 34:
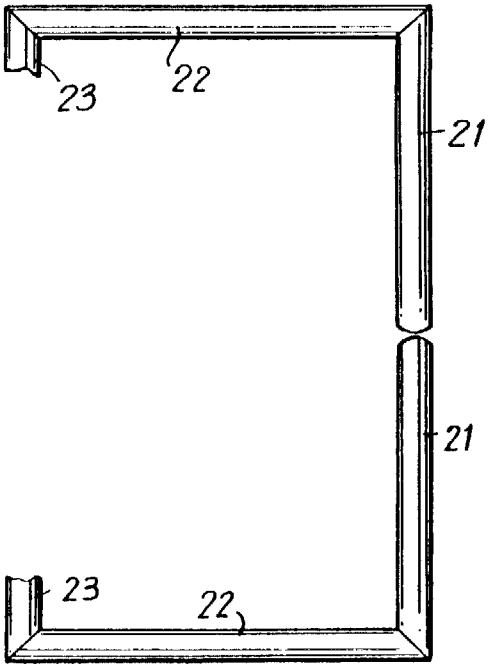
Figure 34B:
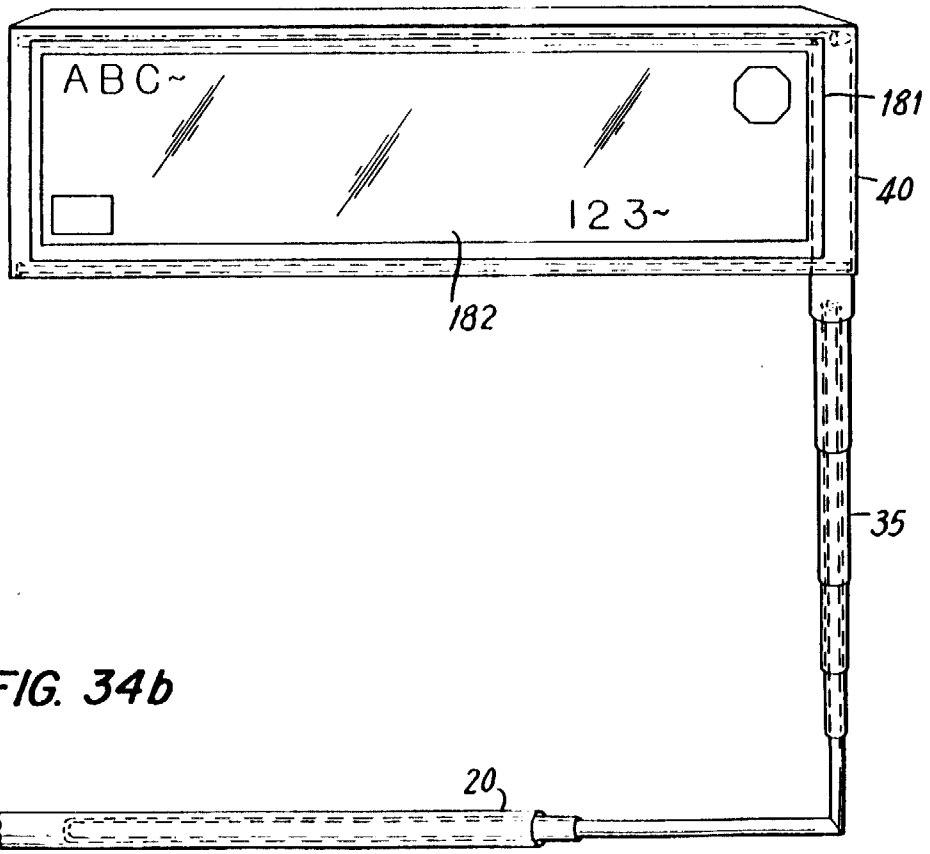
Figures 35, 36, 37, 38, 39:
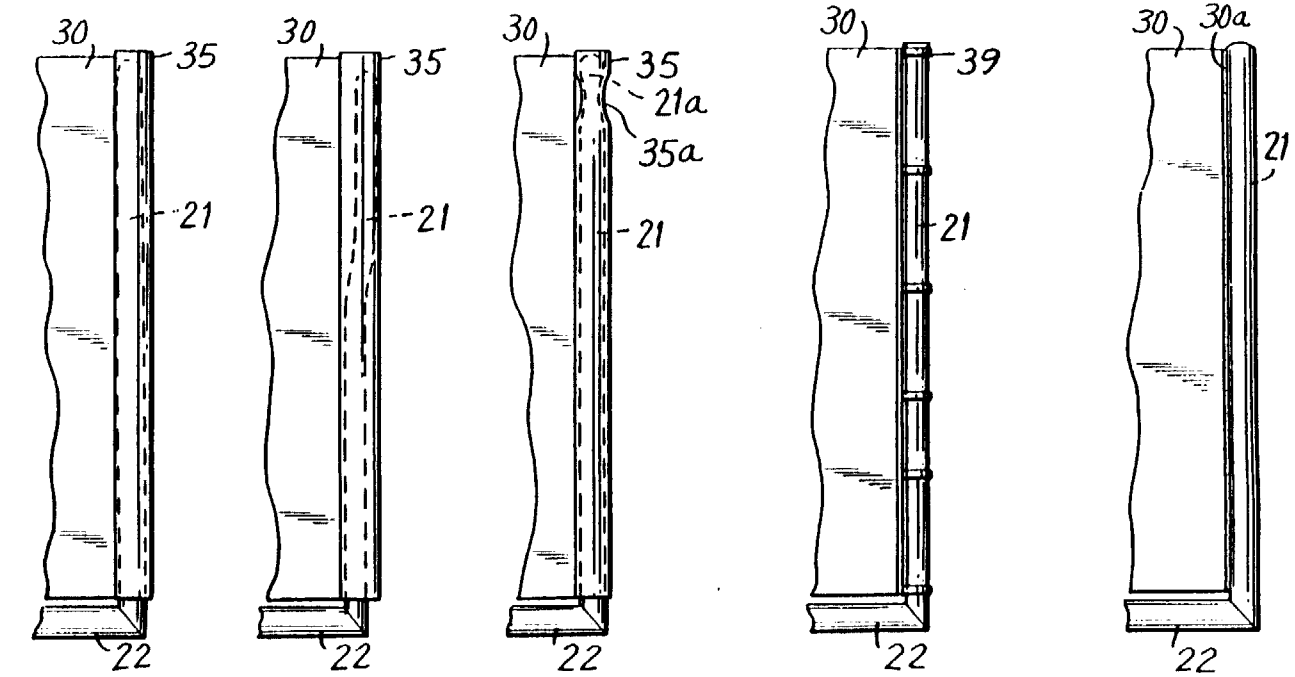
Figure 38C:
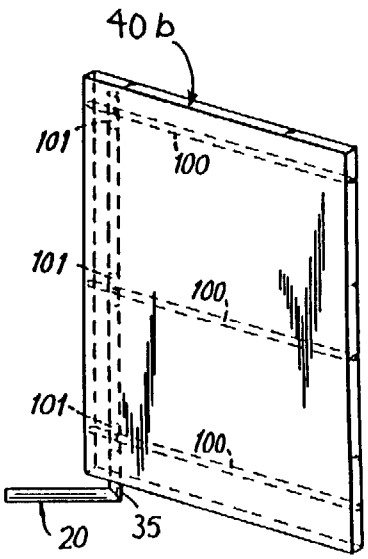
Figure 38B:
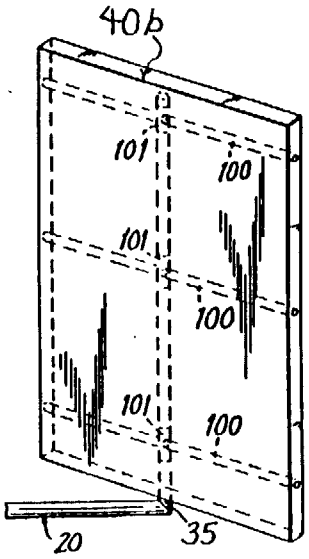
Figure 38A:
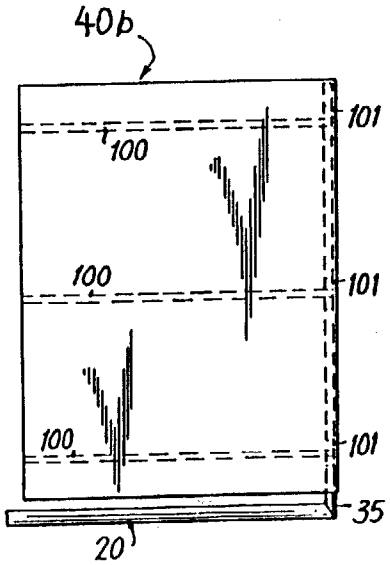
Figure 41:
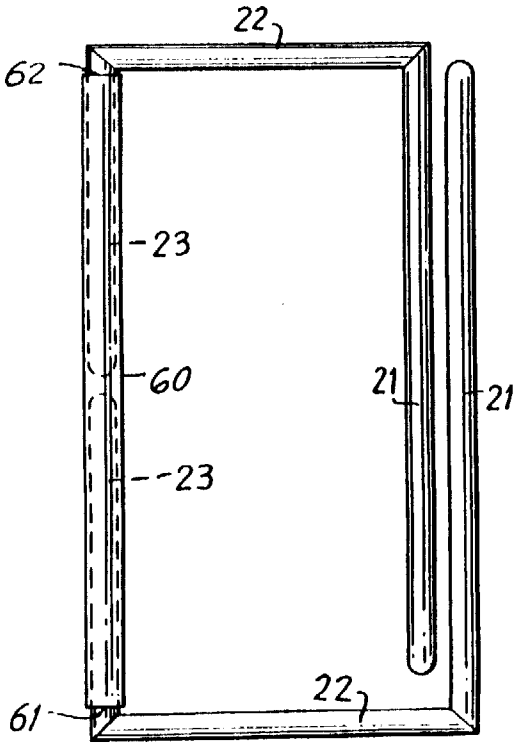
Figure 40:
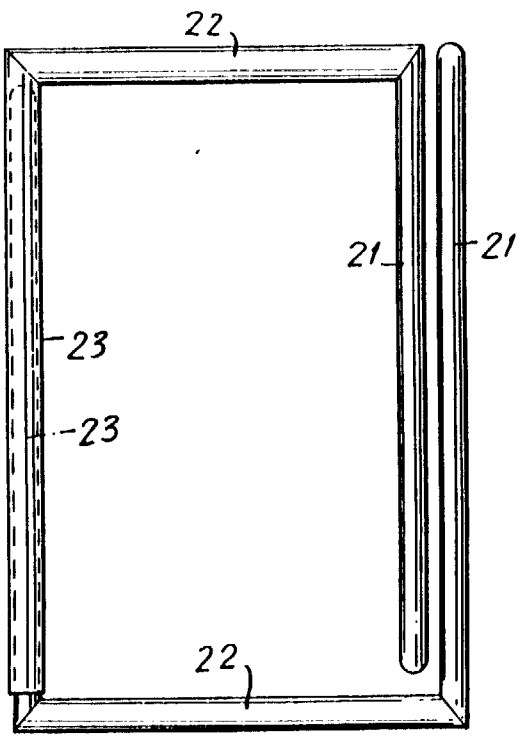
Figure 41A:
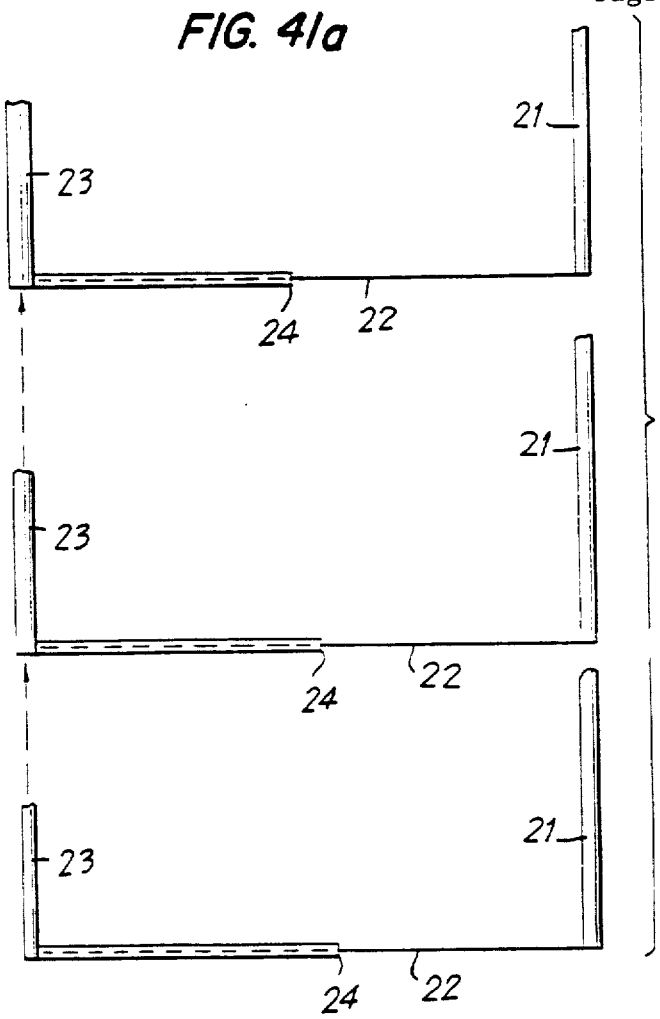
Figure 41B:
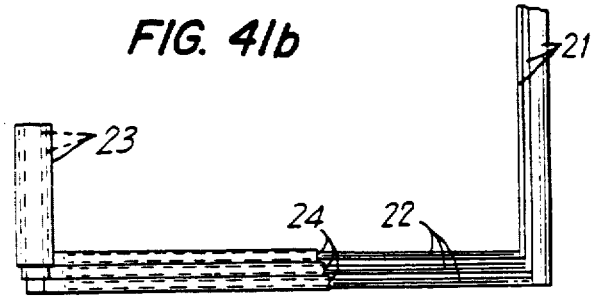
Figure 41C:
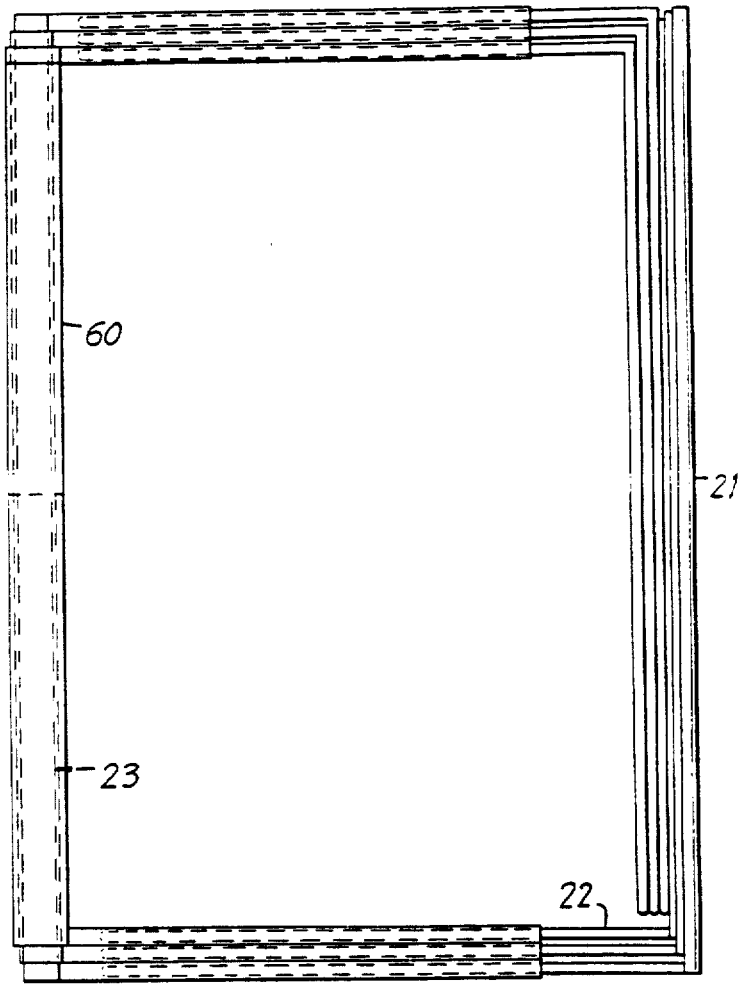
Figures 42, 43, 44, 45:
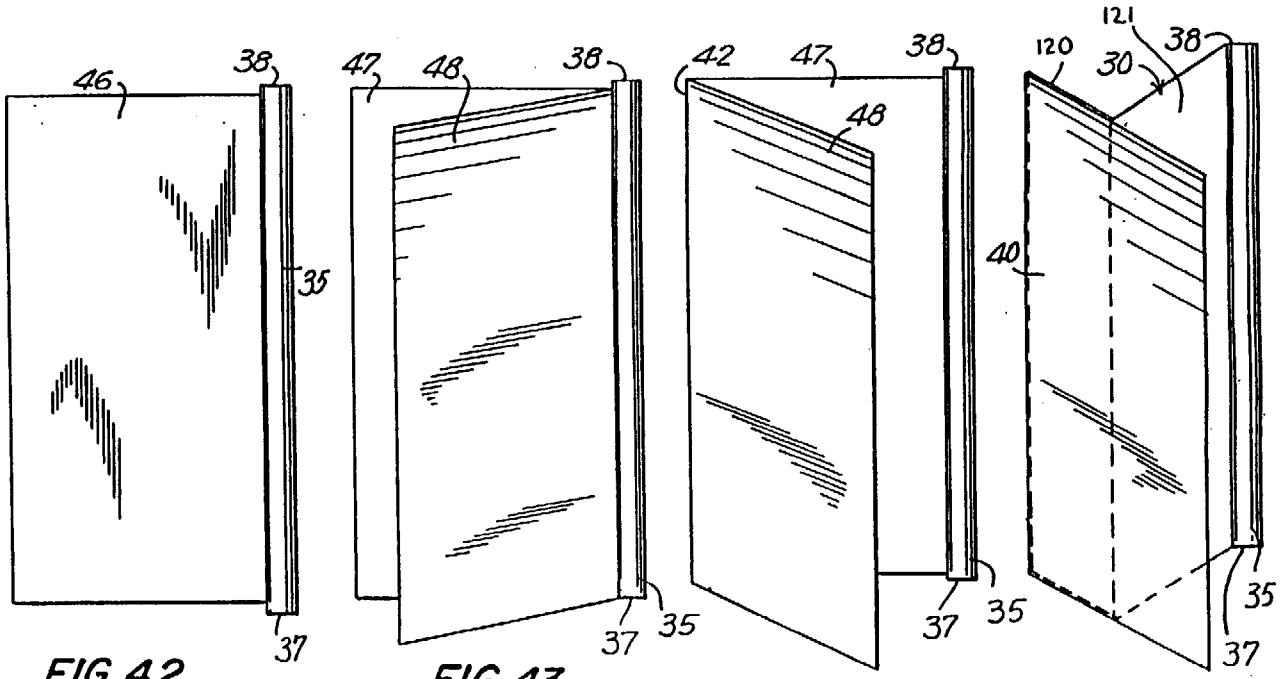
Figure 48:
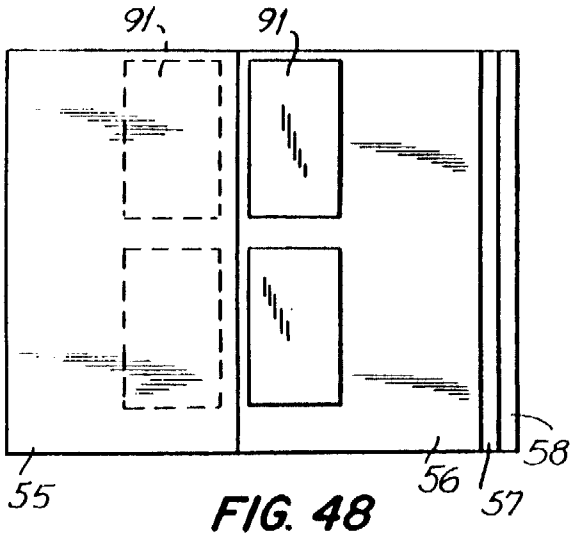
Figure 49:
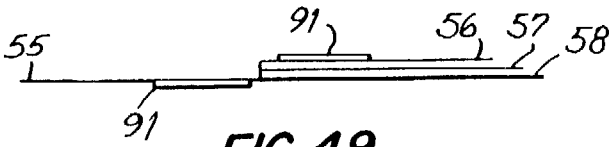
Figure 46:
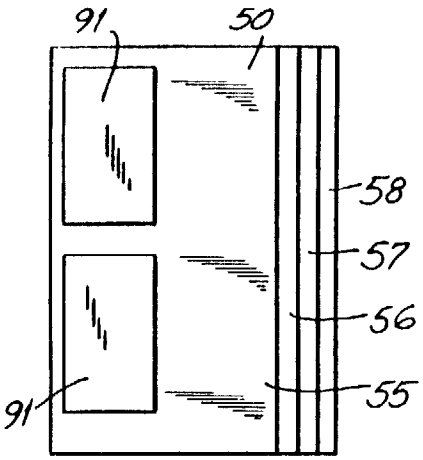
Figure 47:
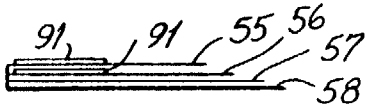

FIG. 4*a* shows an electronic module, 40*a*, here in shown as a calculator mounted on surface 40*e*. FIG. 5*a* shows the cross section view of the electronic module. It is possible to construct such an assembly by attaching the orientation flap directly to the electronic module. Alternatively, the orientation flap may be constructed in a variety of ways, not limited to a flap, wire frame, or the like structure. The electronic module may be mounted in a pocket or otherwise affixed to the orientation flap. The electronic device may be any device not limited to a calculator, application specific microprocessor, and the like.

The sizes of the respective surfaces have been described for a preferred use within a host book. However, the above described mechanism would work well with surfaces having lengths of varying proportion, while still being within the scope of the invention. The book attachment shown herein provides a repositionable surface which allows for a surface intensive blackboard with optional surfaces which can be labelled, typed, categorized and retyped as suits the application, as well as to be placed as a mark in any page of a book.

Alternate embodiments employ variations on the frame, types of leaf, means for binding the leaf to the frame, and means for binding the frame to the host book, each variety of host book binding style requiring a different preferred mechanism of attachment.

Figure 34A:
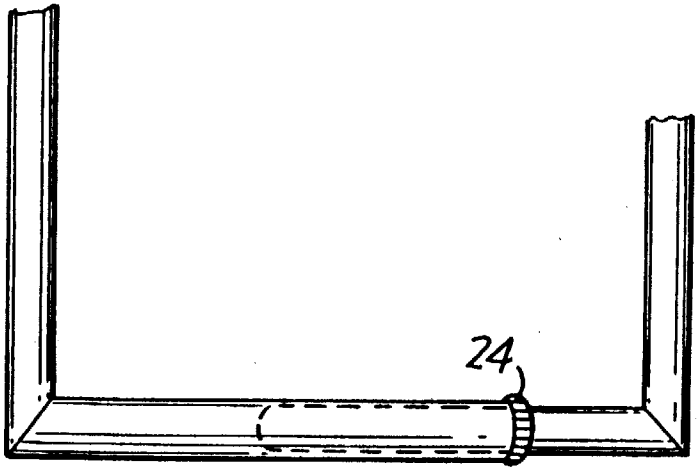
FIG. 34*a* shows means for adjusting a connector arm of a frame.
Figure 34:
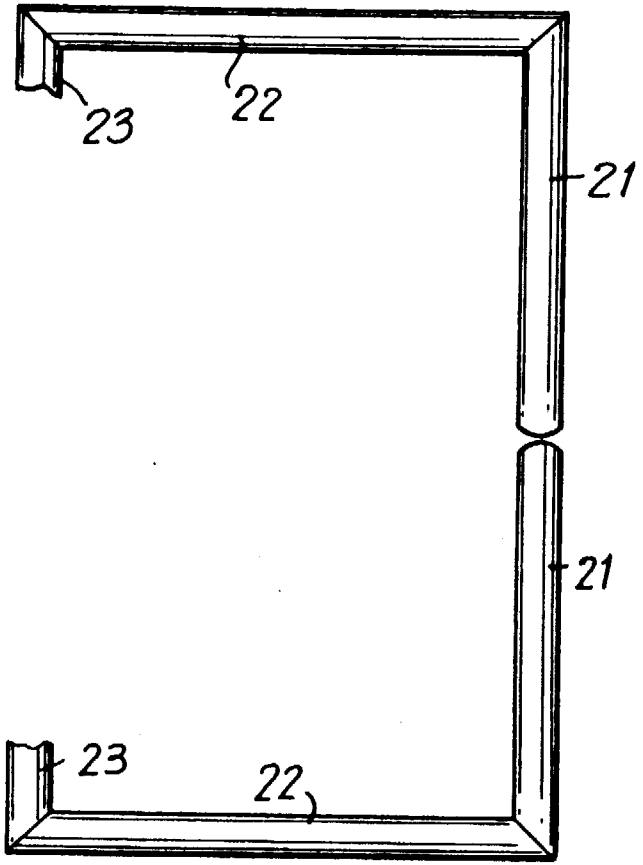
FIG. 34 shows a front elevational view of a frame set where the frame pair is used to retain a single leaf.
Figure 41:
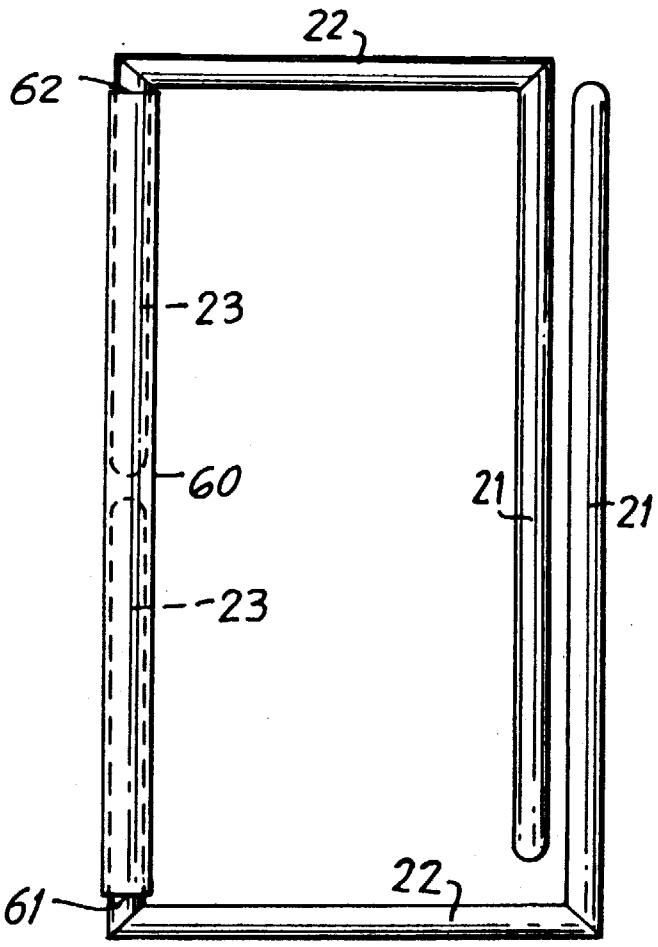
FIG. 41 shows a frame set showing the interleaving arrangement of each frame outer arm where the inner arms are connected by a hollow tube adapter.
Figure 41A:
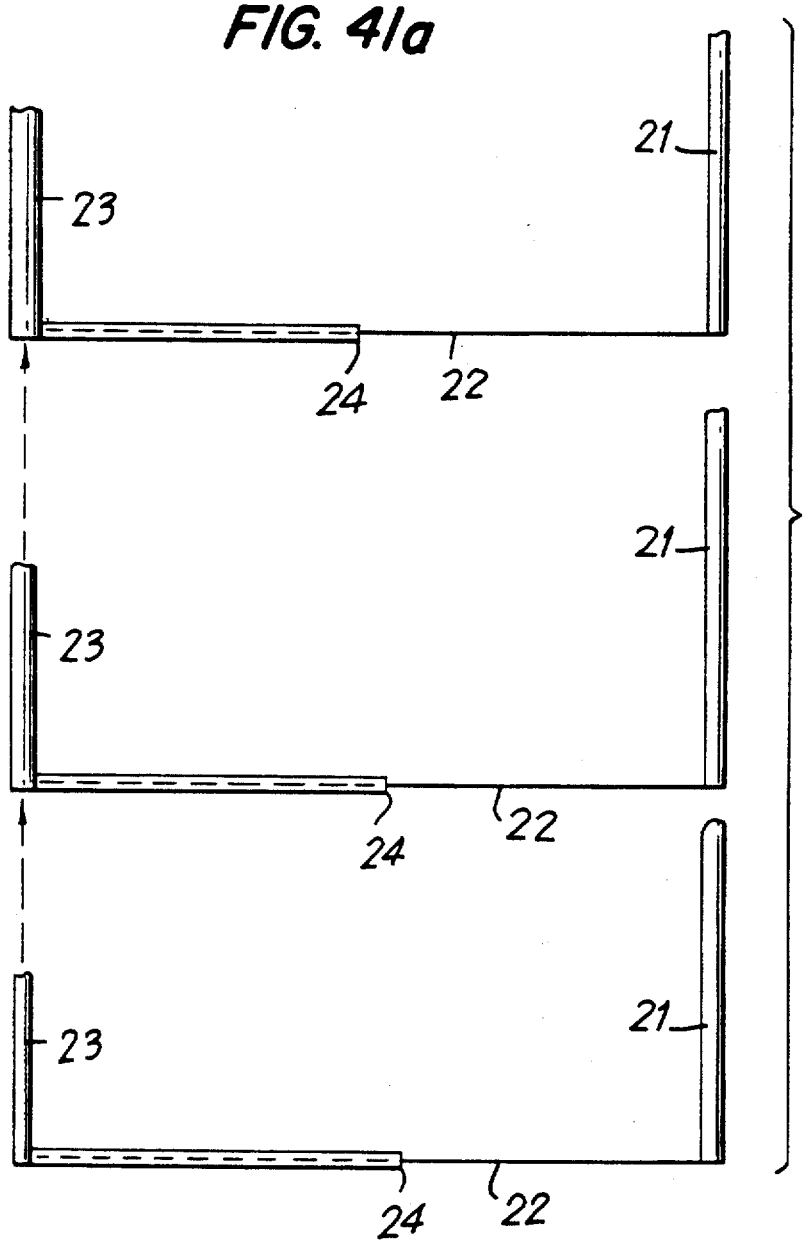
FIG. 41*a* shows an exploded view of a frame set with ordinal enabling means in each connector arm of each of the frame members, the frame inner arms joining telescopingly to one another forming a set of three arms.
Figure 41B:
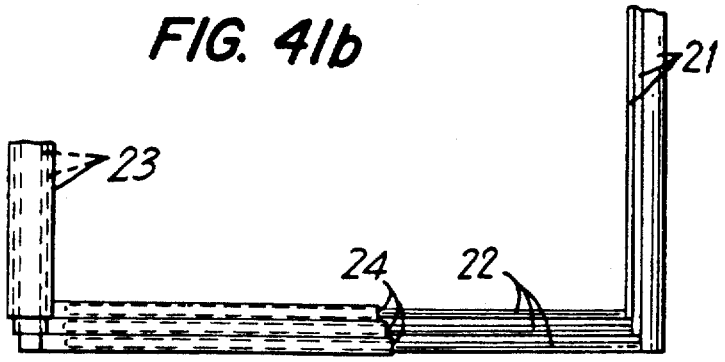
FIG. 41*b* shows the three frame members of FIG. 41*a* joined in a set.
Figure 41C:
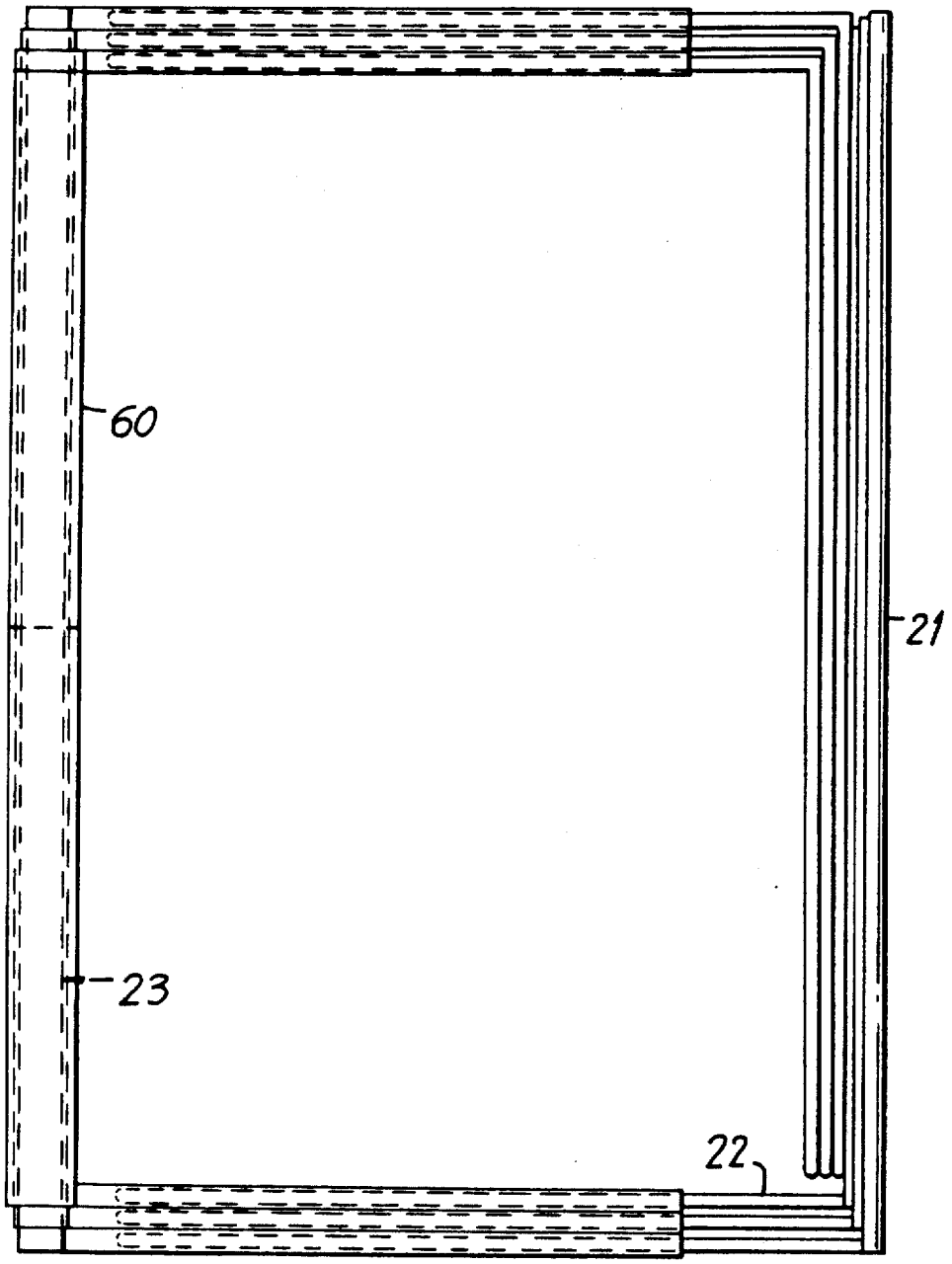
FIG. 41*c* shows a set of two groups of the frame set of FIG. 41*b* joined in a hollow tube adapter forming a frame set of six members, each frame capable of moving past each other frame.

As shown in FIG. 34, a frame may utilize two members where the connector arms 22 are identical in length, and outer arms 21 join in supporting a leaf member. This configuration would be employed for increased stability of the assembly. FIG. 34*a* shows a means for adjusting connector arm 22 by means of a slide adjustment 24. Such a means may also be employed to rotate a leaf out of the host object surfaces plane. Additionally, such a mechanism can be employed as shown in FIGS. 41*a–b* where a set of telescoping frame members are formed to telescopingly fit into one another, and via the slide means shown as item 25, may be longitudinally adjusted to allow each frame to pass each other frame. FIG. 41*b* shows a partial combination of a set of three such frame members combined together. FIG. 41*c* shows a set of six such frame members in a frame set, joined in a hollow tube adapter.

Figure 8:
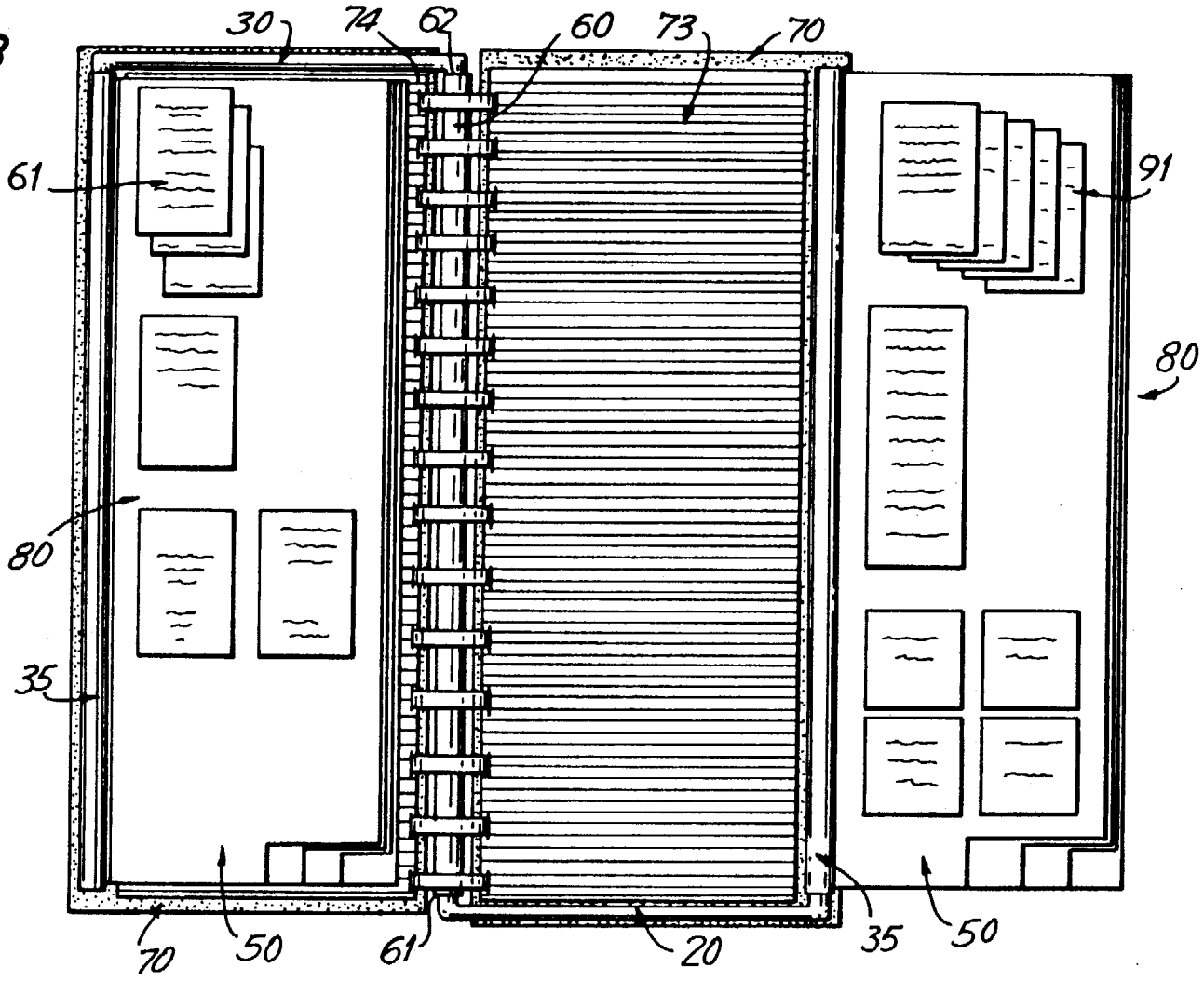
FIG. 8 is a front elevational view of a spiral-bound book fitted with a retention tube and two frame members, each with a plurality of surfaces, with member folded to rest within the book, and the other extended to the side showing a page of the host book in plain view.
Figure 13:
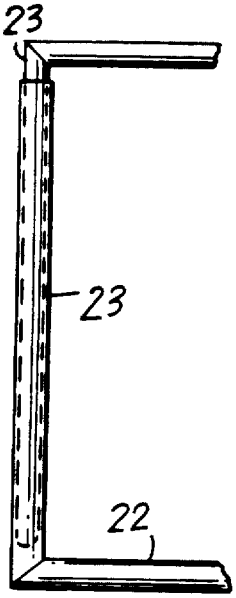
FIG. 13 shows a frame set in which a pair of frames are combined by means of a joinder sleeve.
Figure 40:
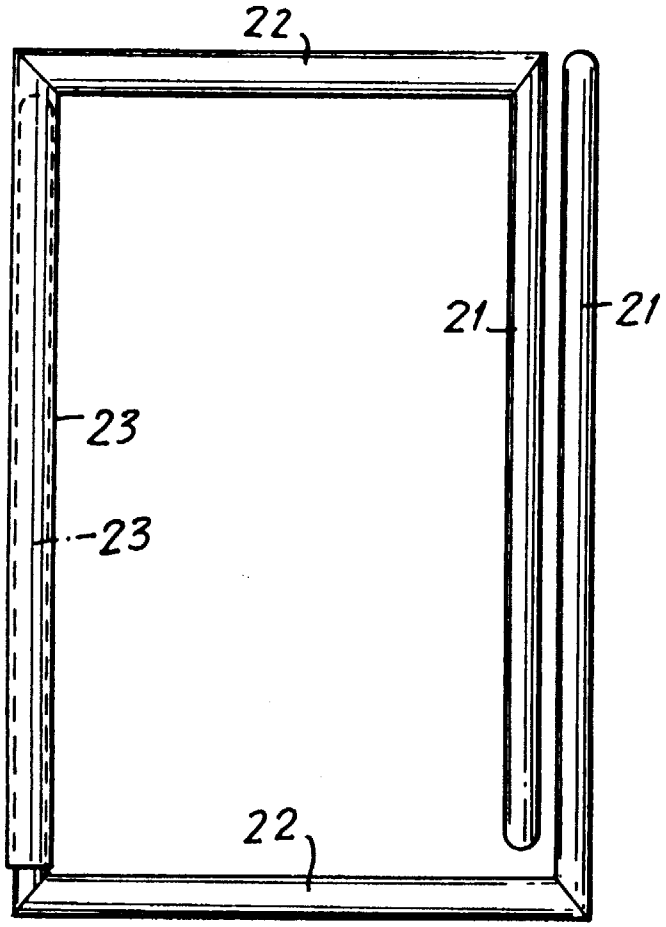
FIG. 40 shows a frame set showing the interleaving arrangement of each frame outer arm where the inner arms are connected by a joinder sleeve.

FIG. 40 shows a frame set which would be employed for supporting two leaves. In this case the connector arms 22 are sized to allow the frame outer arms 21 to pass one another without interference. In FIGS. 13 and 40, the frame inner arms mate male-to-female, while in FIG. 41 they are joined by a hollow tube adapter 60. Another variation of this would have the inner arms 23 of FIG. 41 join directly to the host book spine without the aid of adapter tube 60. FIG. 8 shows how the frame set of FIG. 41 would be utilized in a spiral binding.

FIG. 41*a* shows another means for implementing a frame set. Inner arms 23 fit within one another. Connector arm adapter 24 provides the facility for the arms to extend and contract. FIG. 41*b* shows a partial view of the frames fit together as a set. FIG. 41*c* shows a complete frame set with six frames.

Figures 8A, 8B:
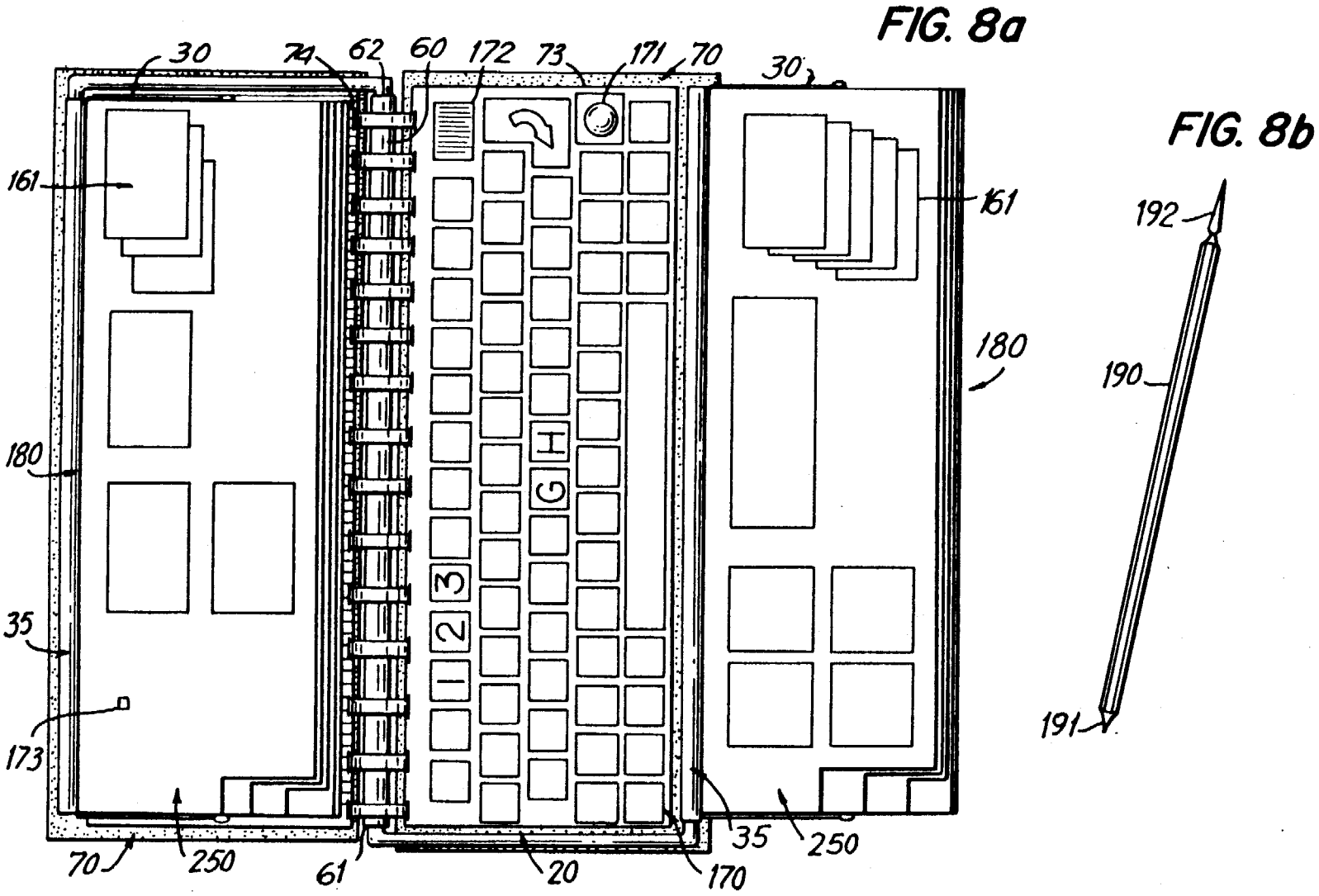
FIG. 8*a* is a front elevational view of a spiral-bound book fitted with a retention tube and two frame members, each with a computational window system attached thereon, one window system folded to rest within the book partially covering the pages on that side, and the other extended on its orientation maintaining means to the side showing a keyboard facility in plain view.
FIG. 8*b* shows a "pencil" with dual facilities for both writing on a paper surface and an electronic stylus for writing on an electronic form of "paper"

FIG. 8*a* shows a hybrid system comprising a dual electronic window system, a book with pages and a keyboard. The retention tube and frames may form a bus structure as a backplane for the bi-directional transmission of electrical signals, or the three electronic devices may be self-contained units with the ability to transmit signals bi-directionally for example, via wire-free transmission as with infrared signals. FIG. 8*b* shows a writing implement capable of writing on both an electronic surface and paper. The computational component has means for speech input/output as well as a track ball for "mouse style" cursor movement.

FIG. 8*a* shows an electronic module 180 with screen 250 mounted therein and window 161 displayed thereon. Orientation section 30 is directly and pivotally coupled to module 180 at pivotal coupling structure 35'. Track ball 171 is provided for positioning cursor 173. Keyboard 170 and audio input/output device 172 are also provided.

FIG. 8*b* shows a stylus 190 with a dual writing feature. Point 191 is a conventional pen or pencil. Point 192 is a point with a touch-sensitive writing feature for screen 250.

Figure 8C:
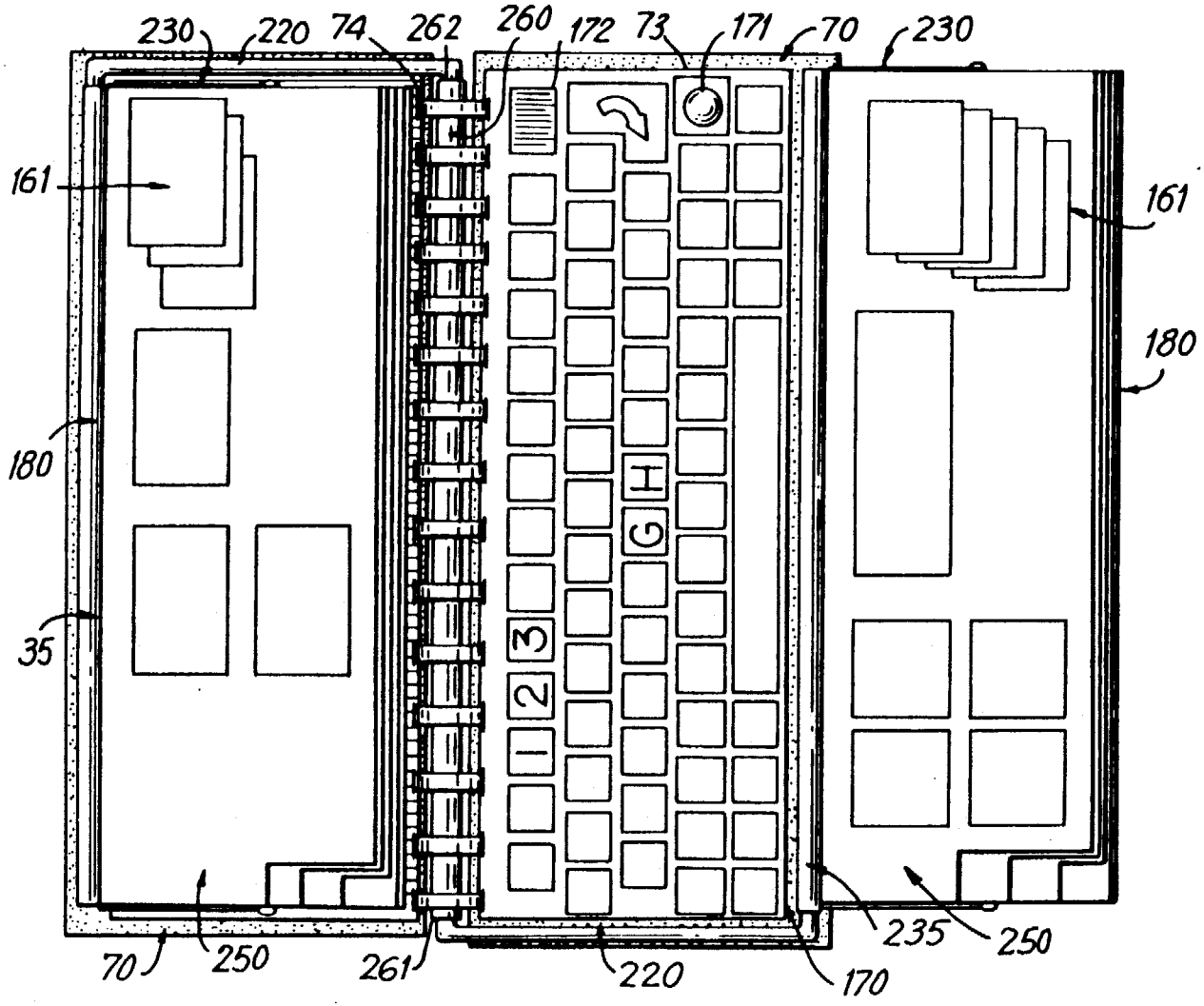
FIG. 8*c* shows a view similar to FIG. 8*a*, but where the frame members and leaf members are part of an electronic backplane system.

FIG. 8*c* shows orientation flap 230, frame 220 serving as an extension structure of extent sufficient to clear the host book pages, and adapter coupler 260 with top 262 and bottom 261 as an electronic backplane joined to electronic module 180 and keyboard 170. Orientation member 230 is pivotally coupled to the electronic module 180 between opposing ends of 180 at coupling structure 235'.

Figure 34B:
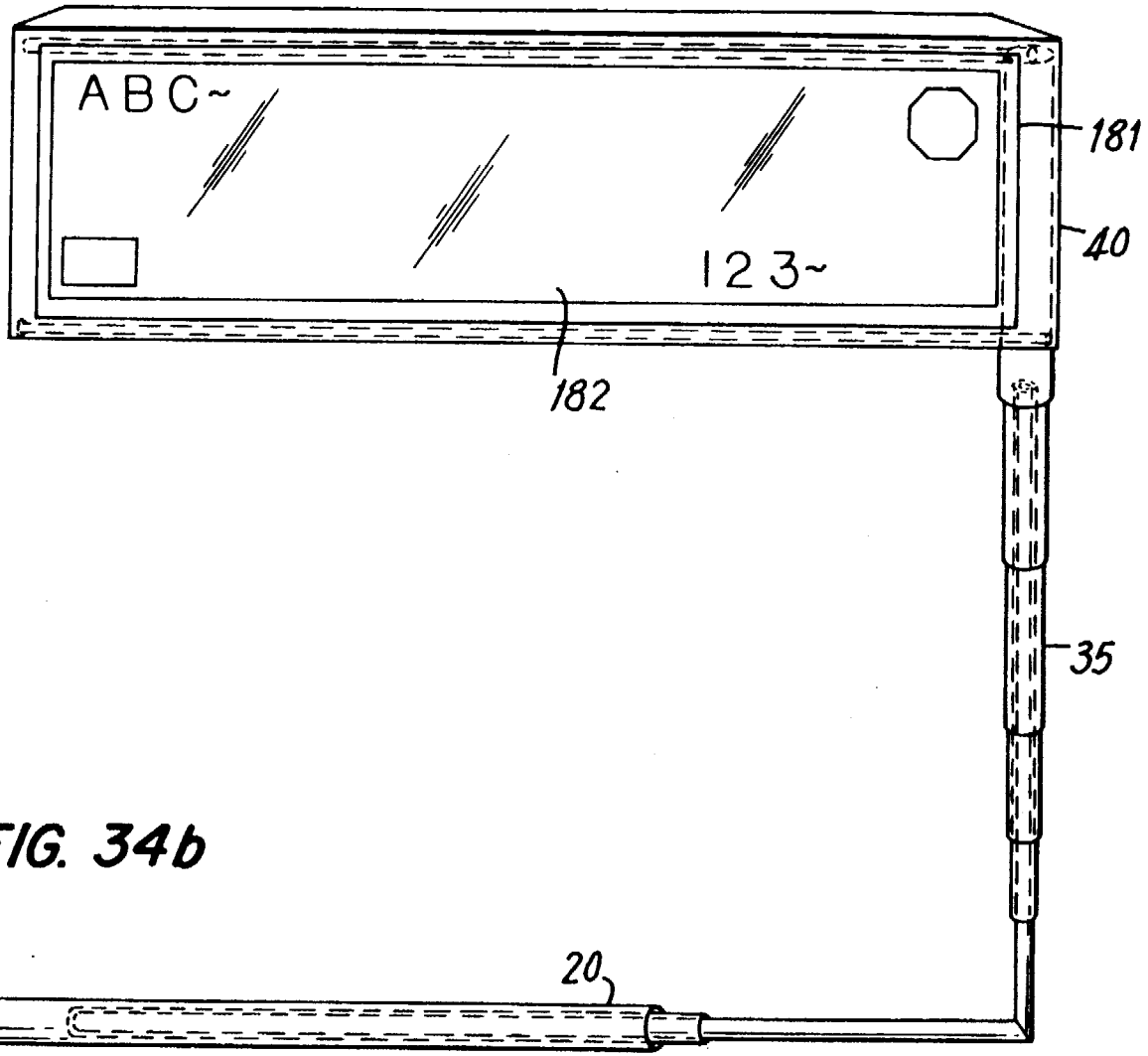
FIG. 34*b* is a partial front elevational view of a frame member and a rotating and sliding leaf member that is itself attached to a frame with dual telescoping facilities in the outer arm and in the connector arm.
Figure 38:
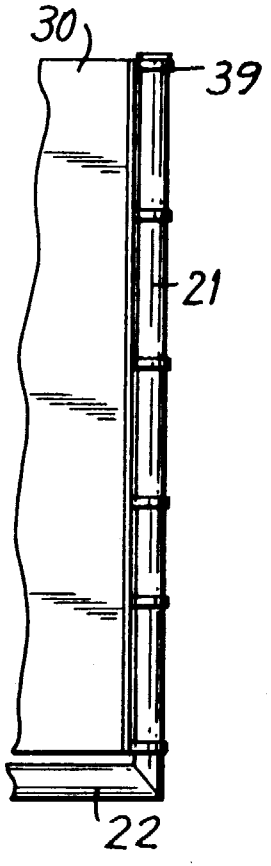
FIG. 38 shows a frame outer arm and orientation flap where the orientation flap has a set of fingers that snap onto the frame outer arm.
Figure 38C:
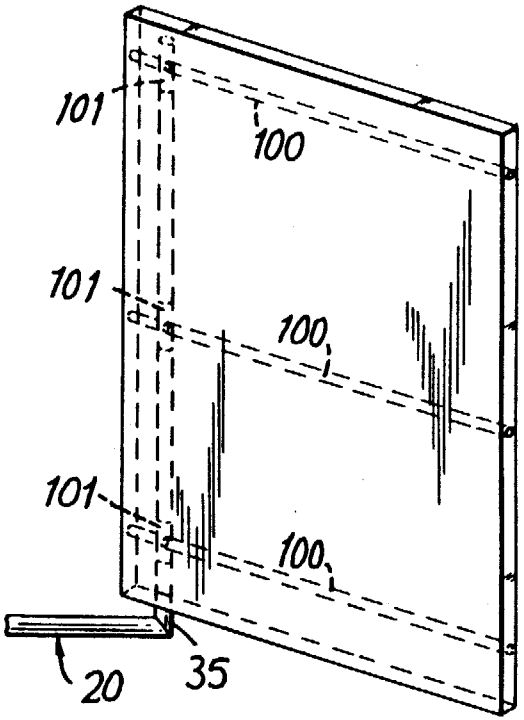
FIG. 38*c* shows the leaf of FIG. 38*b* with the leaf slid nearly all the way to the right.
Figure 38B:
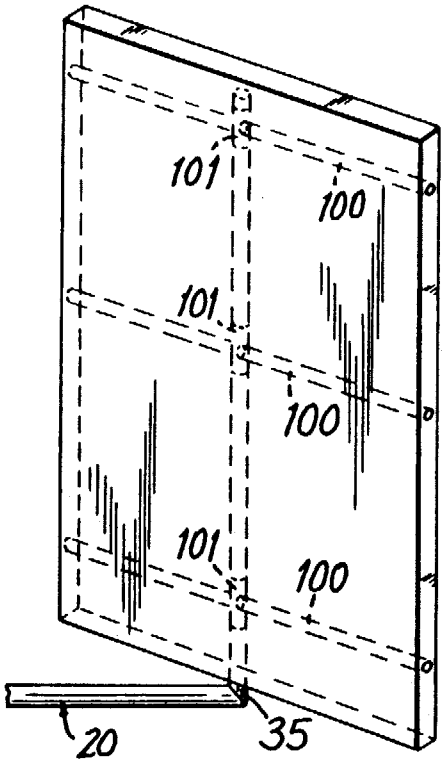
FIG. 38*b* shows the leaf of FIG. 38*a* slid partially to the right and rotated.
Figure 38A:
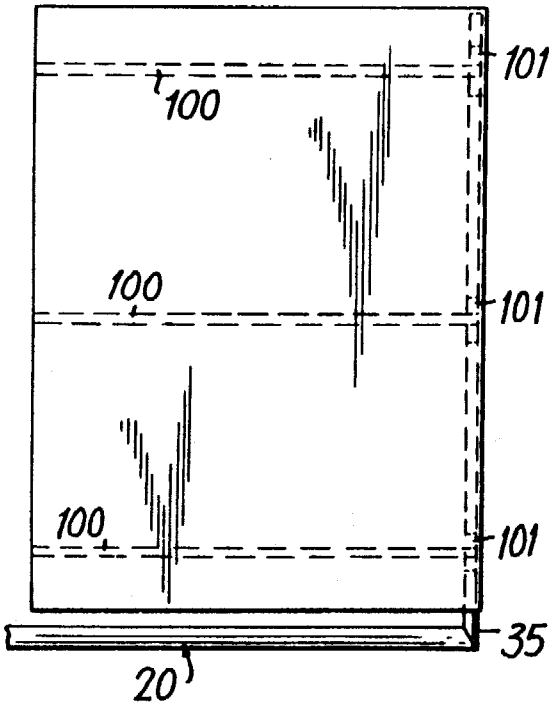
FIG. 38*a* shows the first of a sequence of three figures in which a frame/leaf pair is implemented as a combination of a leaf with a sliding mechanism comprised of guide bars contained within the leaf, and a frame with an outer arm, featuring a set of rotating components in the line of the outer arm of the frame that enable the leaf to slide in either direction and rotate 360° about the frame.
Figures 42, 43, 44, 45:
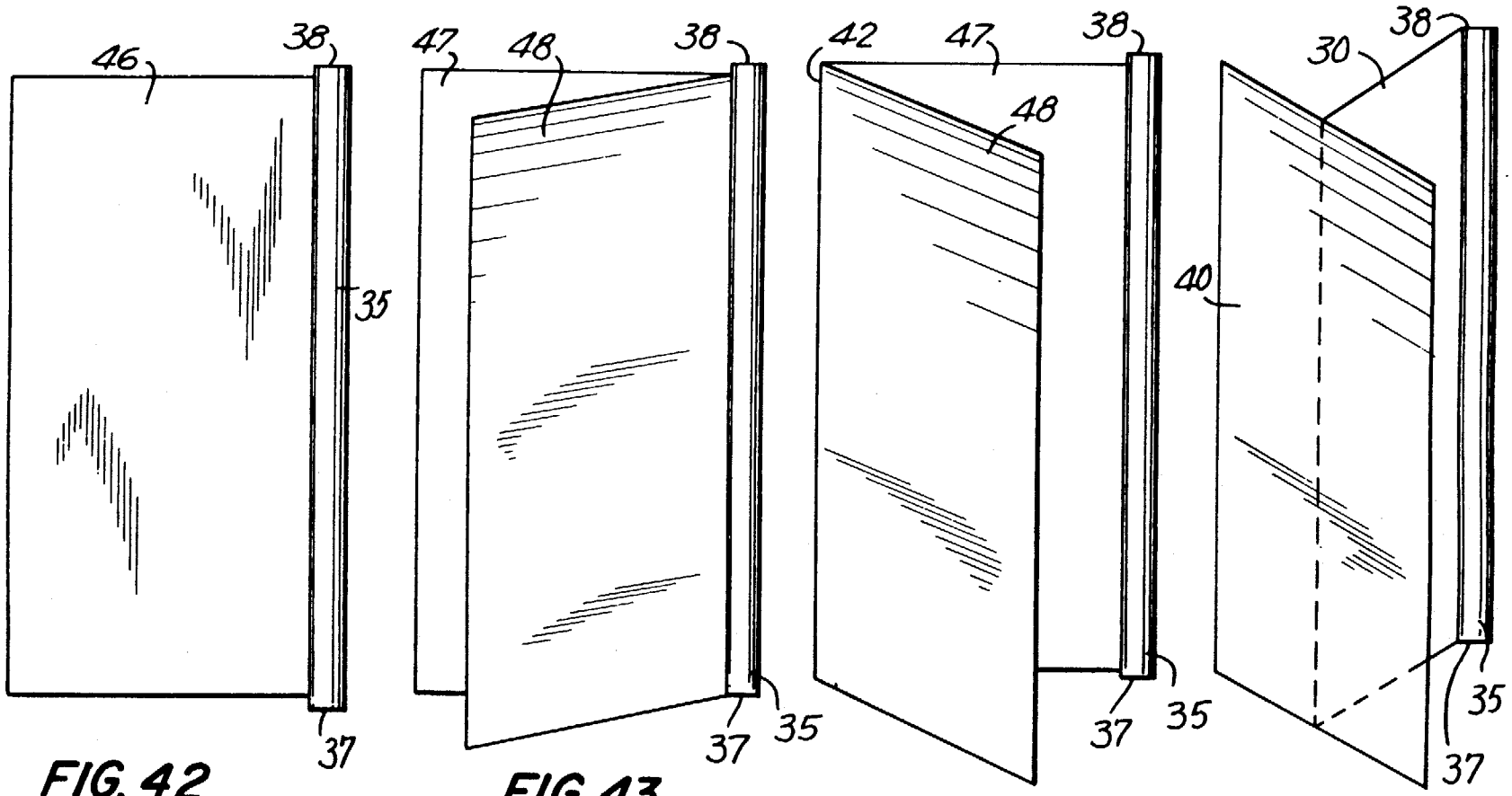
FIG. 42 shows a leaf with a rectangular mounting surface and mounting edge with a hollow tube adapter.
FIG. 43 shows a set of mounting surfaces in a "V" configuration with a hollow tube adapter attached at the mounting edge.
FIG. 44 shows a set of mounting surfaces in an "L" configuration with the hollow tube adapter attached at the mounting edge.
FIG. 45 shows a mounting surface orientation flap, leaf configuration with a hollow tube adapter attached at the mounting edge of the orientation flap.
Figure 48:
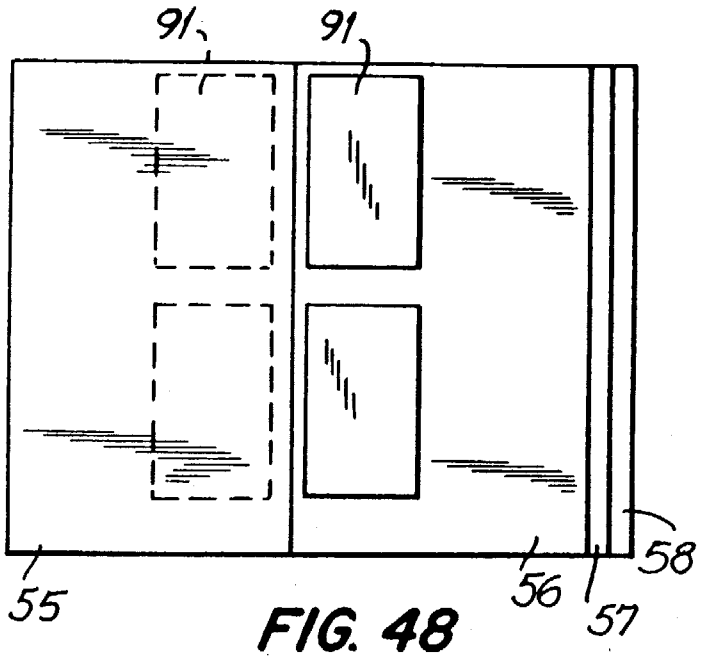
FIG. 48 shows the plurality of folding surfaces of FIG. 46 with the top cover opened showing the inner set of adhesive note stacks.
Figure 49:
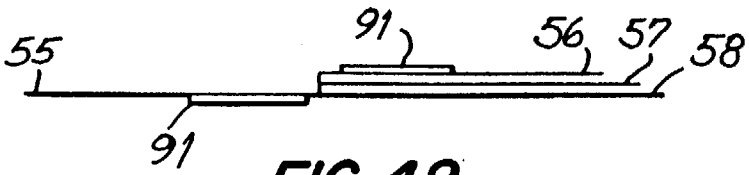
FIG. 49 shows a side view of the folding surfaces of FIG. 48.
Figure 46:
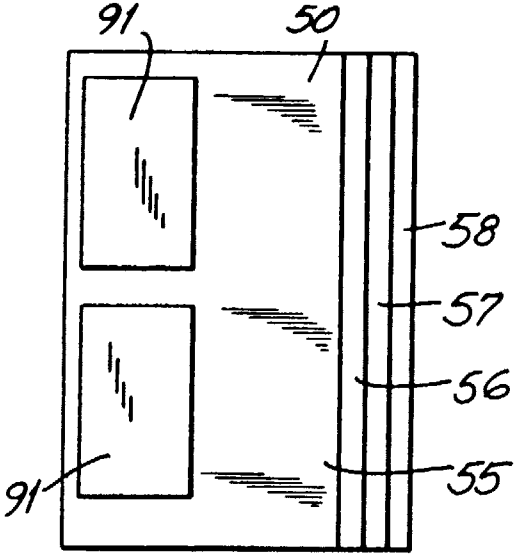
FIG. 46 shows a plurality of folding surfaces with a set of adhesive note stacks on the top and inner covers.
Figure 47:
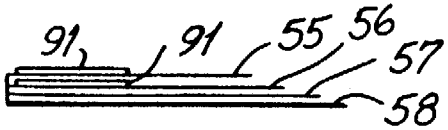
FIG. 47 shows a side view of the folding surfaces of FIG. 46.

Various leaf types would offer different options in the use of a deployed hypermedia system. FIG. 42 shows a basic configuration where the leaf 46 is a simple rectangle which could be deployed as a mounting surface. FIG. 43 shows a dual leaf configuration with leaf members 47, 48 joined at their binding edge. FIG. 44 shows the leaves 48, 49 joined to form a folding rectangular shape with one binding edge 42. Another leaf type, 40*b*, is shown in FIGS. 38*a–c* in which the leaf, 40*b*, is formed as a sandwich within which is housed a set of facilities that enable the leaf to be slid and rotated on a frame arm. The frame arm is comprised of a set of rotating elements, 100, that allow the leaf facilities, in this case, guide bars, 101, to slide and rotate within them. In FIG. 34*b* such a leaf is shown on a dual telescoping frame member, where the leaf further comprises an electronic device 181, having display screen 182, which can be used as a document scanner. The leaf operates as an electronic hypertext book attachment for the selective capture of written information.

FIG. 45 shows the preferred embodiment of the mounting surface 40 with orientation flap 30 which operates as an orientation enabler that preserves the orientation of surface 40 in each configuration about the frame.

Various surfaces as hypermedia structures could be attached to mounting surface 40. FIGS. 46–49 show a different configuration of a plurality of surfaces used to support arrays of note stacks 91. As shown here, note stacks 91 themselves are sets of removable adhesive notes which provide a means for collecting information and can be written on incrementally and pasted many times among the pages of the attachment as well as among the pages of the host book. The plurality of folds could also be labeled for various purposes. The folds could host pre-printed forms, envelopes, pouches, or electronic devices such as calculators and other application-specific microcomputers. For example, FIGS. 4*a* and 5*a* show a calculator module 40*a* on mounting surface 40.

Figure 56:
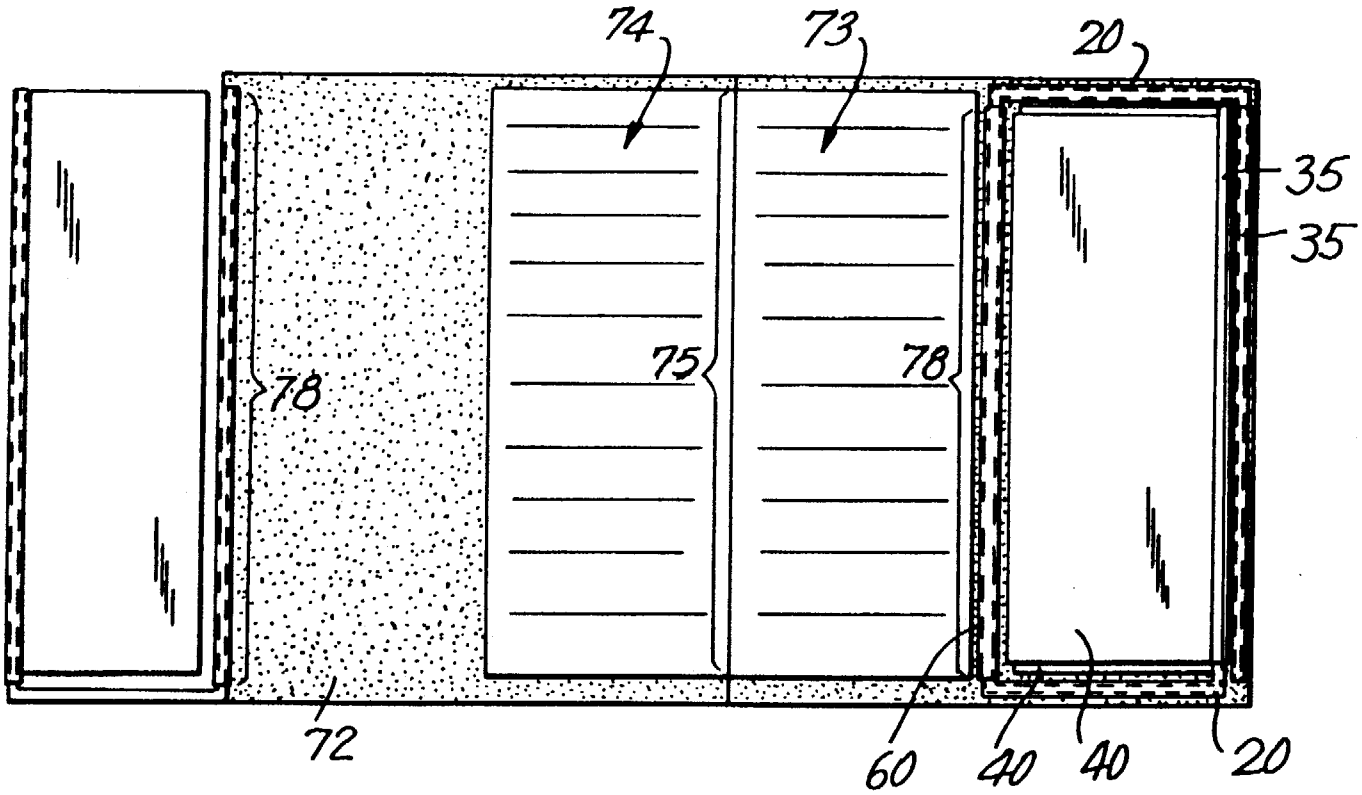
FIG. 56 shows a host book with a dual spine system, having a secondary spine housing a frame set with associated leaf members.
Figure 61:
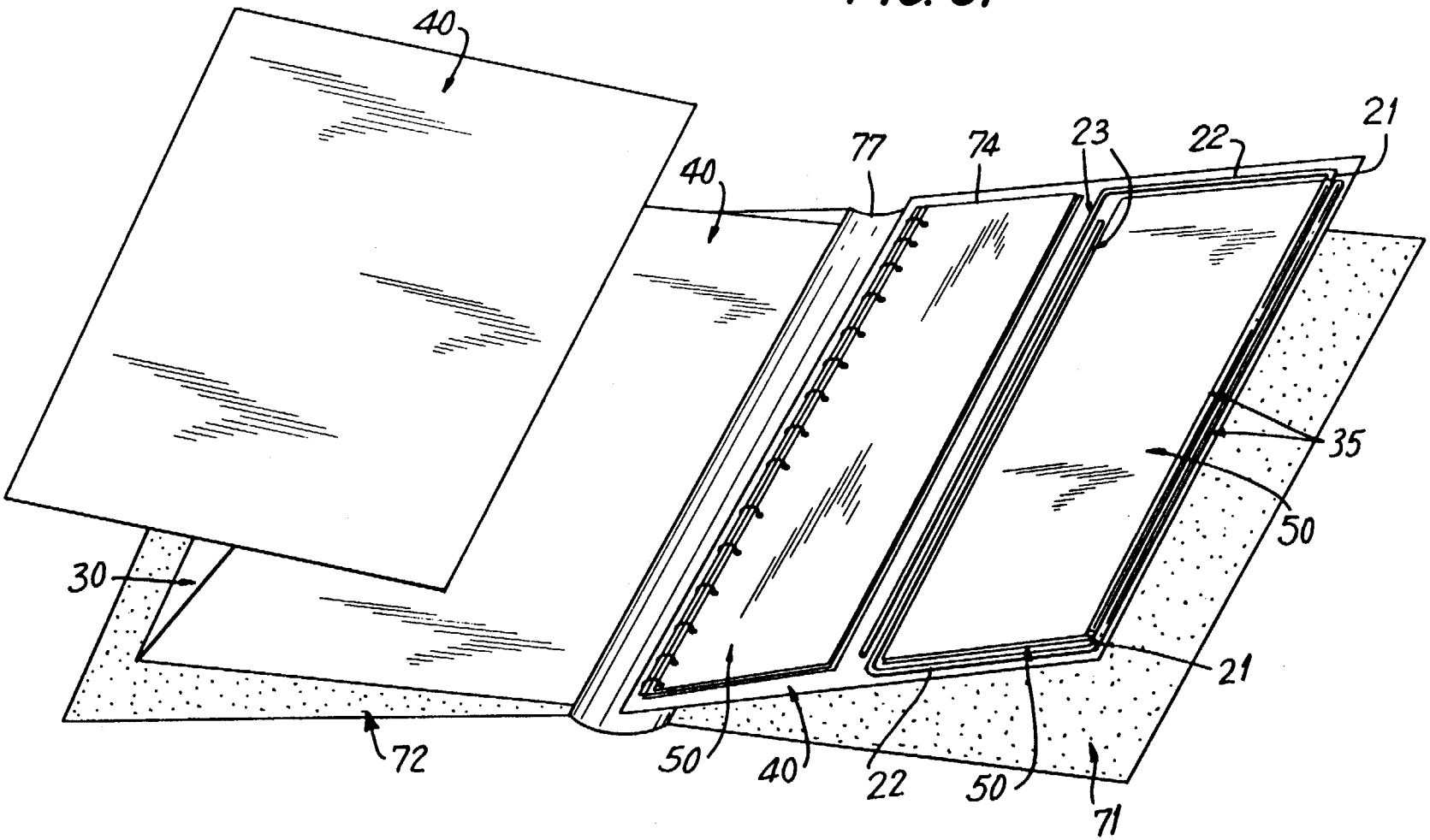
FIG. 61 shows a book comprised exclusively of surface attachments.
Figure 64:
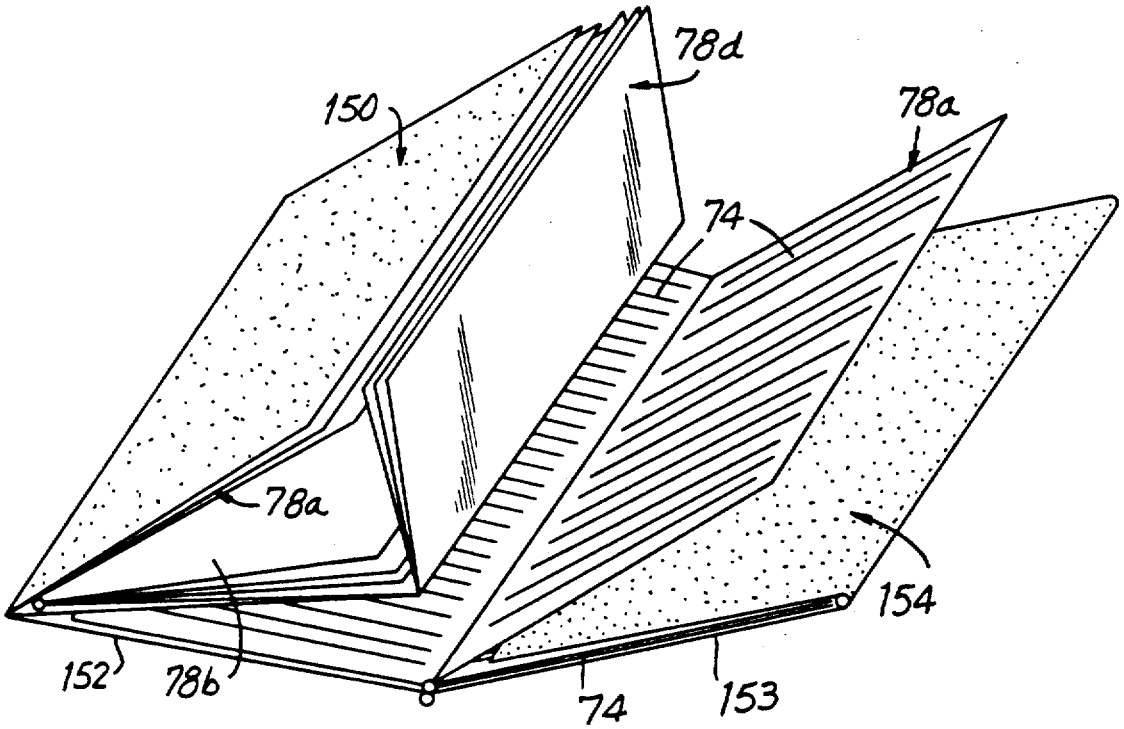
FIG. 64 shows a perspective view of the supra-folded module of FIG. 63 with one of the leaf pages exposed for access, one of the leaf pages tucked under the left upper surface of the host base module, and the remainder of the leaf pages tucked under the right upper leaf of the base module.

Various surfaces can be implemented as direct attachments to a host book, a book leaf, or a frame based page, or cascaded to themselves as supra- or hyper-folded modules, as shown in FIG. 56. According to the original invention, such surfaces would employ the leaf and orientation flap as an attachment not only to a frame, but also directly to a host object. FIG. 61 shows how the leaf's mounting surface/orientation flap module could be attached to a mounting surface which itself would substitute for and serve as the frame. This mounting surface could be attached directly to the host book. FIG. 56 also shows a multi-frame surface attachment with two coupling structures. One of the coupling structures has two frame sets positioned one on top of the other. The other coupling structure has a half-width leaf set directly bound to the surface at said second coupling structure. FIGS. 62*a–g* show a variety of surface and leaf components that can be combined to form a supra-folded module. These components can be formed from a single piece of patterned material or combined pieces. The material can be clear, allowing see-through application in a note-taking application. FIGS. 62*a–c* show three types of base folding surfaces. FIG. 62*d* shows a leaf set with a direct coupling on its left at 156. FIG. 62*e* shows a "major" leaf set mounted on a card with its binding location to the right. The leaf set is marginally longer than a "minor" leaf set. FIG. 62*f* shows a "minor" leaf set mounted on a card with its binding location to the right. The leaf set is marginally shorter than a "major" leaf set and can flip past a major leaf when bound at the same point. FIG. 62*g* shows a leaf set substantially half the width of its intended mounting surface. FIG. 62*h* shows a leaf set which would typically be a set of pages for writing on. The other leaf sets would typically be used as surfaces for attaching information to. The embodiment of FIG. 64 shows a particular supra-folded combination of these components in a hyperfold configuration particularly useful for implementing an agency or object center according to the invention.

Figure 39:
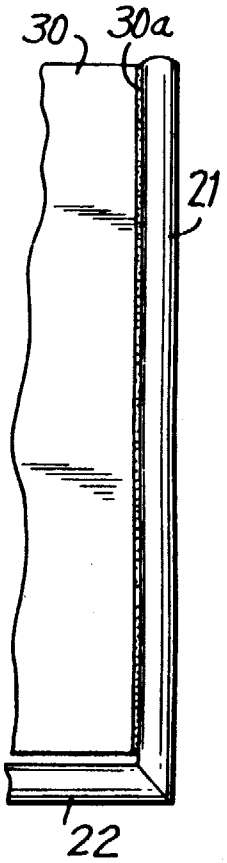
FIG. 39 shows a frame outer arm and orientation flap portion of the leaf where the orientation flap is adhesively attached to the frame outer arm.
Figure 37:
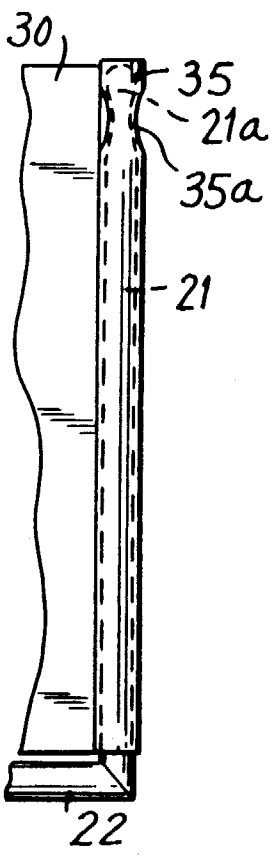
FIG. 37 shows a frame outer arm and orientation flap where the orientation flap binding edge has a hollow tube with a retainer and the post has a bulbous shape suitable to snap within the tube.
Figure 36:
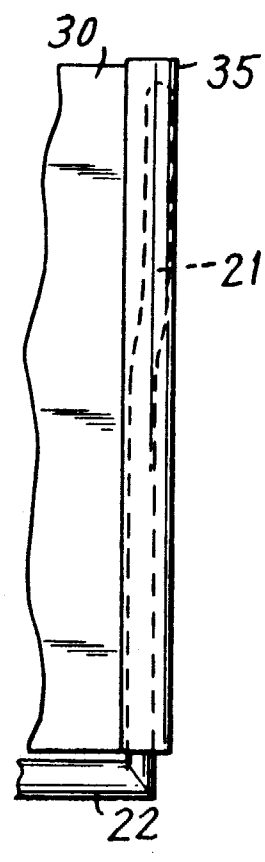
FIG. 36 shows another means of frictional joining with a frame orientation flap configuration.
Figure 35:
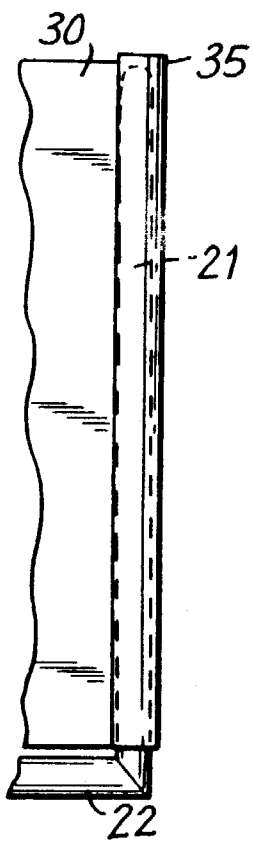
FIG. 35 shows a binding of a frame outer arm to an orientation flap where the frame is a post, the orientation flap has a hollow tube receptor, and the means of joining is frictional.

Various means can be employed for constructing a leaf comprising a mounting surface and orientation flap for retaining the leaf orientation flap on the outer arm of the frame. In FIG. 39, the orientation flap 30 is attached to the outer arm 21 with a permanent, flexible, adhesive mount 30*a*. Another variation shown in FIG. 38 would employ a set of clamps 39 on the leaf orientation flap 30, which snap onto the outer arm 21. Yet another variation, FIG. 37, shows a means for the posts 21 to snap into a tube 35 to the leaf's orientation binding edge. The means for snapping could vary. One type includes the use of a post 21 with a bulbous end 21*a* that slides past a flexible construction 35*a*. Two frictional variations are shown in FIGS. 35 and 36. In FIG. 35, post 21 is a straight member that fits frictionally into tube 35, any of which like pivotal hingeing methods could be used at the other end of the orientation flap 30 to pivotally attach orientation flap 30 to mounting surface 40. In FIG. 36, the post is kinked slightly to place varying pressure on tube 35 ensuring a frictional fit. FIG. 38*a* shows a leaf, 40*b*, as a mounting surface attached to frame 20 by guide rods 100, which are inserted into slots in rotational modules 101 in frame outer arm 35, forming a rotational and sliding mounting.

Figure 55:
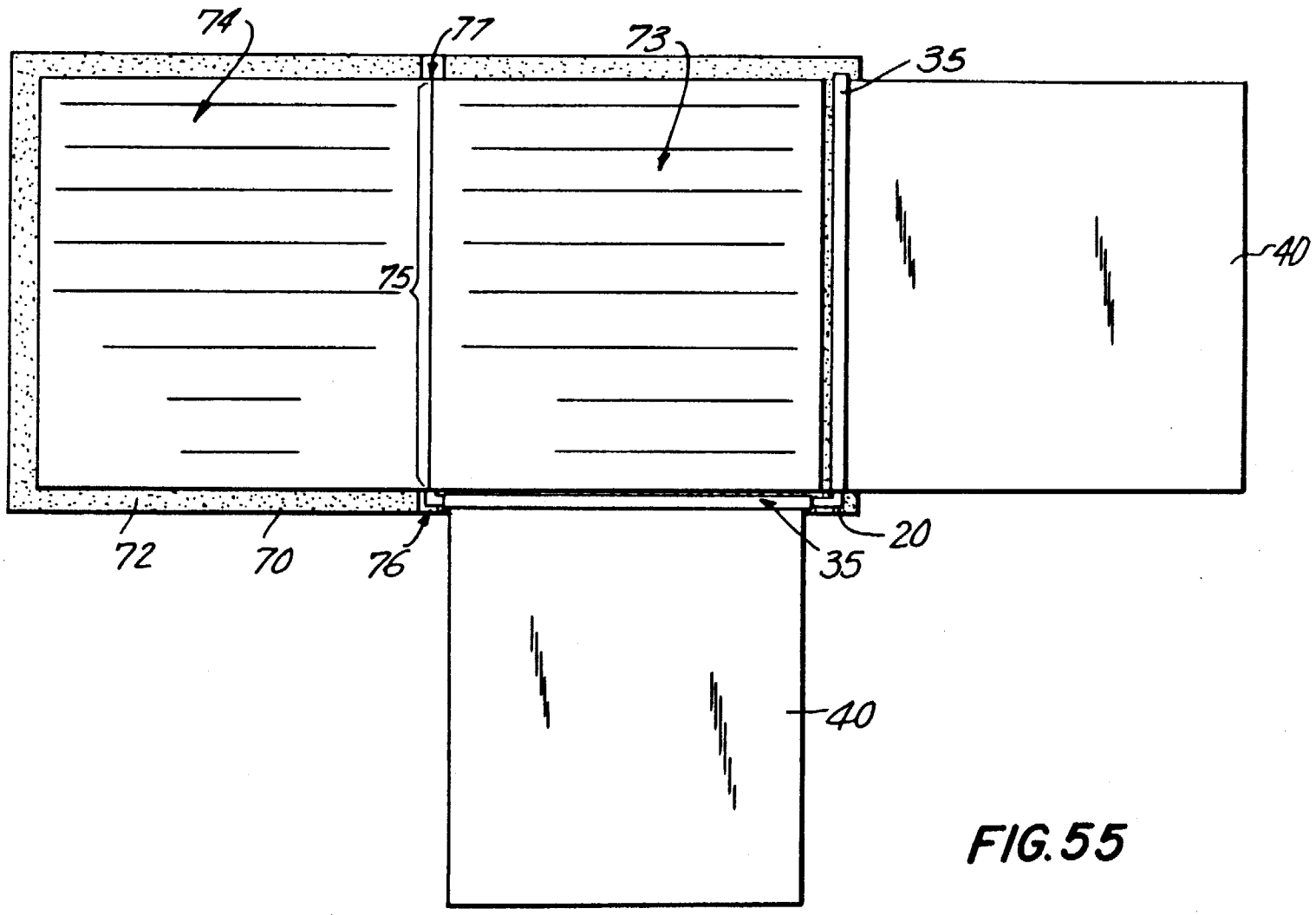
FIG. 55 shows a host book with a leaf member attached to both the connector arm and the outer arm of the frame member.

Leaf members may be attached to either outer arm 21 or connector arm 22. FIG. 55 shows a host book with a frame supporting two leaf members 40.

Figure 14:
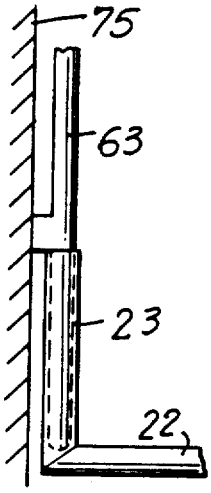
FIG. 14 shows a frame set male host with inner arm of frame member of female construction.
Figure 25:
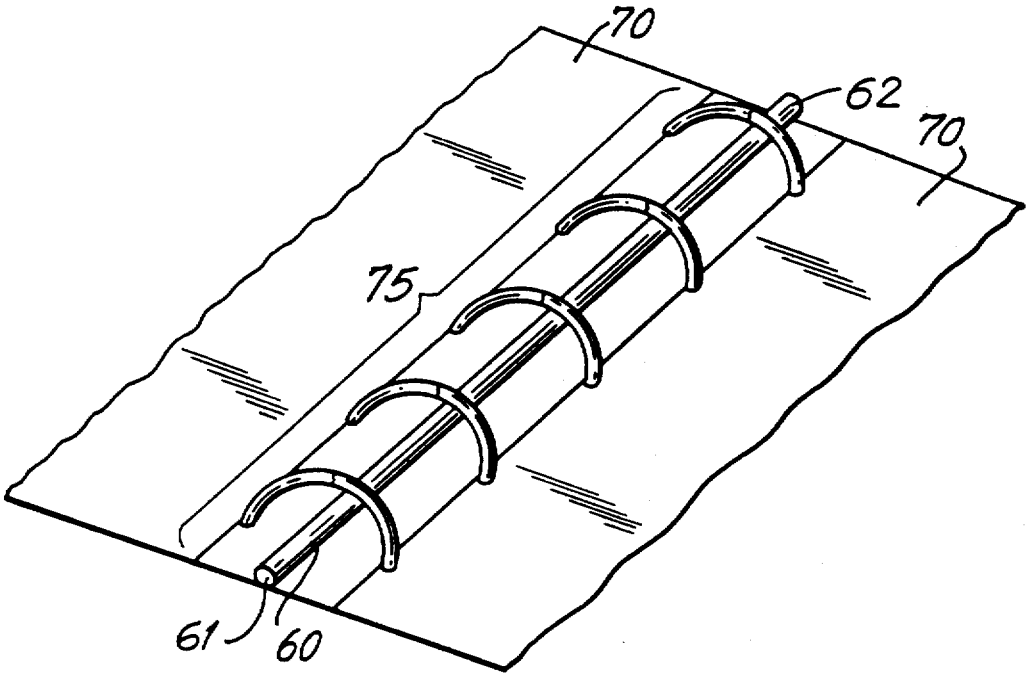
FIG. 25 shows a hollow tube adapter in a hybrid binding configuration mounted within a multi-ring binder.
Figure 26:
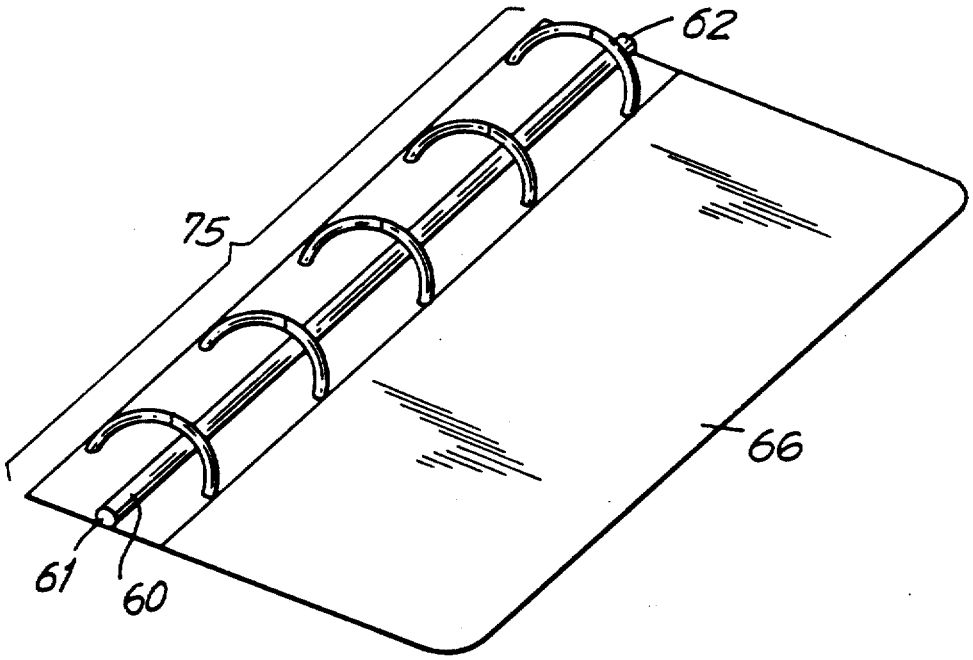
FIG. 26 shows a hollow tube adapter on a card with a multi-ring adapter.
Figure 27:
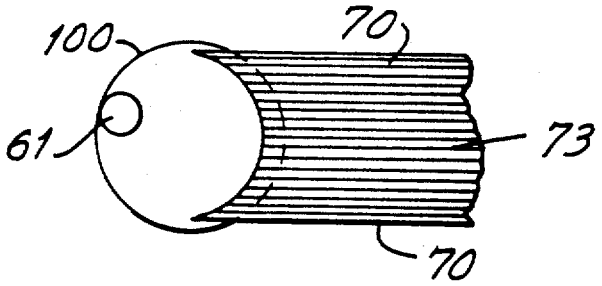
FIG. 27 shows a side view of a finger clasp spiral-style binding with tube adapter.
Figure 28:
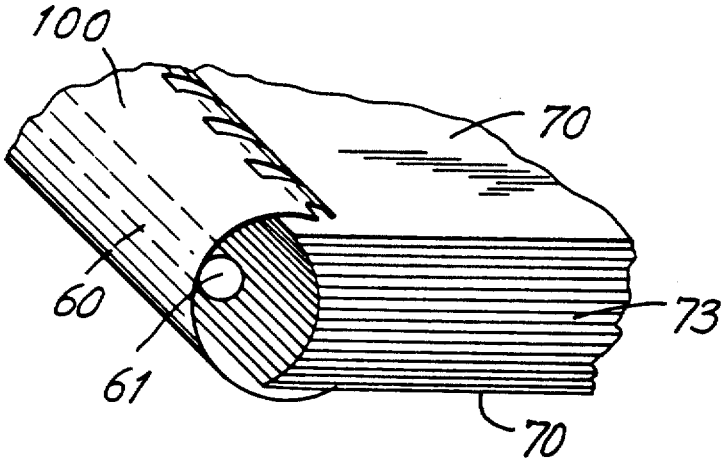
FIG. 28 shows a perspective view of the binding of FIG. 27.

Host book spines come in various types. FIG. 14 shows a spine formed by a post 63 capable of supporting two female inner arms, one of which is shown at 23. FIG. 29 shows the gap 76 formed along spine 75 when a cover is adhered to a set of either glue- or staple-bound pages. FIG. 30 shows a side view of the gap when the book is open and FIG. 31 shows a side view of the gap when the book is closed. FIG. 32 shows a similar gap formed by a different variation of glue-bound binding. FIG. 33 shows a side view. FIG. 27 is a side view of finger clasp binding shown in FIG. 28. A hollow tube adapter 60 is shown as part of the binding as a means for hosting frame inner arms. The adapter tube is sized to allow the pages to turn freely. The spiral binding gap of FIG. 8 is another type of host spine for which the present invention is compatible. Additionally, a variety of hybrid bindings formed by an adapter and a standard multi-ring binding are shown in FIGS. 25, 26. In FIG. 25, a hollow tube adapter 60 is fitted directly to spine 75 of the multi-ring binding. In FIG. 26, the multi-ring binding 75 and the adapter tube 60 are mounted on a card 66. The card may be deployed in the jacket of a host book cover.

Figure 12A:
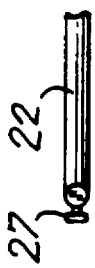
FIGS. 12 and 12*a* show elevational and top views, respectively, of a frame member inner arm post construction with an ear hook.
Figure 12:
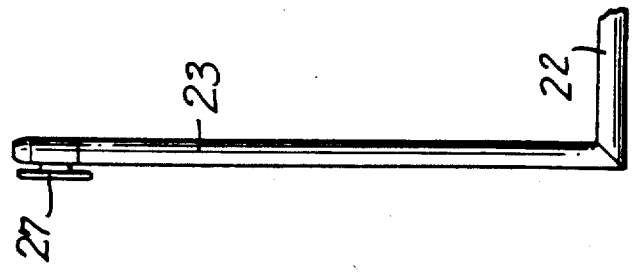
Figure 11A:
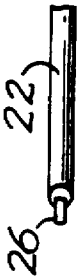
FIGS. 11 and 11*a* show elevational and top views, respectively, of a frame member inner arm post construction with a hook.
Figure 11:
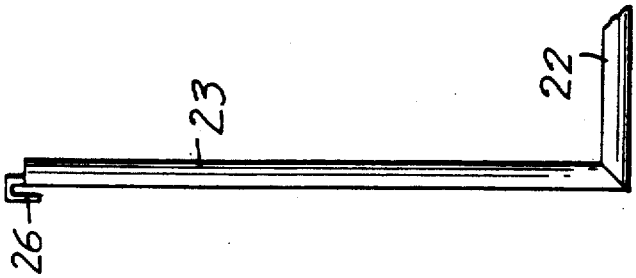
Figure 10A:
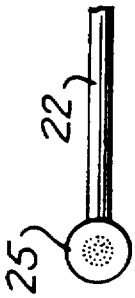
FIGS. 10 and 10*a* show elevational and top views, respectively, of a frame member inner arm post construction with a retainer cap.
Figure 10:
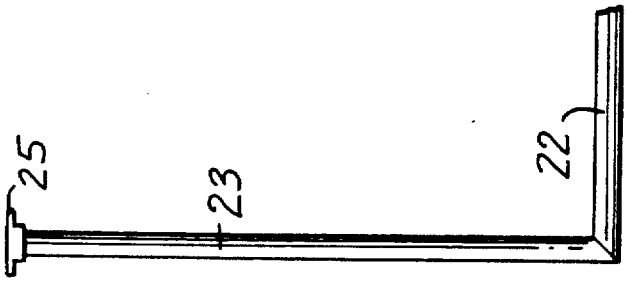
Figure 9A:
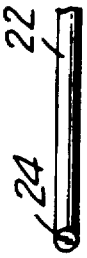
FIGS. 9 and 9*a* show elevational and top views, respectively, of a frame member inner arm post construction.
Figure 9:
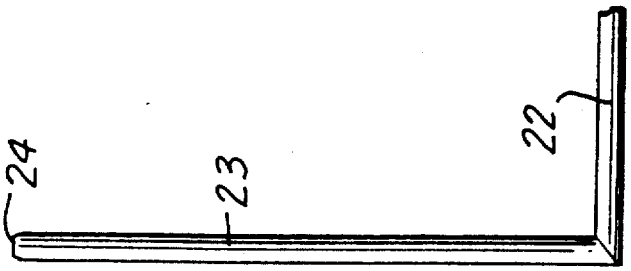

The inner arms of the frame can provide a means for retaining itself in some standard book spines. FIGS. 9–12*a* show various inner arm modifications. FIGS. 9 and 9*a* show a simple post, preferably with a rounded or tapered tip, which would mount frictionally in the cylindrical gap spine of, for example, FIG. 29. FIGS. 10–12*a* show variations that adapt for spiral or tube fittings as a means for retaining the tube more securely while enabling pivotal action. FIGS. 10 and 10*a* show post 23 with a cap 25. This could be a removable element or a rivet. FIGS. 11 and 11*a* shows post 23 with a hook which would fit over the top loop of a spiral, for example. FIGS. 12 and 12*a* shows an ear hook which would be inserted into the gaps between spirals as a means for retaining the post inner arm 23 within a spiral binding.

Figure 15:
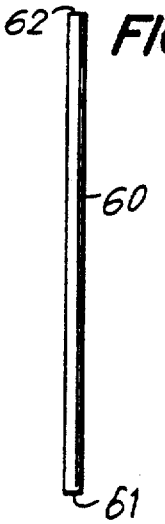
FIGS. 15 and 15*a* show elevational and top views, respectively, of an adapter for inner arm constructed as a hollow tube.
Figure 15A:
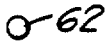
Figure 16:
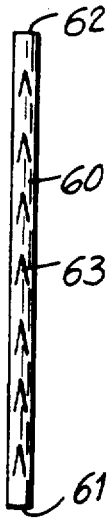
FIGS. 16 and 16*a* show elevational and bottom views, respectively, of a hollow tube adapter with friction spurs for attaching it to a host binding.
Figure 17:
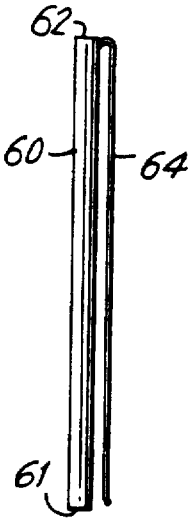
FIGS. 17 and 17*a* show elevational and bottom views, respectively, of a hollow tube adapter with a clip means for attaching it to a host binding.
Figure 18:
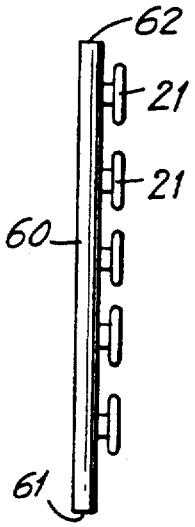
FIGS. 18 and 18*a* show elevational and bottom views, respectively, of a hollow tube adapter fashioned with ear hooks for attaching it to a host binding.
Figure 19:
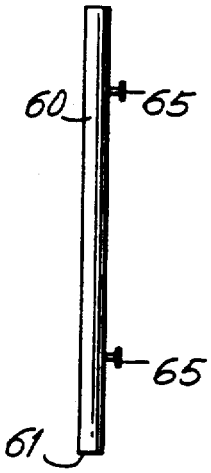
FIGS. 19 and 19*a* show elevational and bottom views respectively of a hollow tube adapter with a rivet mount for attaching it to a host binding.
Figure 16A:
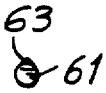
Figure 17A:
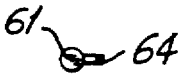
Figure 18A:
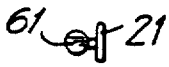
Figure 19A:
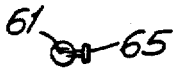

Means for retaining a hollow tube adapter are shown in FIGS. 15–24*a*. FIGS. 15 and 15*a* show the basic hollow tube adapter 60. It can be deployed in most any modification, as shown in FIG. 8. A modification shown in FIGS. 16 and 16*a* which would permit a frictional fit in a cylindrical gap would have spurs 63 along the tube. This figure shows spurs that permit the tube to be slid freely in one direction, but provide abrasion when the tube is slid in the opposite direction. FIGS. 17 and 17*a* shows tube 60 fitted inside clip 64 for mounting in a gap, a spiral, or the like. FIGS. 18 and 18*a* show tube 60 with ear hooks 24 formed along tube 60 as a means for attaching the tube to a spiral. FIGS. 19 and 19*a* shows tube 60 with a rivet attachment 65 for fixing tube 60 to a book spine.

Figure 20:
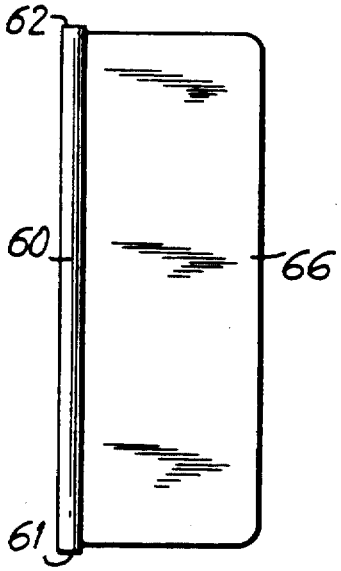
FIGS. 20 and 20*a* show elevational and top views, respectively of a hollow tube adapter with a card mount for attaching it to host binding, with the hollow tube situated on an edge of the card.
Figure 21:
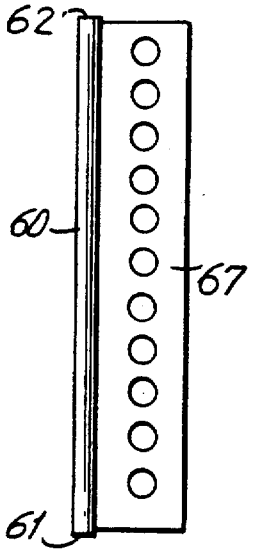
FIGS. 21 and 21*a* show elevational and top views, respectively, of a hollow tube adapter with a multipunched card mount for attaching it to a host binding.
Figure 22:
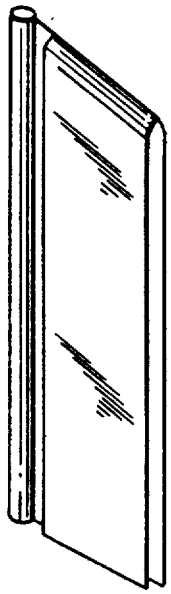
FIG. 22 shows a hollow tube adapter with a broad clip for attaching it to a host book.
Figure 20A:
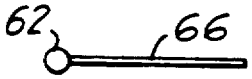
Figure 21A:
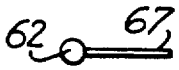
Figure 23:
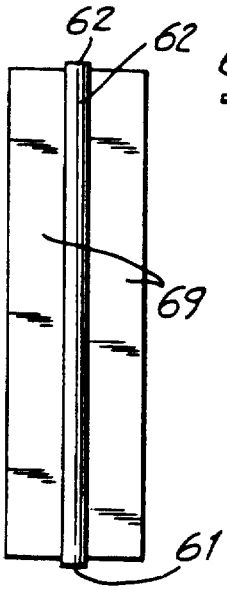
FIGS. 23 and 23*a* show elevational and top views, respectively, of a hollow tube adapter with a card mount for attaching to the host book, with the tube situated in the center of the card.
Figure 23A:
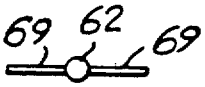
Figure 24:
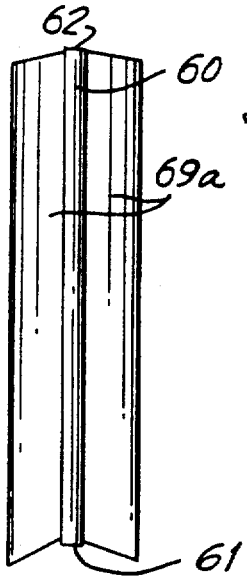
FIGS. 24 and 24*a* show elevational and top views, respectively, of a hollow tube adapter with a card mount, with the tube situated in the center of the card, and where the card folds.
Figure 24A:
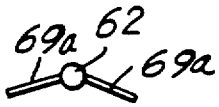

FIGS. 20 and 20*a* shows tube 60 on a card adapter 66 for sliding into a host book cover. FIGS. 21 and 21*a* show a card 67 with multiple holes punched. This adapter would permit the tube to be placed in the inner area of a multi-ring binding. FIGS. 22 and 22*a* show tube 60 with a clamp-style attachment 68. This would allow the tube to be slid onto the back cover of a paperback book or other style of book cover of a firm rectangular shape. FIGS. 23 and 23*a* shows the hollow tube adapter 60 mounted in the center of card 69. This fitting would permit the adapter to fit into a cylindrical gap of the type shown in FIG. 32. FIGS. 24 and 24*a* show tube 60 mounted in a folding card 69*a*. This type of fitting would allow the tube to be deployed in a book cover as a standard feature of the cover. The tube could be on the inside, outside, or formed directly as part of, the folding card.

Figure 57B:
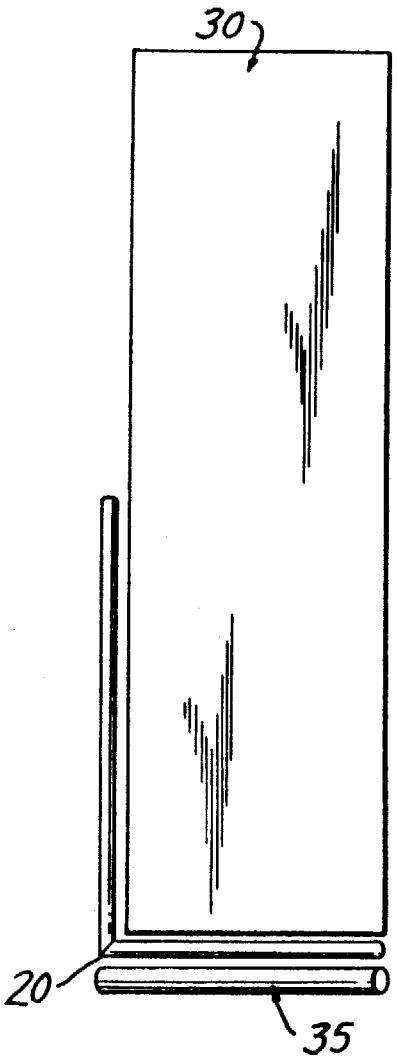
FIG. 57*b* shows an orientation flap of a construction kit, having width one-half the width of the mounting surface and length equal to the length of the mounting surface of FIG. 57*a* as well as a short frame and a hollow tube coupling.
Figure 57A:
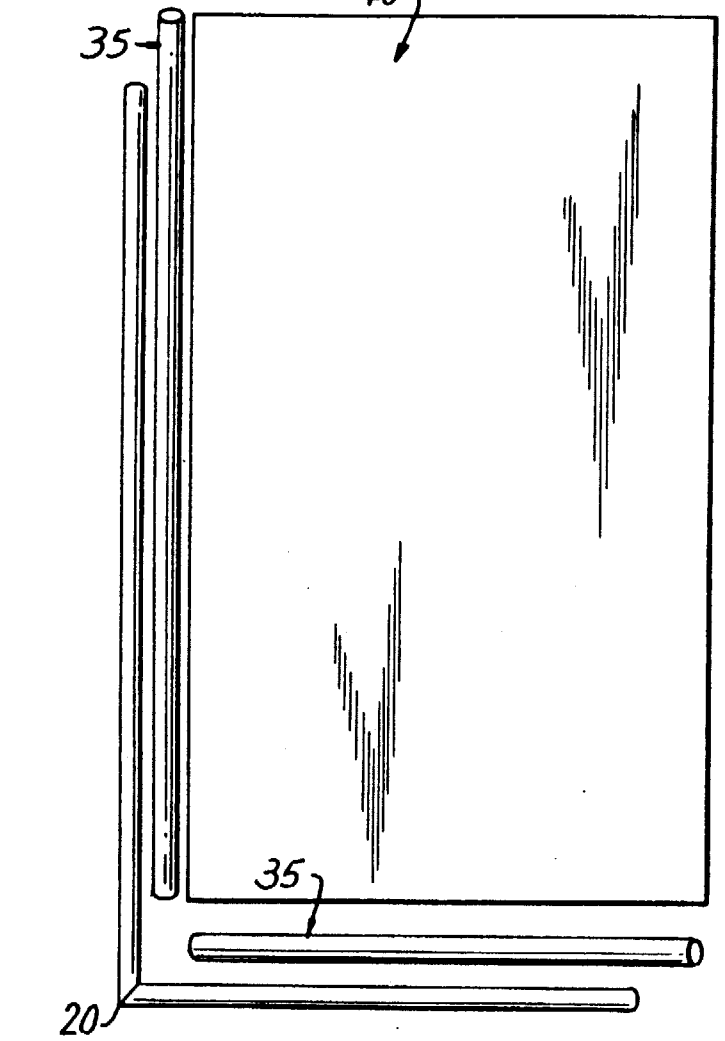
FIG. 57*a* shows a front elevational view of a portion of a construction kit system, including a mounting surface member, two lengths of binding tubes for coupling a frame, and a frame of length and width substantially equal to the coupling element.
Figure 57D:
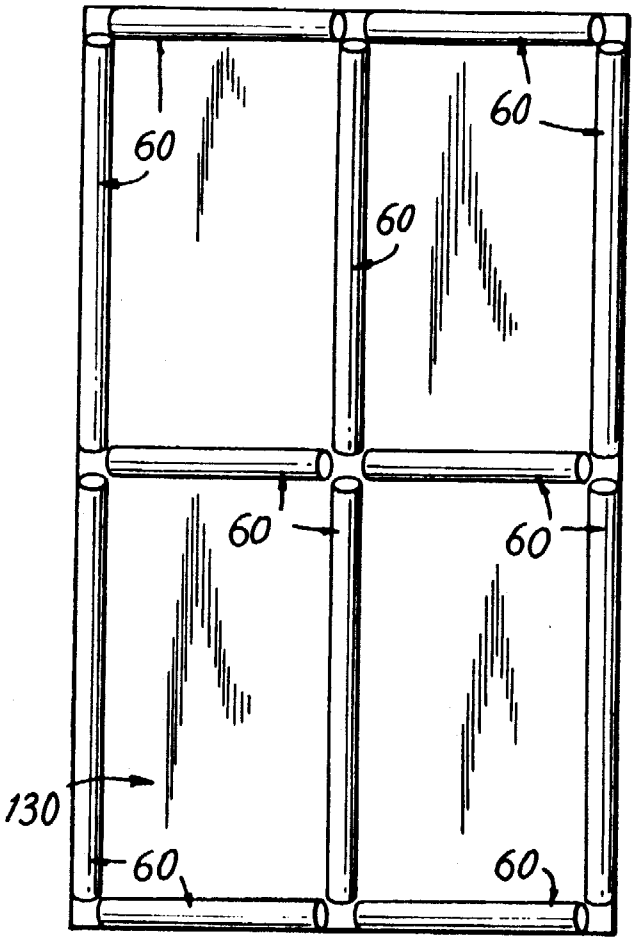
FIG. 57*d* shows a host object coupling system showing how up to twelve coupling structures could be attached to a base suitable for configuring a frame-based system; one or more of the tube coupling structures being removable to enable the construction of the preferred combination of parts.
Figure 57C:
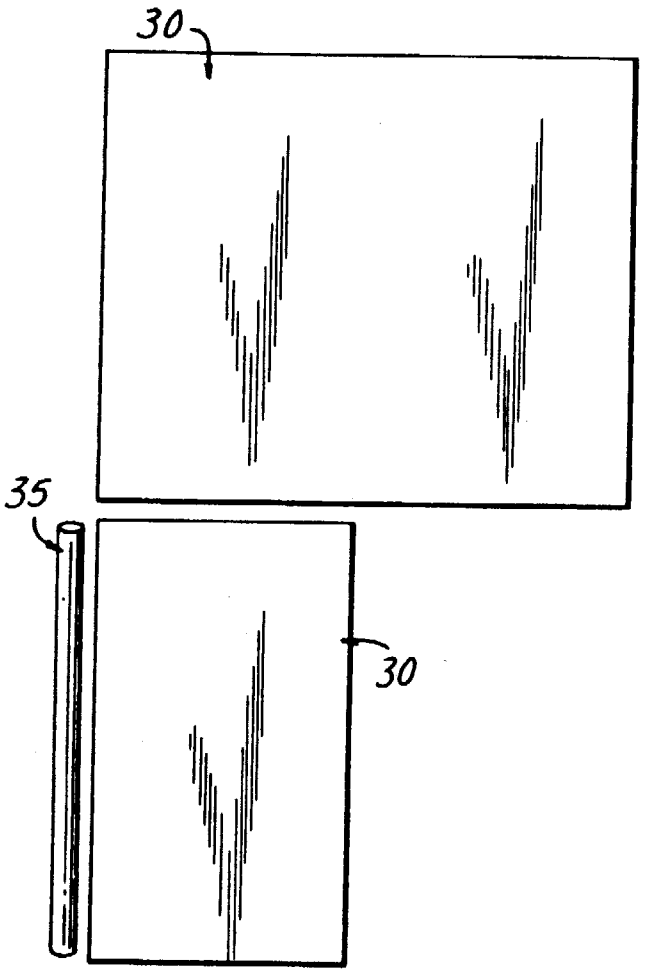
FIG. 57*c* shows two additional orientation flap members of a construction kit, having sizes one-half and one-quarter the mounting surface size of FIG. 57*a* and a suitable one-quarter length coupling tube.

A host book can have primary and secondary spines. FIG. 56 shows a secondary spine 78 positioned equidistantly between the primary spine 75 and the outer edge of the right cover. Additionally, a secondary spine 78 is shown mounted on the edge of the left cover of the host book. A frame 20 is mounted in each secondary spine 78. FIG. 57*d* shows a host object with a coupling structure configuration with multiple attachment points. The coupling structures for a book may include the spine but are not limited to the spine and can be formed by any set of parallel or orthogonal structures at the edges of a book cover or along the surface of the cover at various useful points, such as co-located at the spine.

Figure 58:
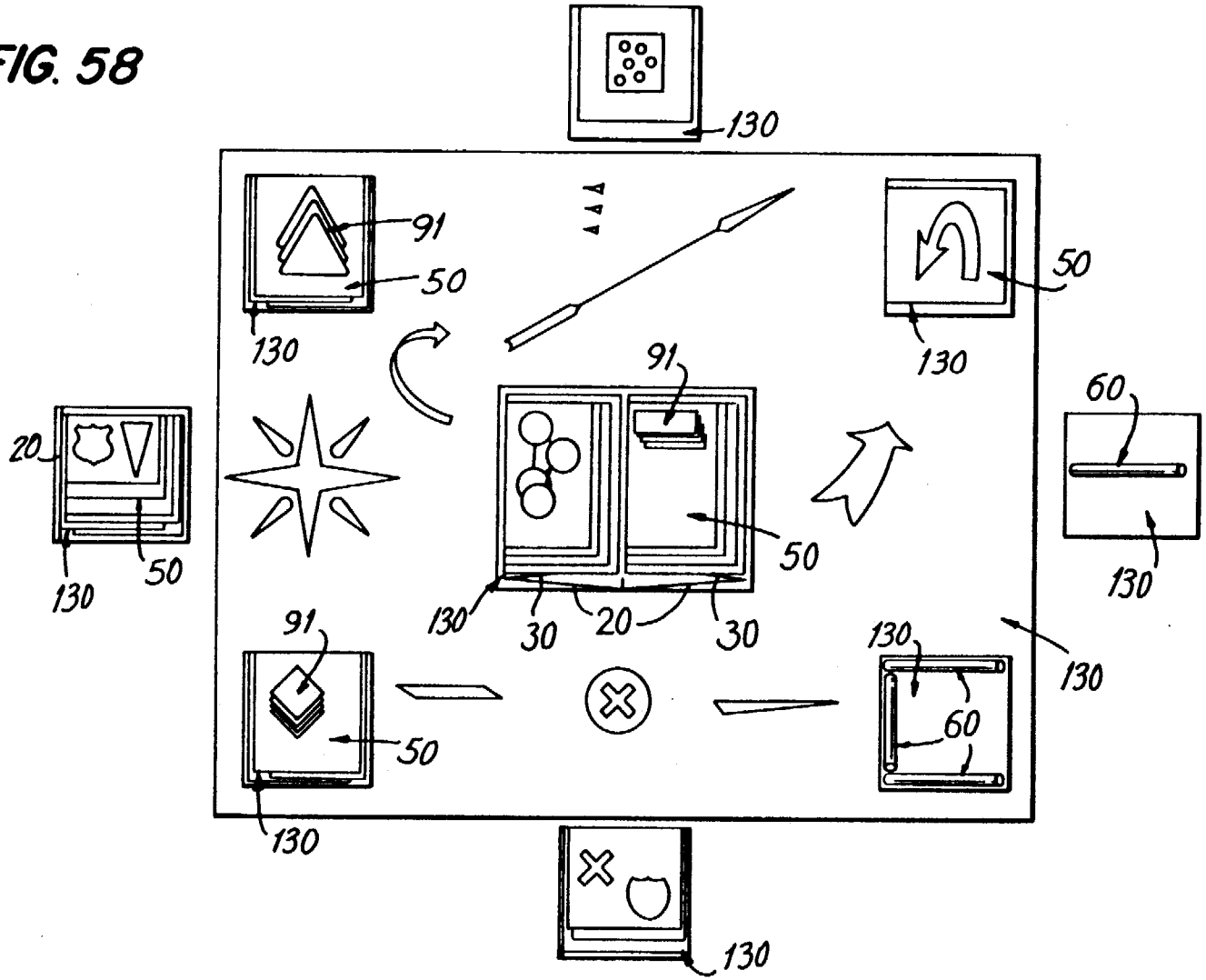
FIG. 58 shows a game board with up to eight host coupling structures and frame attachments as HyperBinding modules in various stages of completion, along with a center piece master HyperBinding module.

FIGS. 57*a–d* show the basis for a host object construction kit in which the configured host object system may be made by combining the sub-components of frame attachments and leaf attachments comprising elements including various mounting surfaces 40 and orientation flaps 30 in different sizes where the orientation flap is attachable between frame and mounting surface using techniques as shown for example in FIG. 39 in a system suitable to a problem or unique application, such as a knowledge-based game. The system includes coupling structure base 130 having an array of adapter modules 60. FIG. 58 shows how such a construction kit could be employed as part of a game board configuration in which each HyperBinding module is assembled according to the script of the game. In each module, configurable base 130 is in various stages of assembly.

Figure 54:
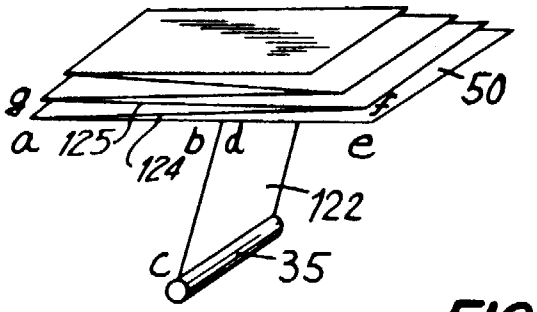
FIG. 54 shows the leaf of FIG. 53, with the additional plurality of leaf surface sections folded into a set of pages, all formed from the single piece of material.
Figure 52:
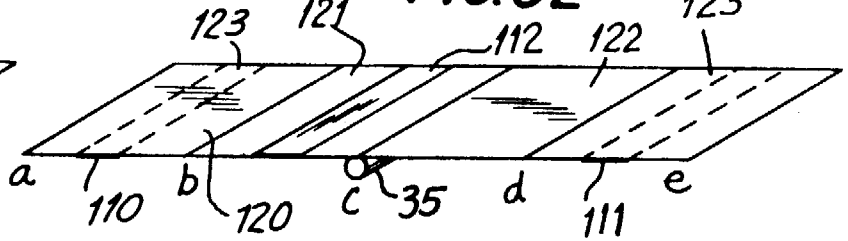
FIG. 52 shows a perspective view of FIG. 50 where the leaf comprising two surface sections and two orientation flap sections is extended and laid in a single plane, with the pivotal adapter shown in the middle.
Figure 53:
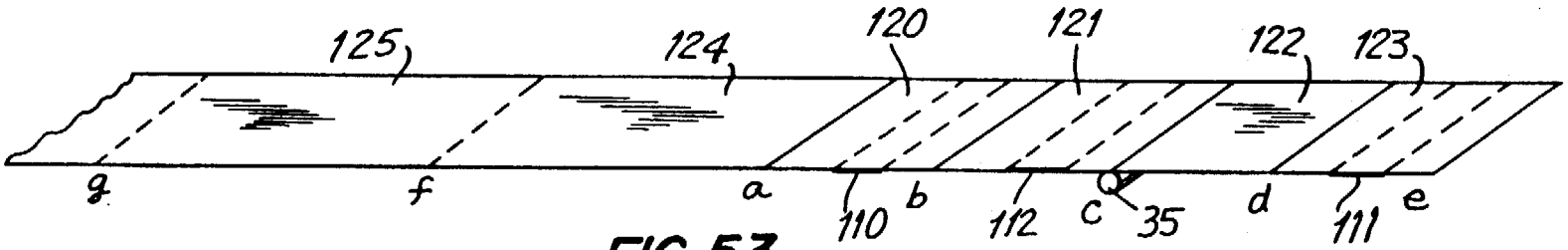
FIG. 53 shows the leaf of FIG. 50 with a plurality of leaf surface extensions f-g laid in a single plane.
Figure 50:
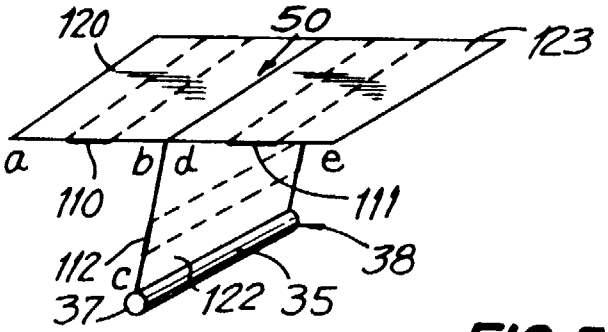
FIG. 50 shows a perspective view of a mounting surface and orientation flap with a tube adapter and a retentive mechanism as cut from one piece of material showing corners a, b, c, d and e.
Figure 51:
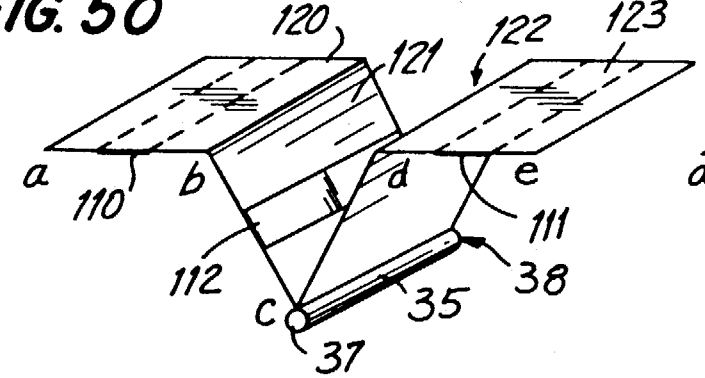
FIG. 51 shows corners a, b, c, d and e of FIG. 50 partially separated in perspective.

For the preferred embodiment, there are additional variations shown in FIGS. 50–54. FIG. 50 shows a mounting surface and orientation flap perspective view. The elements 110, 111 could be made of thin metal strips. Element 112 could be a magnetic element. This would permit the joining of corners a and c or alternatively e and c on a semi-permanent basis. FIG. 51 shows one means for forming the leaf 80 comprising a mounting surface 40*c* having sections 120 and 123, and orientation flap sectins 121 and 122 and tube section 35 from one piece of material with a surface, 58, mounted thereon. The corners b and d are joined with orientation flap surfaces 121, 122 being adhesively connected to form an orientation structure. Retaining element 112 could be concealed between the surfaces. FIG. 52 shows the leaf of FIG. 51 laid out in a single plane. Hollow tube adapter 35 could also be another type of binding. FIG. 53 shows the addition of surfaces 124, 125 which, along with an arbitrary number of additional surface extensions, could be folded to form a plurality of surfaces, 50', on top of the mounting surface, as shown in FIG. 54 where the entire leaf, 80, is comprised of one piece of material. Laminate 58' is shown, as an example, as it would be attached to the plurality of leaves, 50'.

Figure 7:
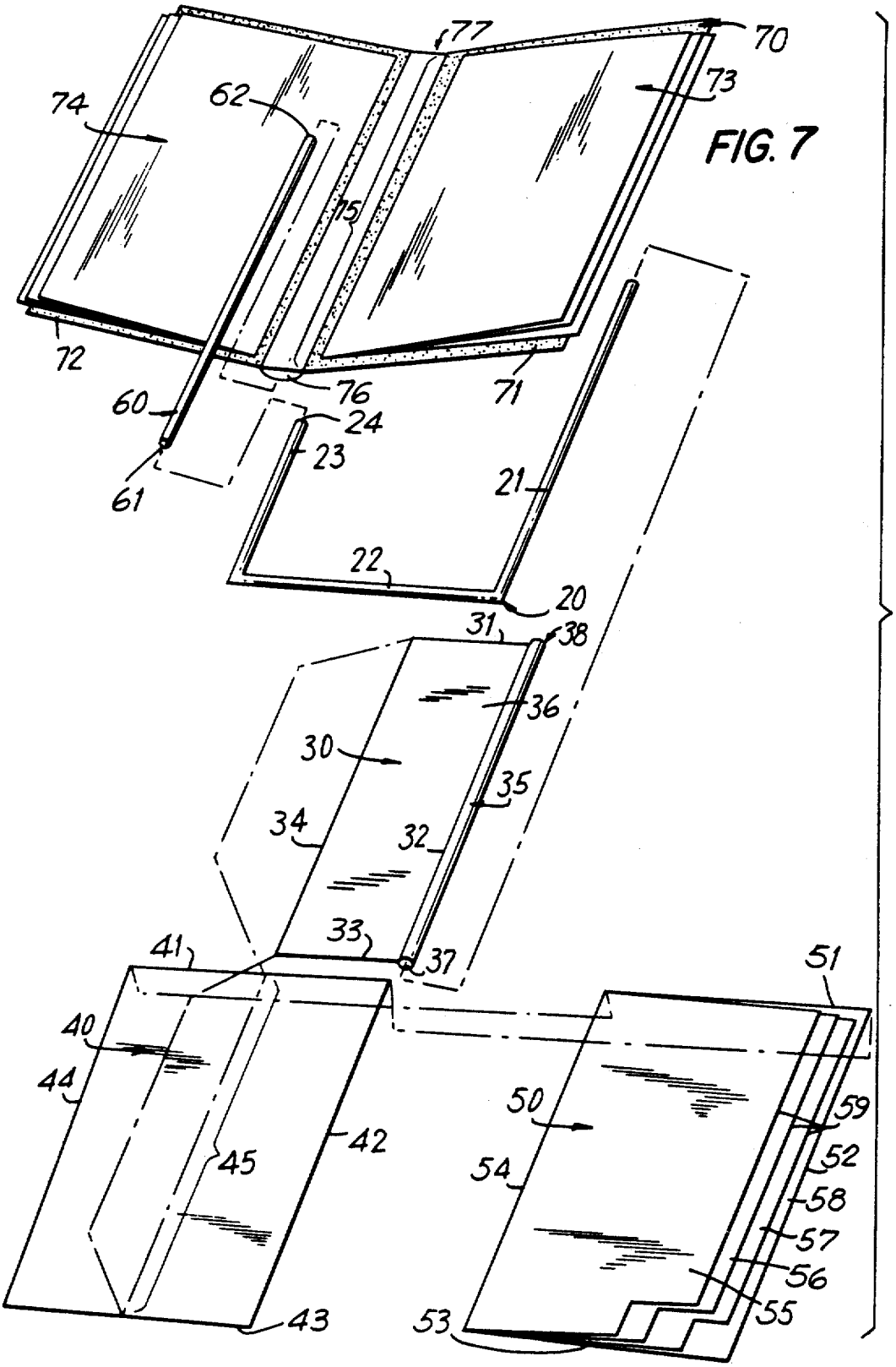
FIG. 7 is an exploded perspective view of the book and book attachment of FIGS. 1–6 showing a frame, an orientation flap, a mounting surface, a plurality of folding surfaces, an adapter fitting, and a host book.
Figures 50, 51, 52, 53, 54:
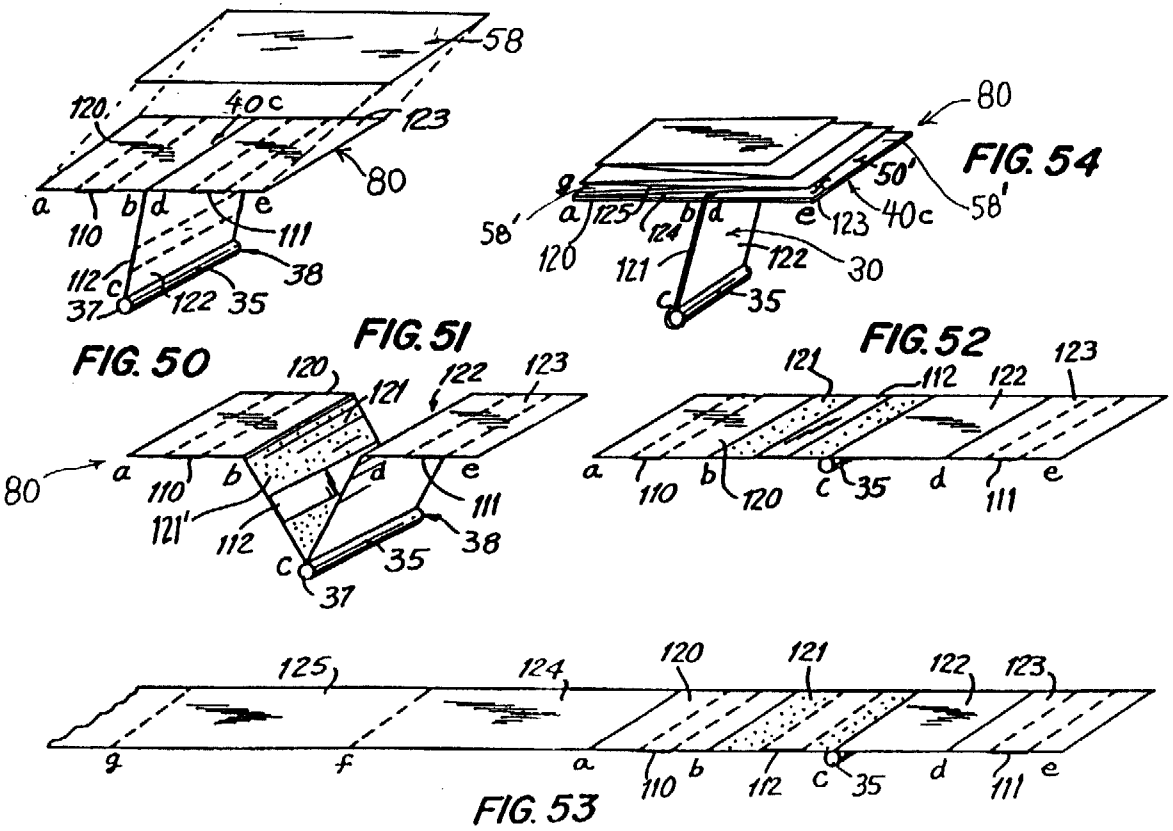
Figure 54A:
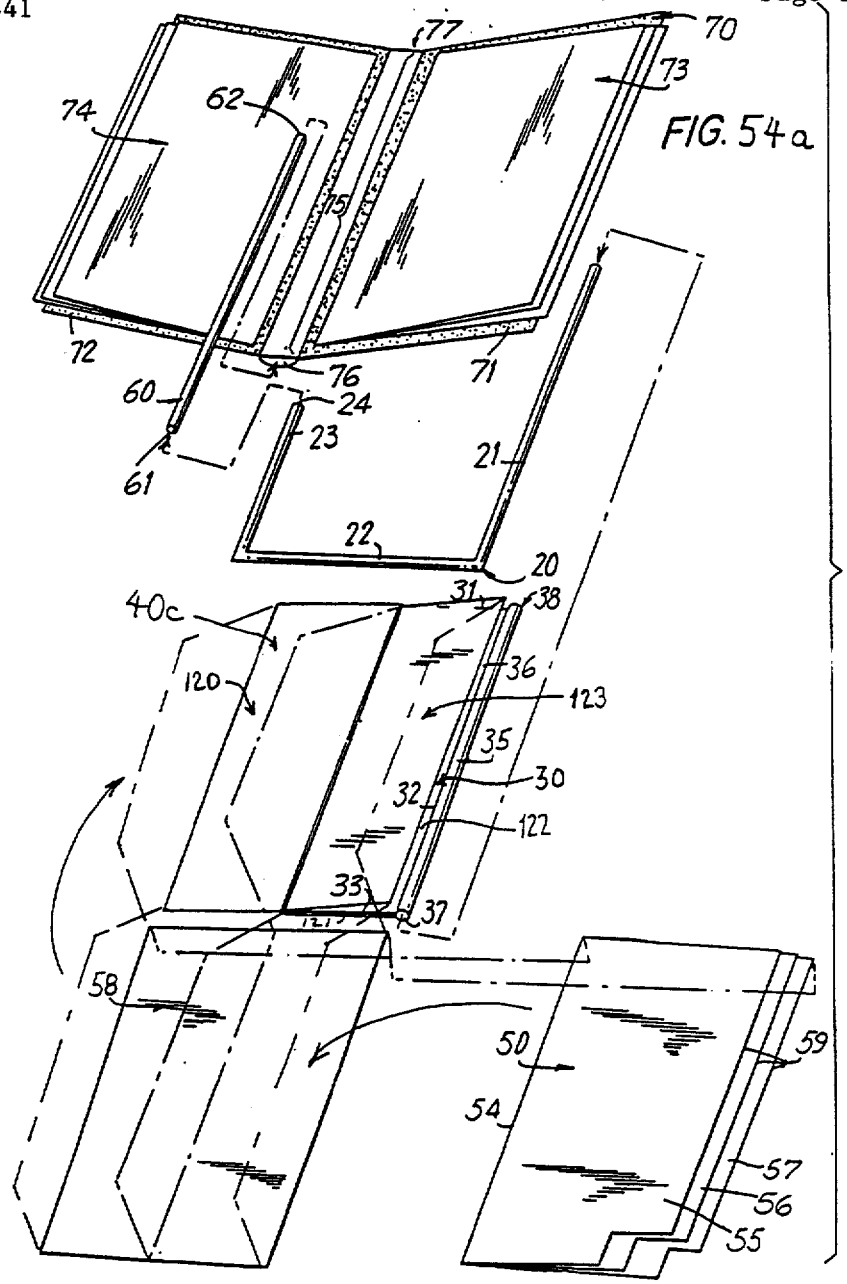
FIG. 54*a* shows the explosion of a construction like that of FIG. 7, as a formal synthesis, that shows one detailed way in which such a form can be made.

FIG. 54*a* shows the explosion of a construction like that of FIG. 7, as a formal synthesis, that shows one detailed way in which such a form can be made. In this embodiment, the flexible material, Tyvec as an example outlined earlier, is folded with the wing sections 120 and 124 forming a mounting surface 40*c* to which leaf set 50 comprising leaves 55, 56, 57, and 58 are attached by mounting 58 to 40*c*.

Figure 54B:
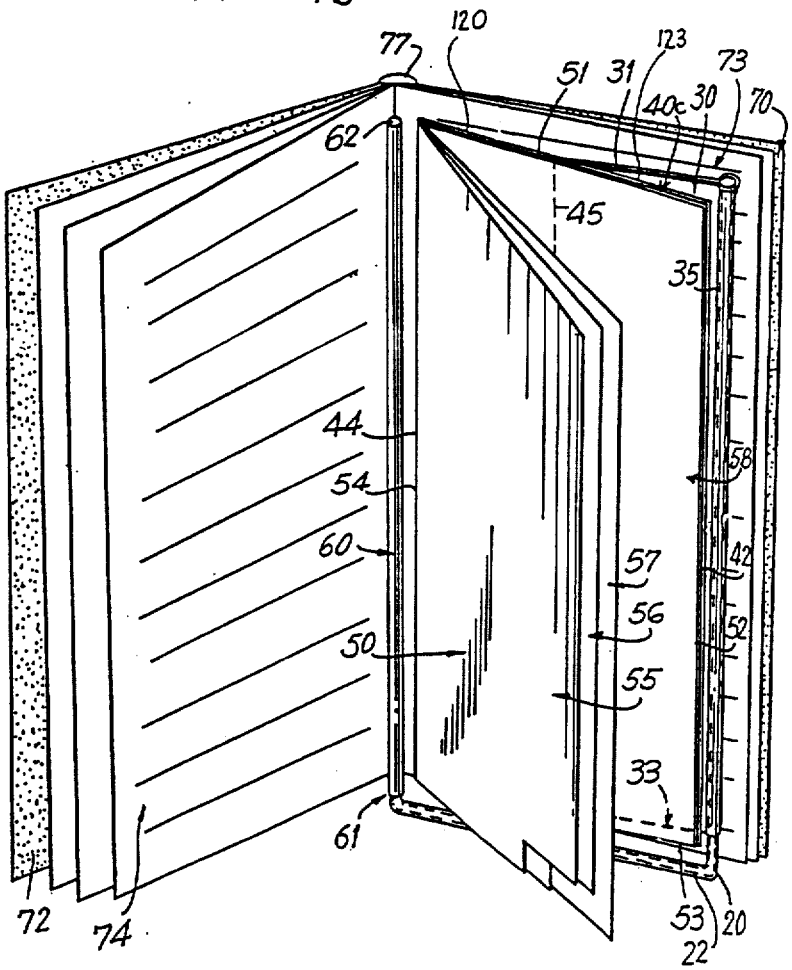
FIG. 54*b* shows the construction of FIG. 54*a* as an integral module.

FIG. 54*b* shows the construction of FIG. 54*a* as an integral module. The leaf array is a set of pages which are permanently attached to the mounting surface and are reusable for the display of information, using for example, stickon notes as explained earlier in FIGS. 46 to 49.

Figure 54C:
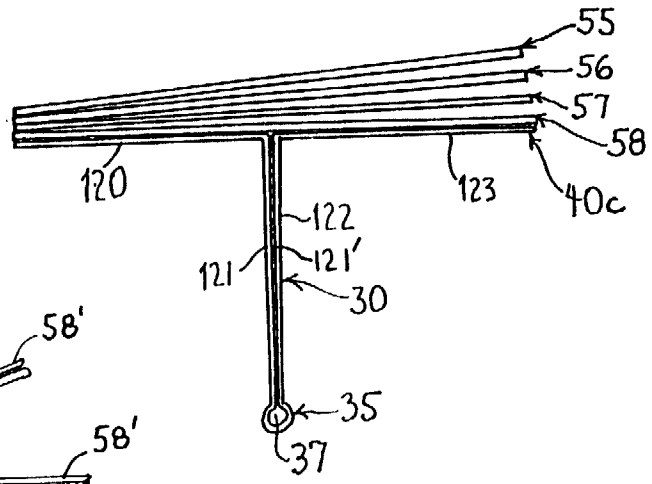
FIG. 54*c* is a side view of FIG. 54*b*.

FIG. 54*c* is a side view of FIG. 54*b*. The layered construction is made more easily discernable.

Figure 54D:
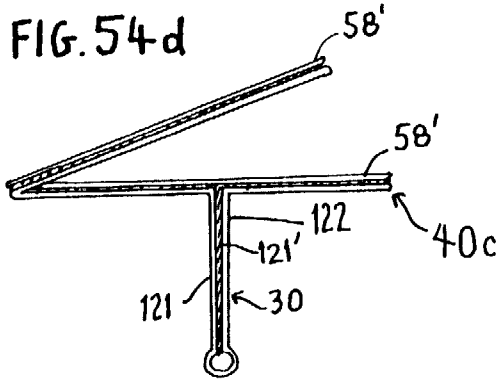
FIG. 54*d* is a side view of FIG. 54 and shows the laminated mounting surfaces as detailed for the repositionable note taking application.
Figure 55:
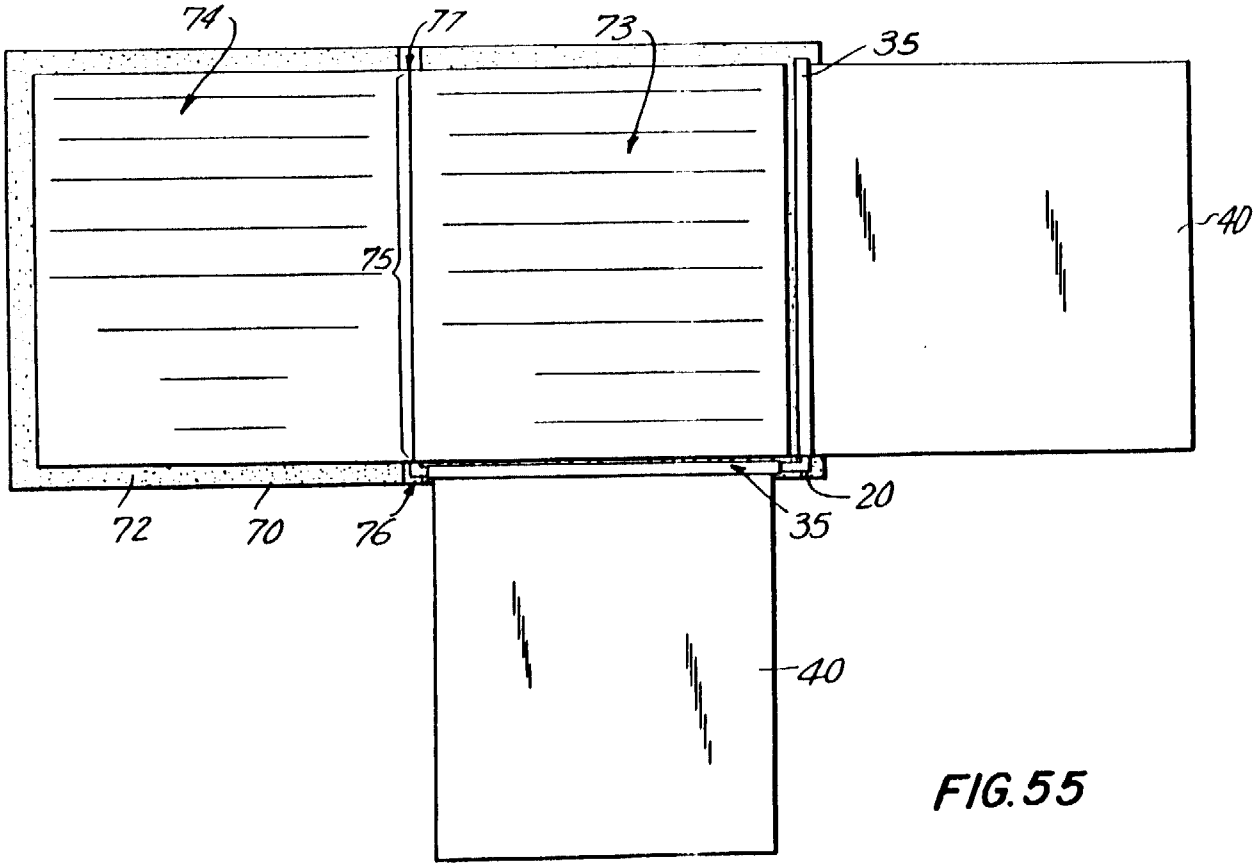
Figure 56:
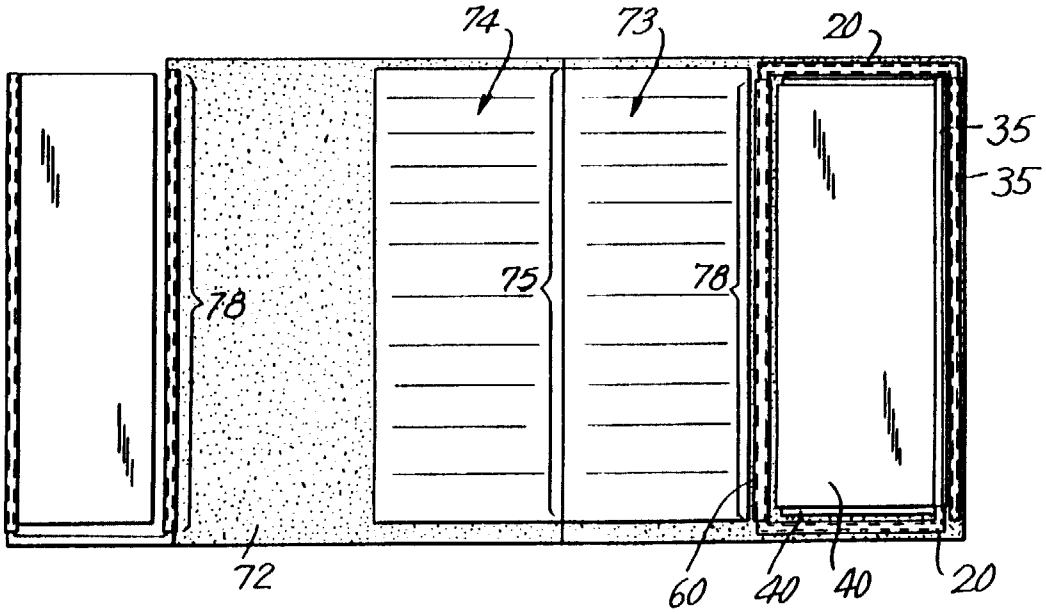
Figure 57B:
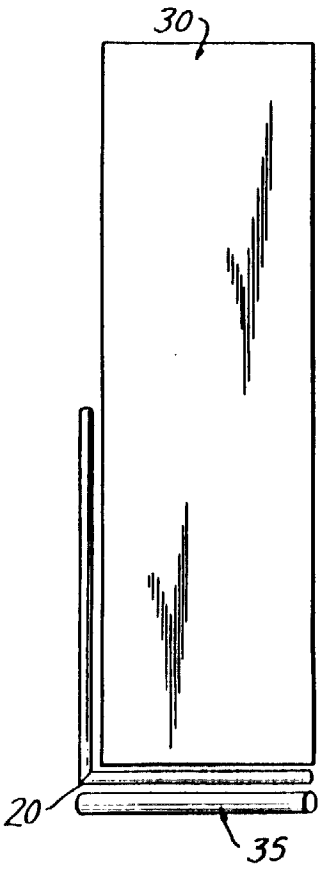
Figure 57A:
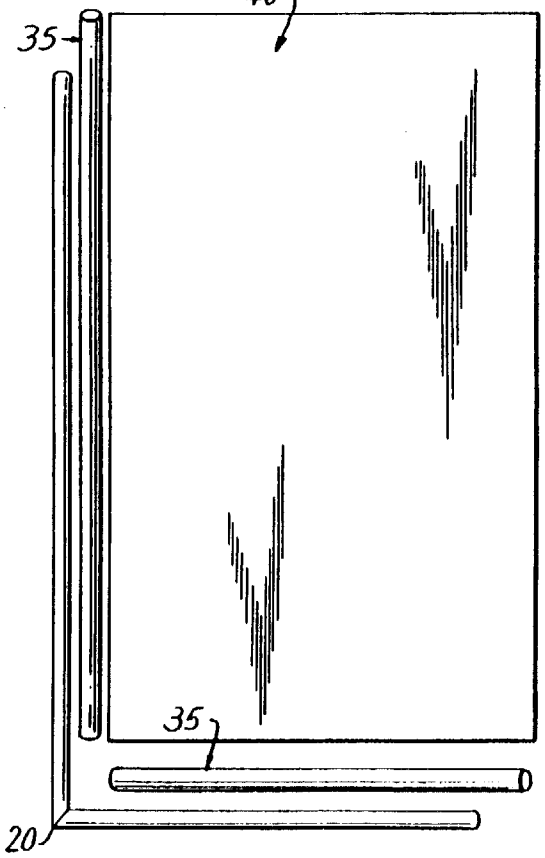
Figure 57D:
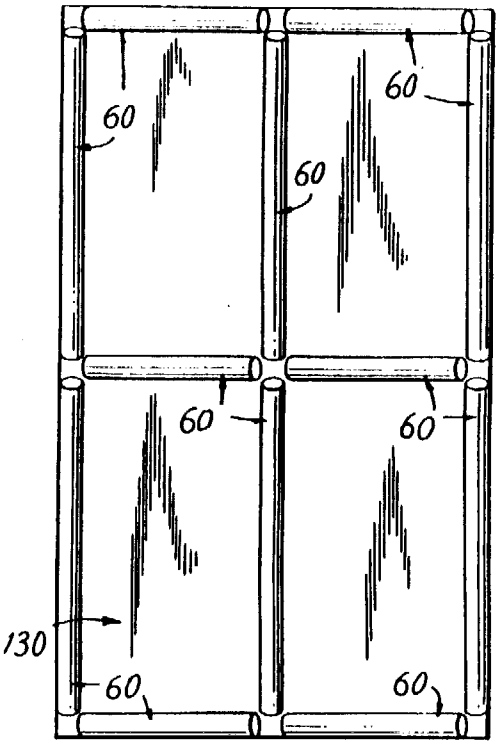
Figure 57C:
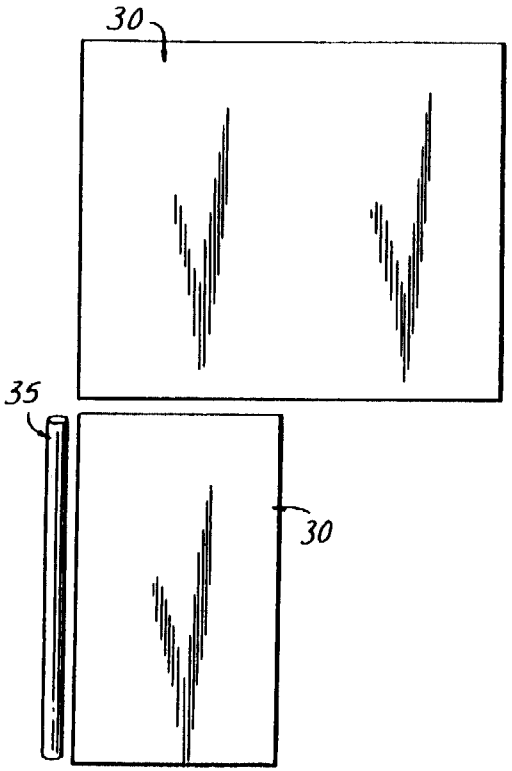
Figure 58:
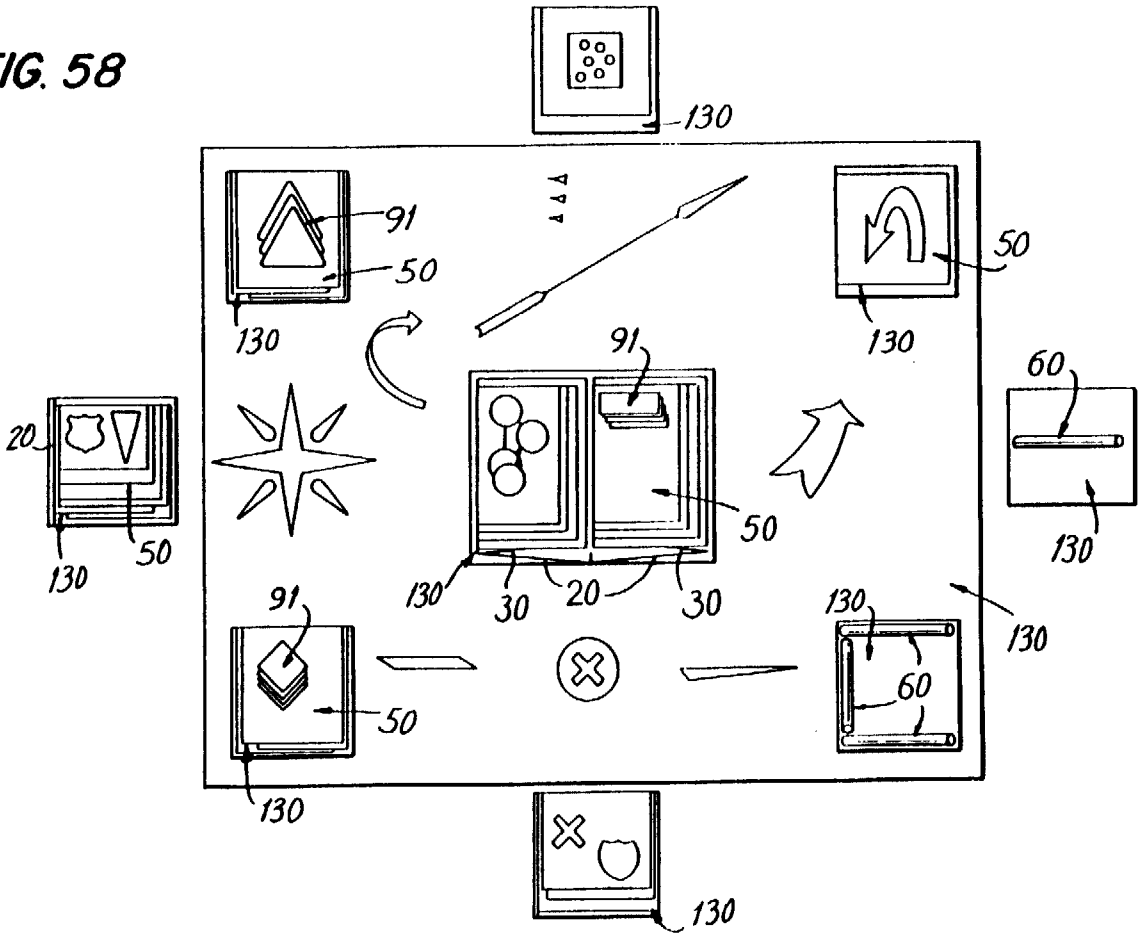
Figure 59:
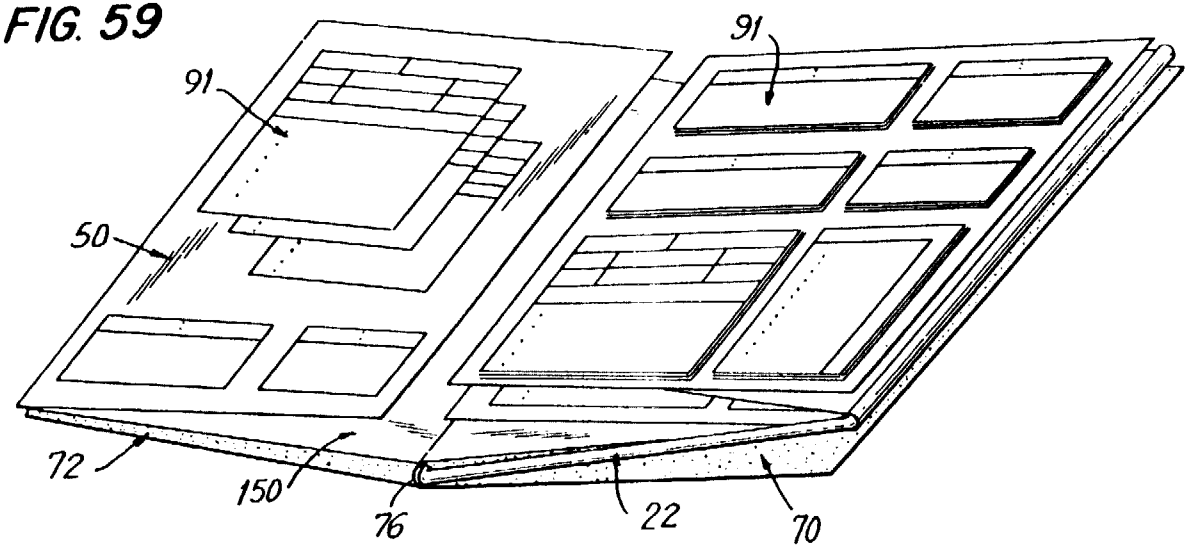
Figure 59A:
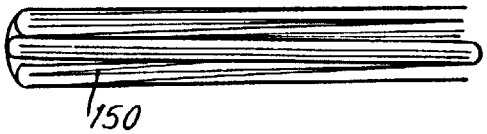
Figure 59B:
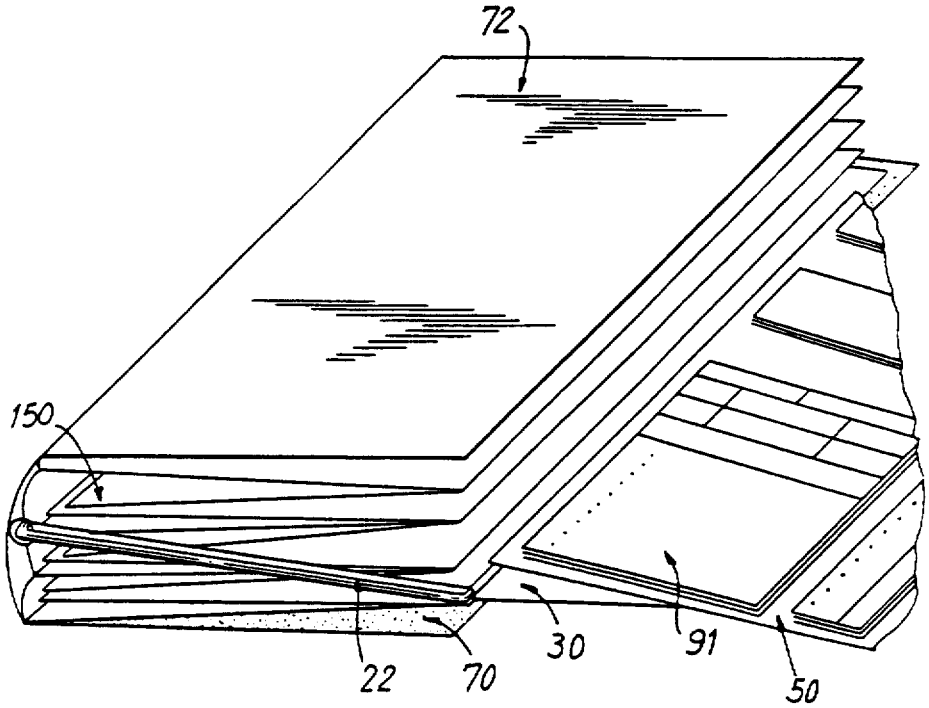
Figure 60A:
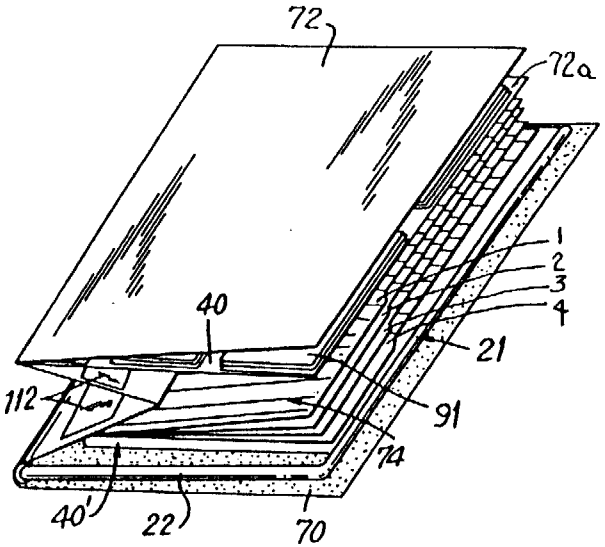
Figure 60:
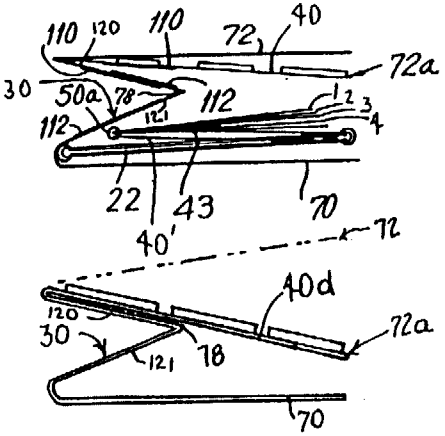
Figure 60B:
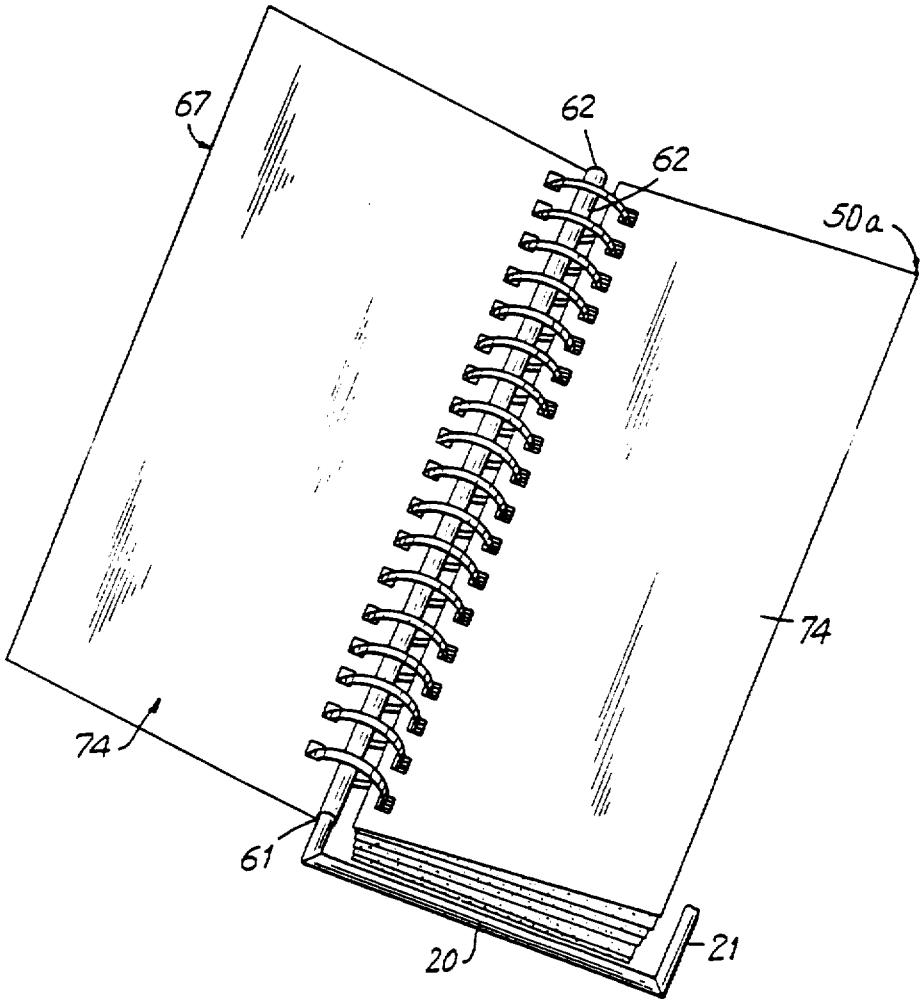
Figure 61:
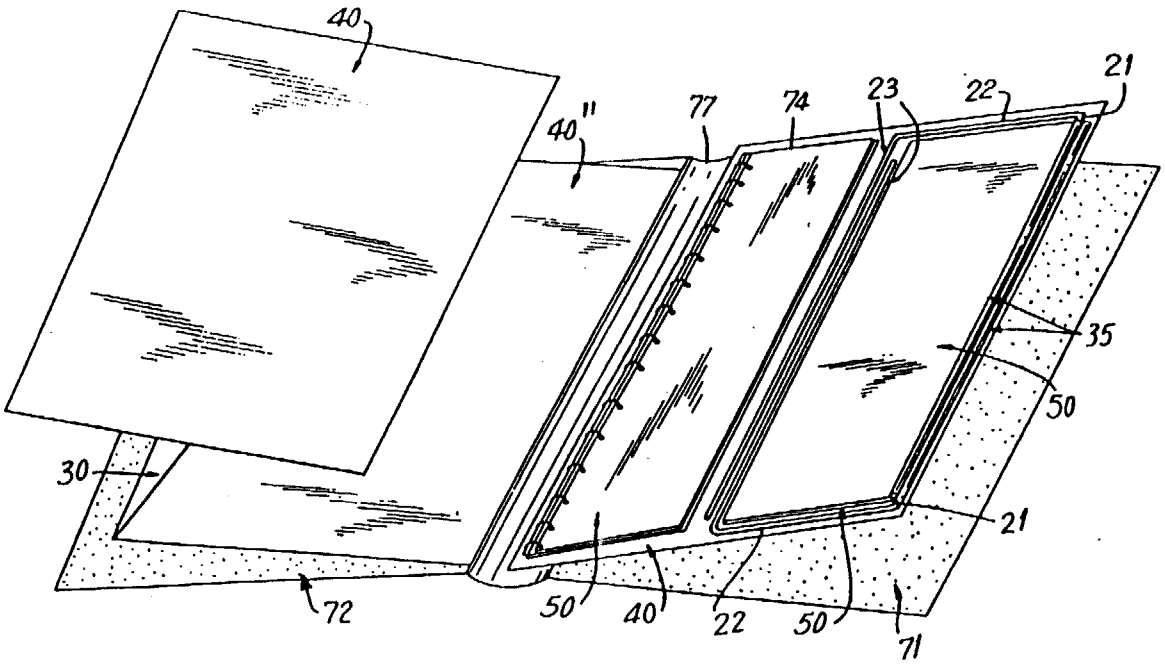
Figure 64:
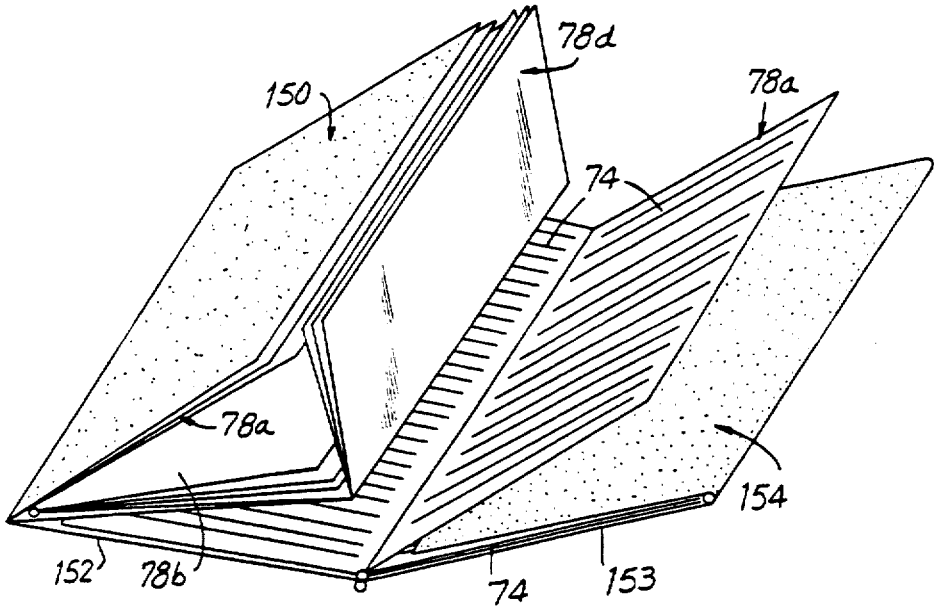
Figure 65:
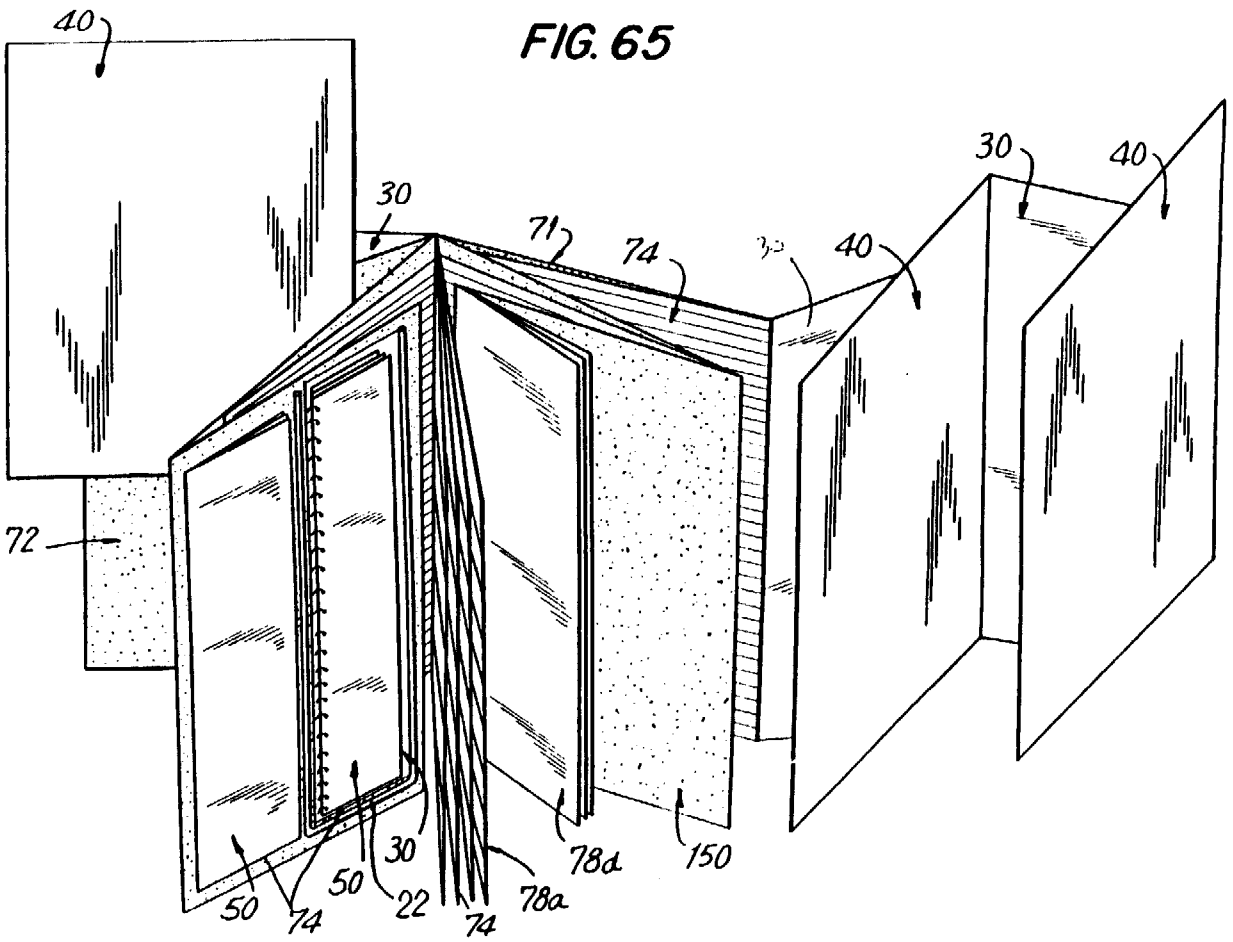
Figure 66A:
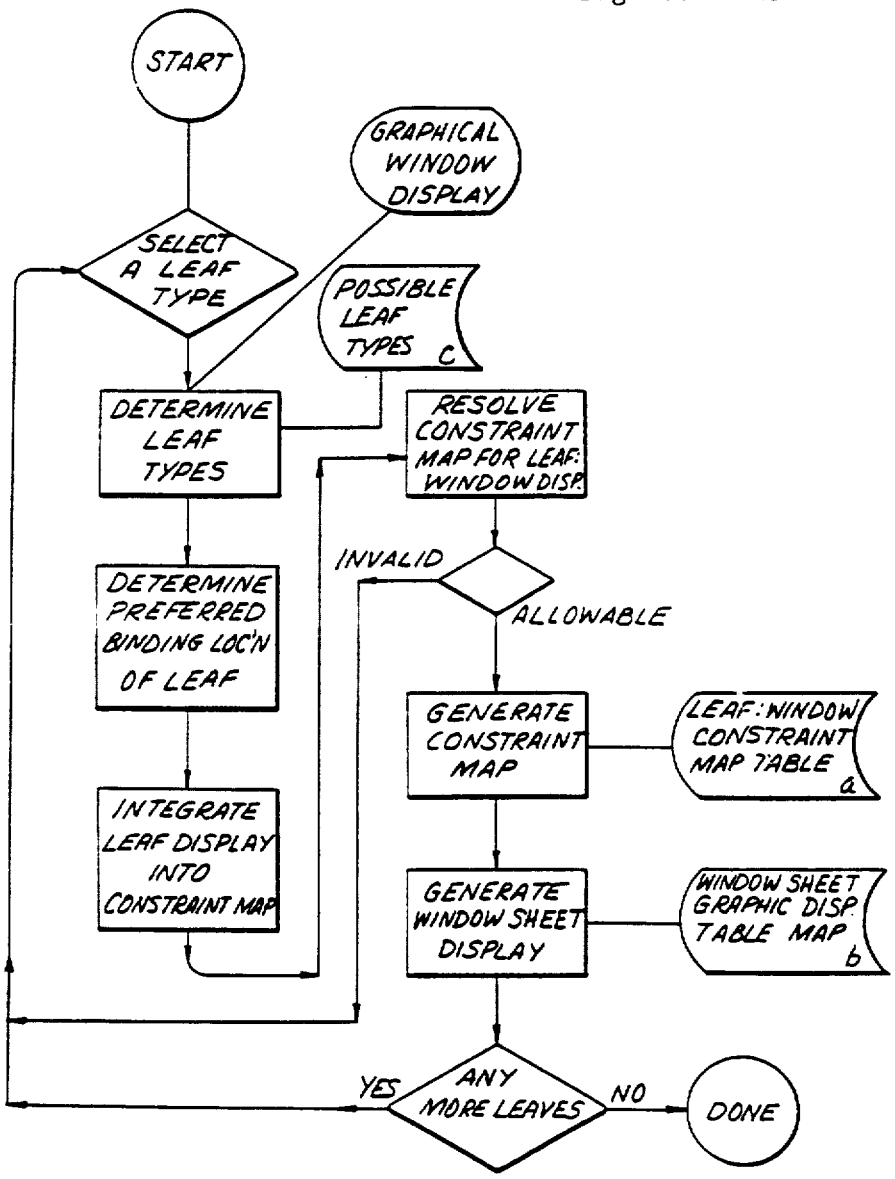
Figure 66B:
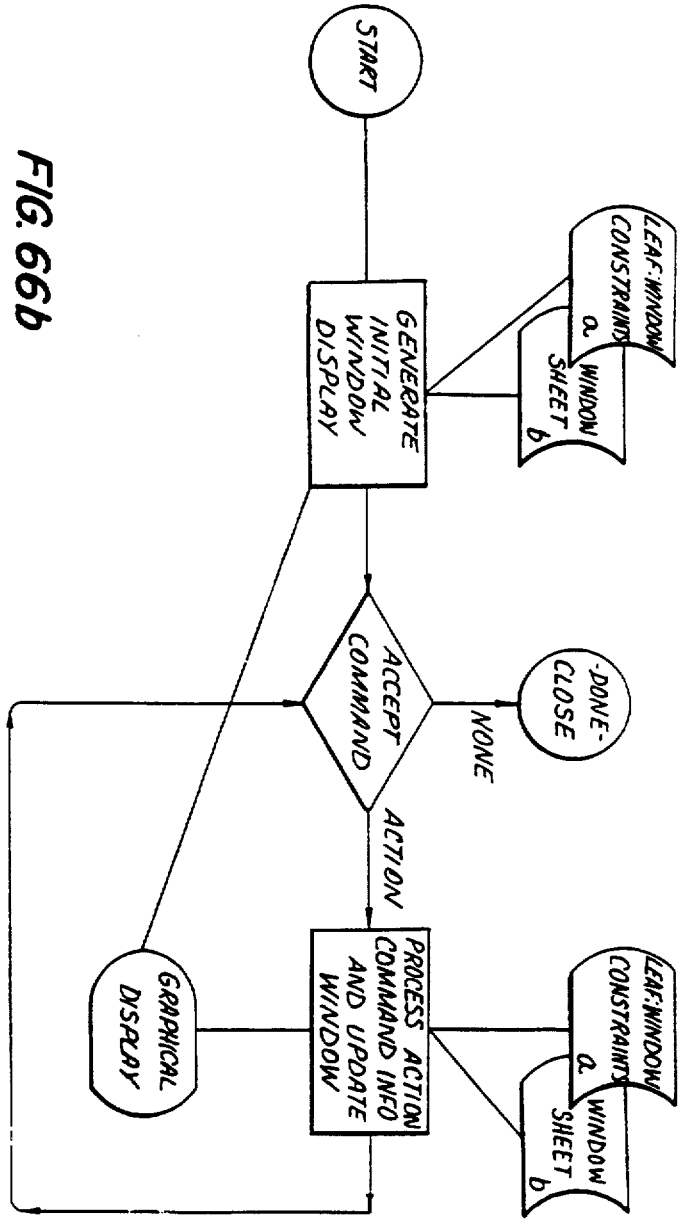

FIG. 54*d* is a side view of FIG. 54 and shows the laminated mounting surfaces as detailed for the repositionable note taking application. The layered construction is made more easily discernable. Element 58', the laminate referred to earlier as being important for making a stick-on note variation of the invention are shown here as it would be attached to the surfaces of leaf 80.

Figure 59:
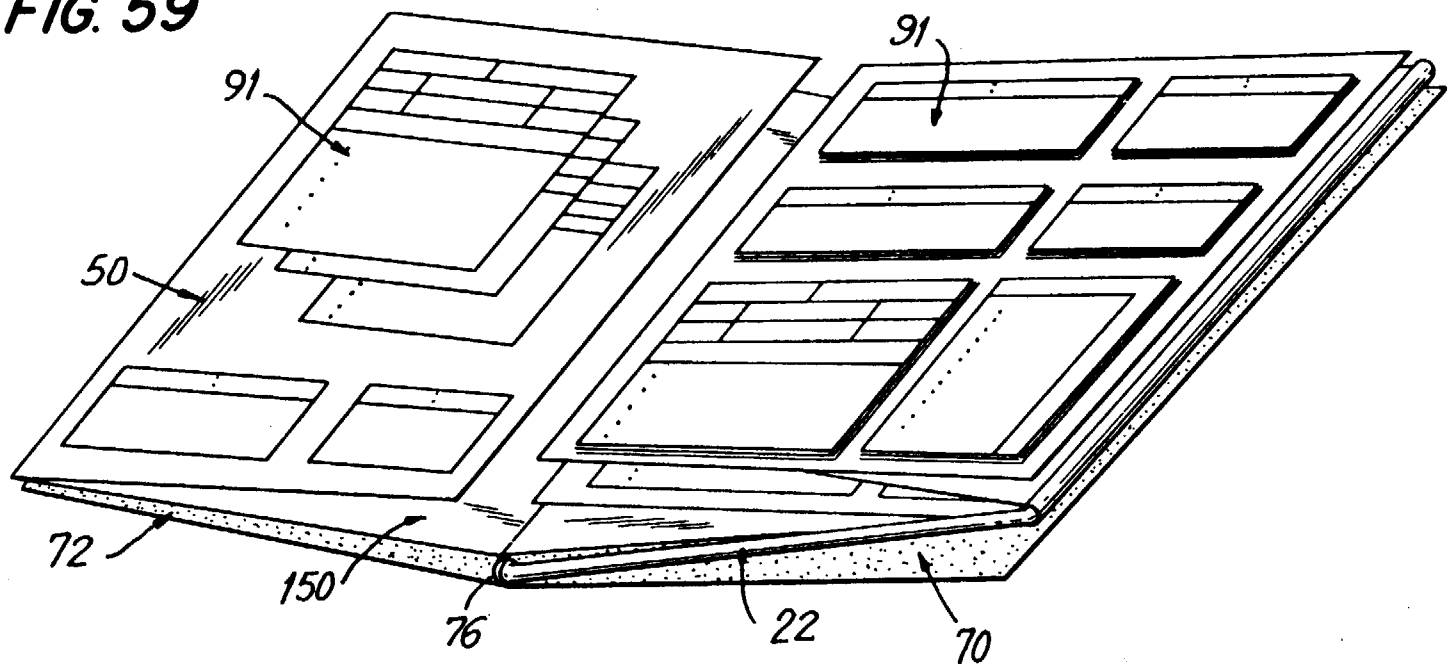
FIG. 59 shows a perspective view of a frame-based notebook with one orientation enabling frame member and a simple supra-folded module with four surfaces suitable for the manipulation of repositionable notes.
Figure 59A:
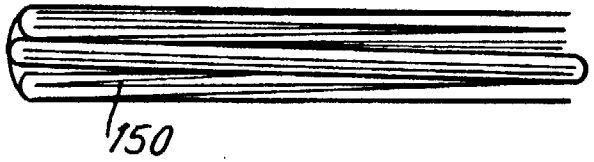
FIG. 59*a* shows a side view of the frame-based notebook of FIG. 59.
Figure 59B:
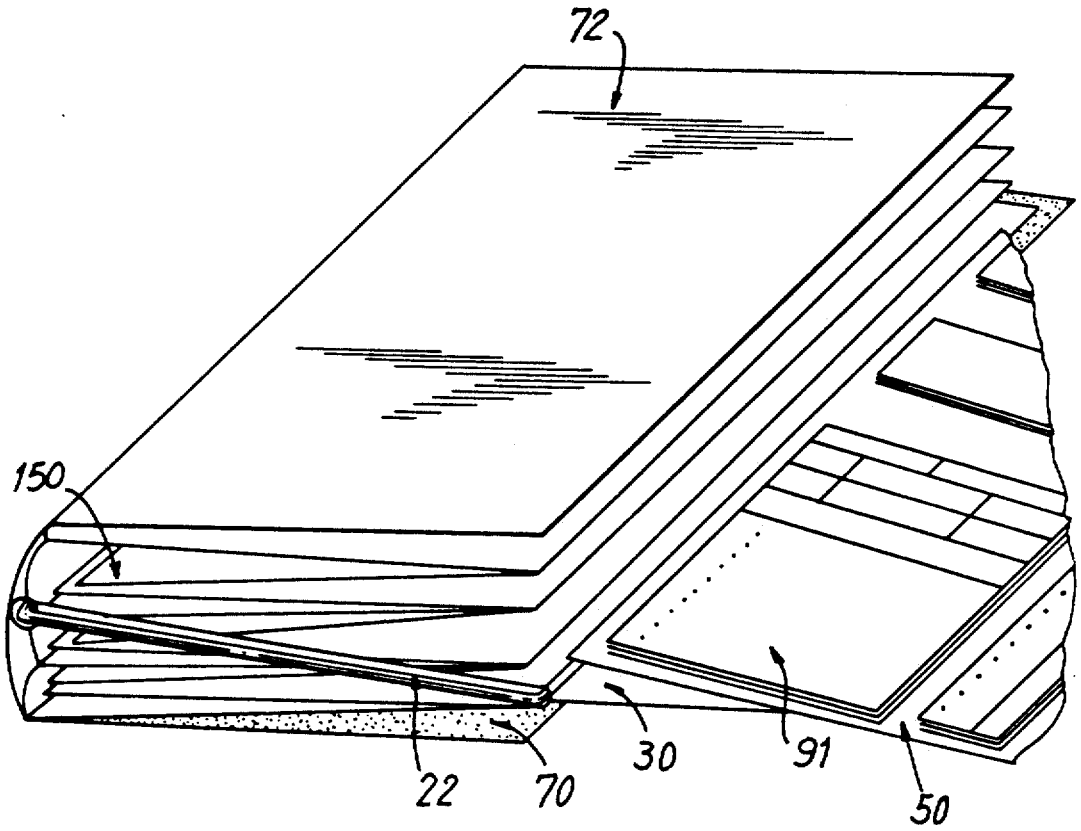
FIG. 59*b* shows a partial perspective view of the frame-based notebook of FIG. 59*a* with three supra-folded modules and one frame, with the leaf mounting surface portion comprising an array of repositionable notes with a partial information structure format, out and to the right.

A variety of host book metaphors may be configured according to the invention. A basic embedded system is shown, as explained in FIG. 1. In FIGS. 59–59*b*, a system is shown in which the pages are themselves supra-folded leaves and the floating page is provided via a frame attachment with an orientation preserving flap. This type of notebook configuration would be ideally suited for use with repositionable notes, where each of the supra-folded surfaces would be utilized for a different purpose, and a supra-folded module could be designed to implement an object or agency center according to the invention. As shown, supra-fold base 150 is a rectangle folded in four substantially equal parts for use in the purposeful ordering of an array of repositionable notes 51.

Figure 60A:
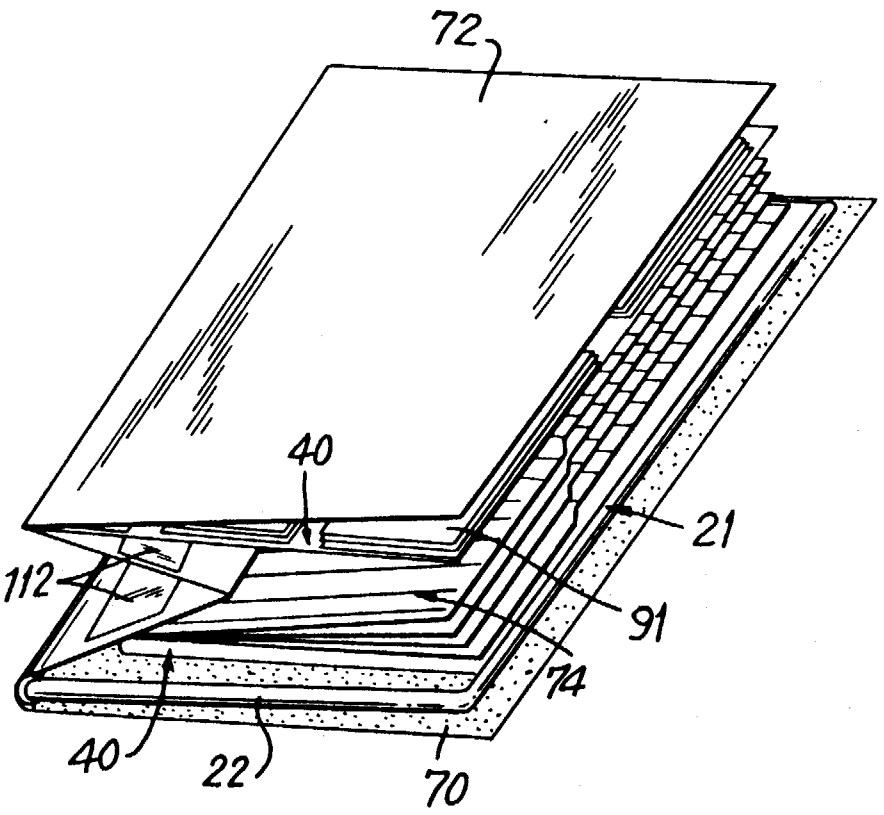
FIG. 60*a* shows a side view of the frame-based notebook of FIG. 60.
Figure 60:
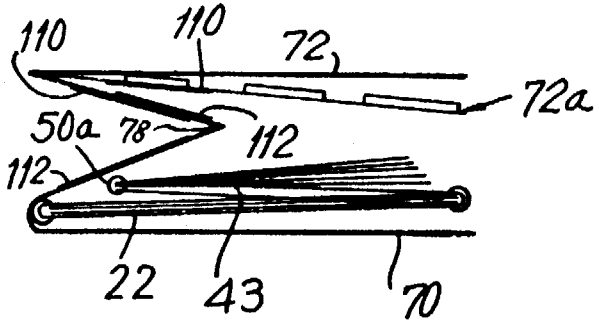
FIG. 60 shows a side view of a notebook formed from a split cover repositionable note reservoir, mounted to a bottom cover by an orientation flap segment which is one-half fold of the panel connecting the bottom portion and the note reservoir, a portion of which is attached to the back of the note reservoir cover section forming a pivotal axis at the fold of the orientation flap segment, and with the bottom cover fitted with a coupling structure along the binding to the orientation flap for retaining a frame leaf set attachment thereon.
Figure 60B:
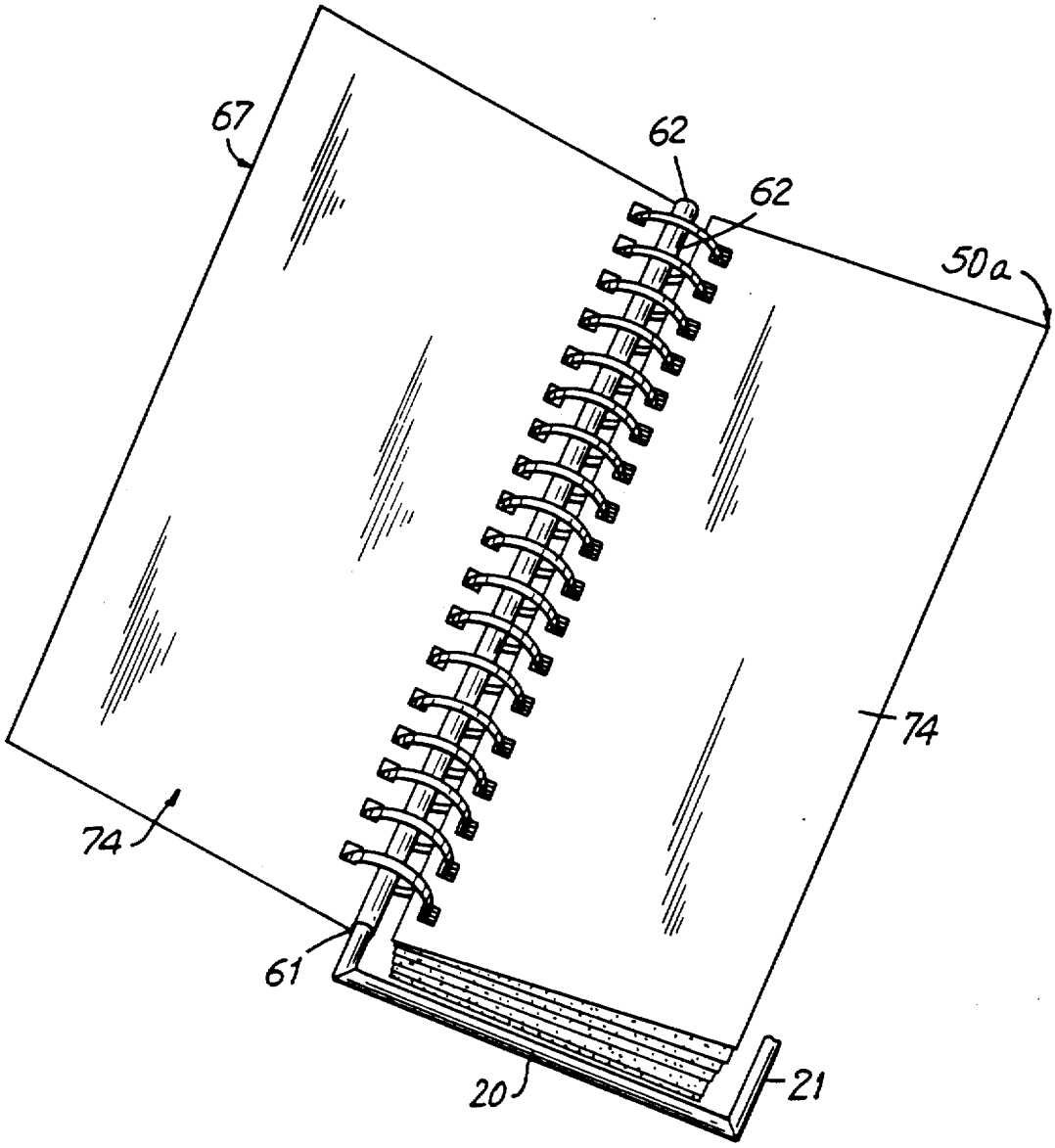
FIG. 60*b* shows a perspective view of a leaf set configuration.

In FIGS. 60–60*a*, the host book has two covers, a top and bottom. The top cover 72 is a supra-folded surface having a mounting surface 40 with a reservoir of repositionable notes as a note-taking media 72*a*, and a cover orientation flap comprised of orientation section 121 and mounting surface portion 120 (see for example FIG. 51) pivotally hinged at pivotal axis 78, that allows the top surface to be moved left into a co-planar and non-overlapping position with the base or right, into a coplanar overlapping position with the base mounting surface 120 being attached to the bottom mounting surface 40 by for example strips 110 and 112. The leaf set 50*a* comprises a set of die cut surfaces which may be rotated about their frame-based binding, enabling the surface numbered 4 to be positioned in a position under the mounting surface, 40', and below die cut surface number 1, or, with the cover 72 and reservoir 72*a* extended to the left, surface 4 may be flipped back between and below the note reservoir 72*a*, sandwiched between the cover orientation flap (120/121) and the note reservoir on mounting surface 40. Further, the cover may be pivoted about axis 78 and folded face down on, for example, leaf 74. The frame/leaf pair in this configuration is a simple frame and mounting surface, where the mounting surface has a means for binding a plurality of leaves into a leaf set. Such a binding means is shown in detail in FIG. 60*b*, in which the leaf set is implemented using adapter 67.

FIG. 61 shows a book comprised solely of surface attachments according to the invention. A HyperFold TM surface attachment comprising a set of mounting surfaces 40 and 40", where 40" acts as an extension structure and orientation flap 30 is attached directly to a book spine. Additionally, a surface attachment including a plurality of frame attachments and a simple plurality of leaves is shown attached to a spine 77.

FIGS. 62*a–g* define a SupraFold and FIGS. 63 and 64 integrated suprafold modules. FIGS. 62*a–c* show three base suprafold structures with surfaces 150–154, and coupling locations 155. FIG. 62*d* shows a standard leaf attachment 78*a* of length substantially equal to one of the surfaces 150–154, having a coupling location 156. FIGS. 62*e* and *f* show major (78*b*) and minor (78*c*) leaf arrays, array 78*b* being marginally longer than array 78*c*. Each has a coupling location at 156. FIG. 62*g* shows a half-leaf array 78*d* whose leaf length is substantially less than the length of a surface of a base. It has a coupling location at 156.

FIG. 63 shows a side view of the preferred embodiment of a Suprafold(tm) module in which the unique combination of attachments 78*a–*78*d* implement a directed leaf system. The constraints of the folding pattern direct access to surfaces and enables representation of various patterns of information organization based on category of information, time, etc. Attachments 78*b–d* are connected to base 150 at 155. Attachment 78*a* is connected to the coupling structure defined by the joining of surfaces 150 and 152 at 155. Another attachment 78*a* is connected at the inner base coupling 155. Modules of these forms may be attached to orientation structures to create windowing Suprafold modules for forming the object centered notebooks as detailed, for example, in the "suprafold(tm) item categorizer" mentioned earlier.

FIG. 64 shows a perspective view of a preferred embodiment of the module of FIG. 63. The SupraFold module can be made from a set of components as shown, from suprafold modules, which themselves can be made from progressively continuous single-sheet sections of material, appropriately folded into suprafold configurations.

Figure 65:
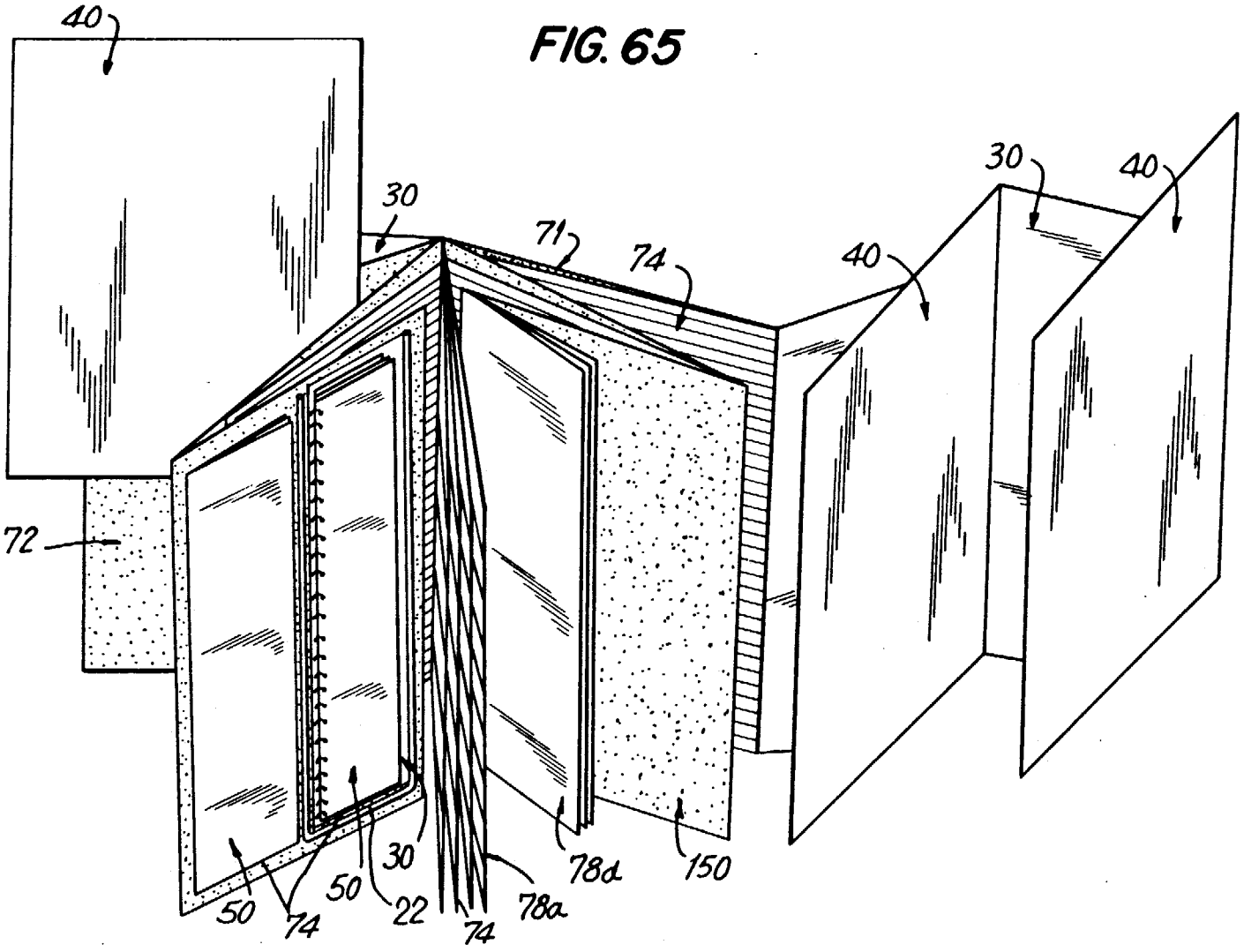
FIG. 65 shows a notebook system composed of supra-folded modules, one of which has a frame based surface attachment mounted thereon, and orientation flap based hyperfold surface attachments, one of said orientation flap hyperfold components being attached to the front cover and the other showing two cascaded to one another pivotally attached to the back cover.

FIG. 65 shows a host book configuration comprising hyperfold surface attachment pages as mounting surface 40 and orientation flap 30 cascaded to the rear cover and windowed off the front cover top edge according to the invention. Additionally, it comprises a Supra-Folded module, one of which has been detailed in FIG. 64 and is included in FIG. 61 in a specific application, "flat bound" directly into a book spine without the use of a ring mechanism or other bulky type of binding. Of course, any of these surface attachments, suprafold modules, or hyperfold modules can be combined via ring attachment or any other type of host to leaf binding method.

Figure 66A:
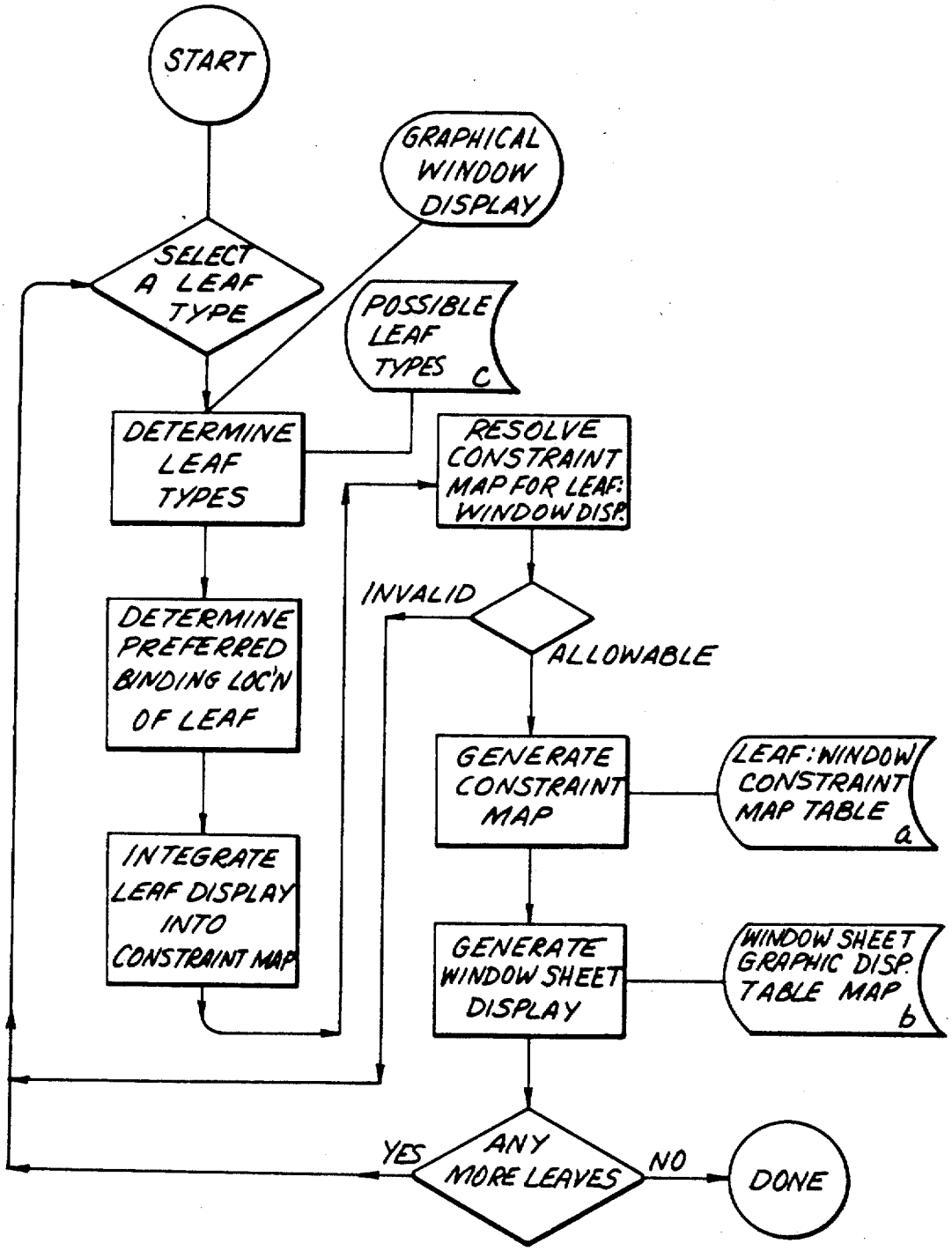
FIG. 66*a* is a flowchart showing the construction steps of a computer program used to generate a visual representation set for displaying a host object/attachment system according to the invention.

FIG. 66*a* shows the steps of a construction or generation computer program for the creation and maintenance of a host object/attachment system according to the invention for display and interaction in a computational environment. This routine could be used as a computer-aided system to prepare physical objects according to the invention for manufacture or to generate an electronic window system display on a piece of computer hardware designed to emulate the physical object of the host object attachment system. The system is defined by an allowable set of leaves c, from which selection would be made on an interactive display. The binding of each leaf would constrain the motion of the leaf when combined into an attachment system. The algorithm would accept all leaf types and preferred bindings. A constraint table a, and a window sheet display table b, would be generated for the allowable configuration. This process would be continued until a complete host object was configured.

Figure 66B:
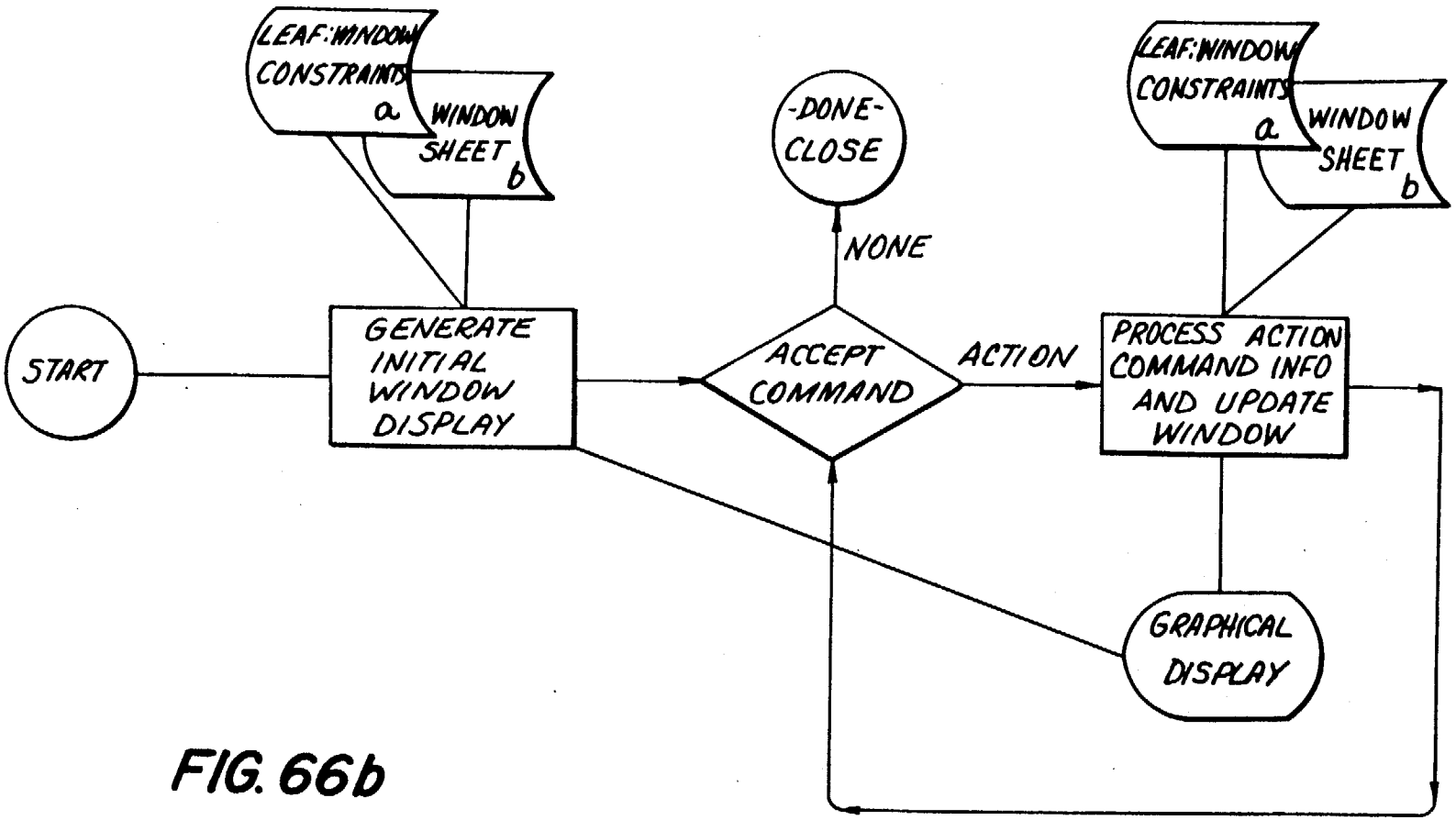
FIG. 66*b* is a flowchart showing the run time actions which would define a computer program for displaying a host object/attachment system according to the invention for interactive manipulation on a computer.
Figure 1:
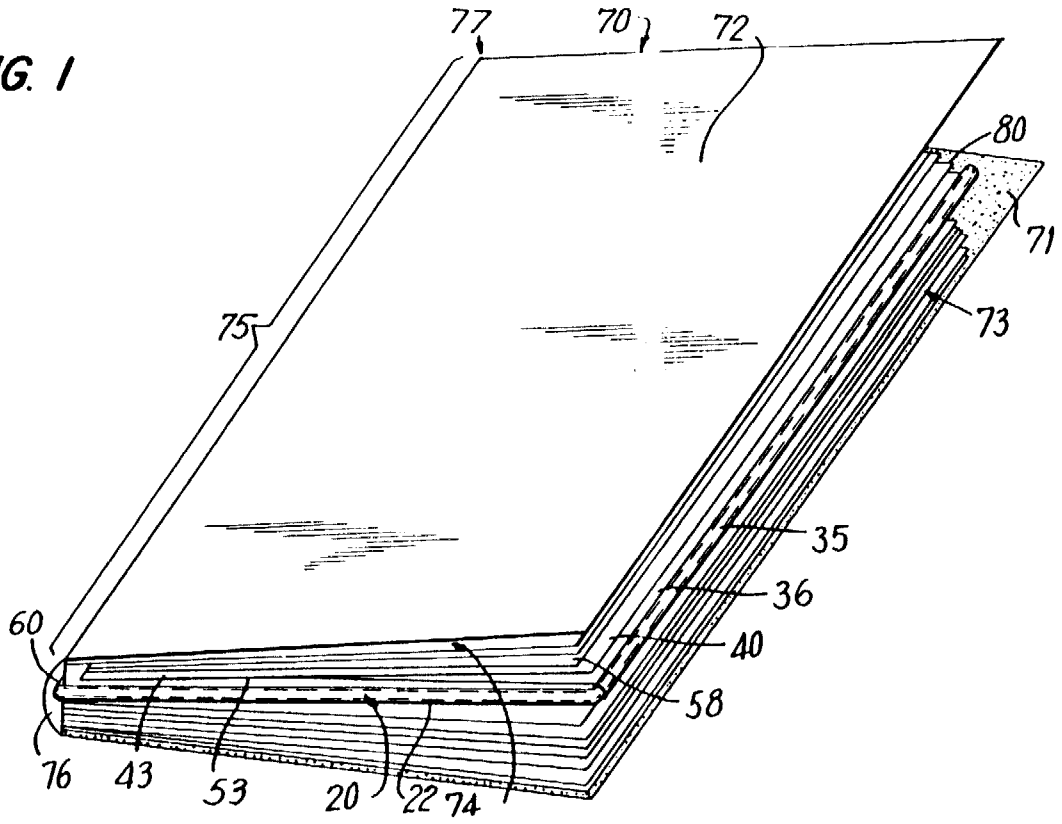
Figure 2:
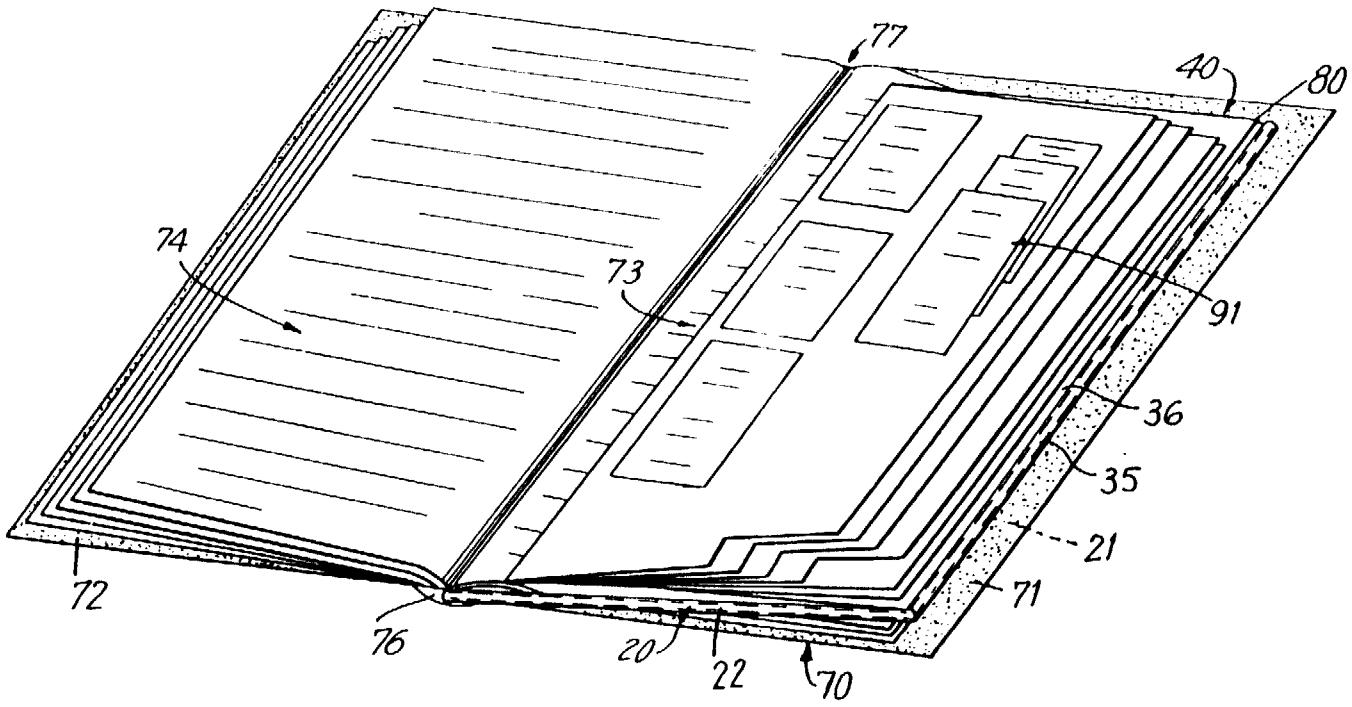
Figure 3:
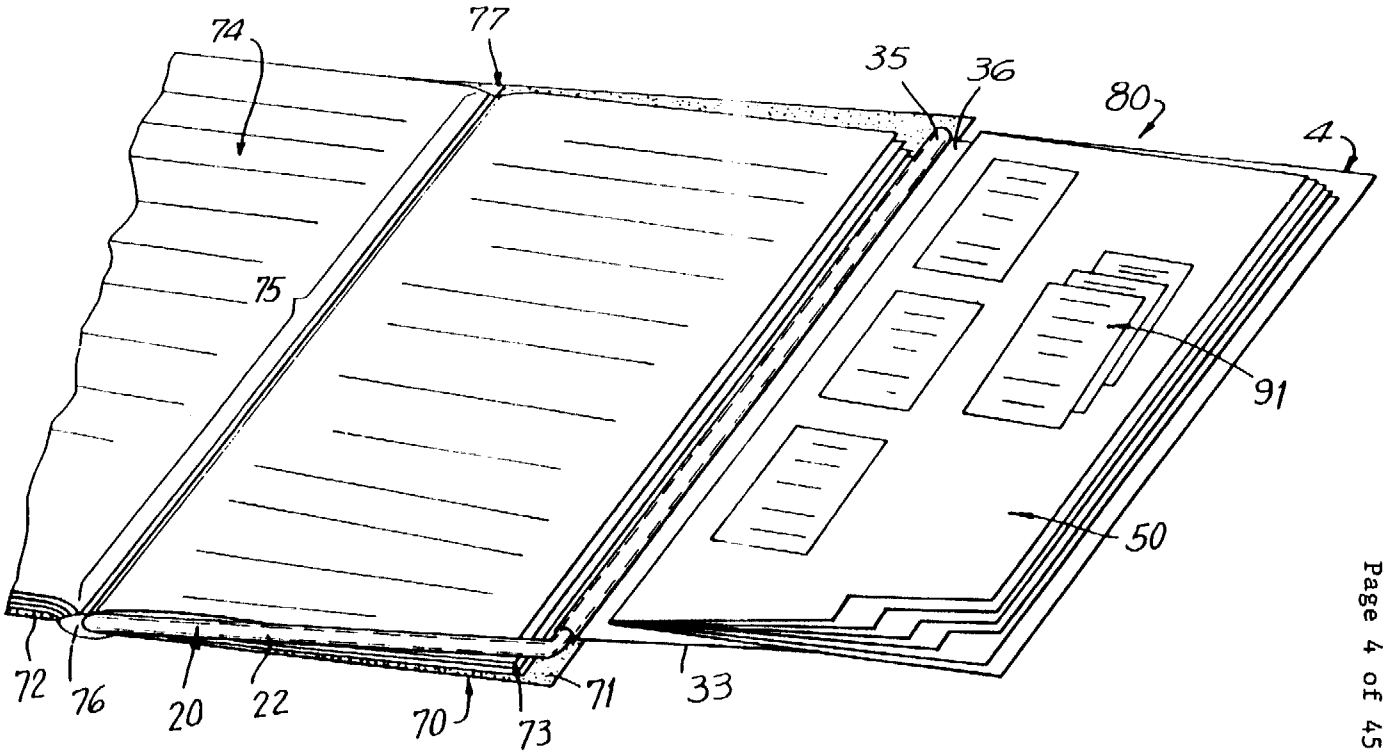

FIG. 66*b* shows the run module of the computer program. In this module, the steps to use the host object attachment system defined in 66*a* are described. Given a leaf-window constraint map that specifies allowable leaf motion and a window sheet table to display each allowable leaf configuration for view on a computer screen, a default display is arranged. A user request is processed by manipulating the display and the information being input, processed or output.

The frame can be made of any stiff, inflexible material, with a colored or coated finish to match the host book requirements. The leaf 80 which can comprise surfaces according to the invention which include the leaf mounting surface and the plurality of leaf surfaces, among others, when made of polyester material such as MYLAR © or of a woven plastic such as TYVEC ©, can be given a plastic coating on their surface using a material like CLEAR SEAL ©, or in particular, when formed as an unobstructed mounting surface, may be formed as (or constructed with) a piece of stiffened plastic whose surface offers sufficient adhesion to allow removable adhesive notes to be easily posted and reposted without peeling off. The color of the surfaces can also be selected to match the host or may be color coded to support the application. The optional plurality of folded surfaces may also be die-cut to enable selective access. They may also contain translucent or opaque pouches for other information handling, or may be shaped to hold an electronic device such as a microcomputer or the like.

The mechanical (hypertext) attachment forms a (hyper) binding system functioning as a list machine which marks any page it is folded into when the book is closed, rests within the perimeter of the cover on either side of the book when the book is open, and allows the pages of the host blank book to sweep past it in either direction when the book is opened and the host blank book pages are turned. One skilled in the art will appreciate that the present invention can be practiced by other than the embodiments described, which are presented for the purpose of illustration and not of limitation, and the present invention is limited only by the claims which follow.

What is claimed is:

1. In combination, a leaf attachment and a book:

said book comprising a binding structure with a cover attached thereto, said binding structure further having one or more pages pivotally attached to said binding structure, said each of said pages having a width, where the widest of said one or more pages has a width, maximum page width;

said leaf attachment comprising a mounting surface having perimeter features including opposing edges and having a mounting surface width, between those edges;

an orientation member having first and second opposing attachment locations and an orientation member width between those opposing attachment locations, said opposing attachment locations comprising first and second orientation member attachment locations; and an extension member having opposing attachment locations and an extension member width between those opposing attachment locations, said opposing attachment locations comprising first and second extension member attachment locations, said extension member width, being greater than said maximum page width; wherein:

said orientation member width and said mounting surface width are not greater than said extension member width; and, wherein:

said extension member first attachment location is attached substantially adjacent said book binding structure, and said orientation member is pivotally attached at said second orientation member attachment location to said extension member at said second of said extension member attachment locations thereby forming an orientation member-extension member pivotal hinge, having an orientation member-extension member pivotal axis of rotation therefore, and said orientation member is pivotably hinged at said orientation member first attachment location to said mounting surface at a location between said opposing edges of said mounting surface and substantially away from said opposing edges of said mounting surface, thereby joining said mounting surface and said orientation member, said pivotal hinge having an orientation member-mounting surface pivotal axis of rotation therefore, said mounting surface, orientation member, and extension member being attached with said orientation-member mounting surface pivotal axis of rotation parallel to said orientation member-extension member pivotal axis of rotation, such that:

said mounting surface may be placed in any one of a plurality of positions, at least three of said plurality of positions being a first position to one side of said orientation member-extension member pivotal hinge and a second position to the other side of said orientation member-extension member pivotal hinge, one along side the other, and a third position with said mounting surface on top a portion of any page of said one or more pages of said book, where the orientation of said mounting surface perimeter features may be preserved in all three of said three positions.

2. A leaf-extension member pair for attachment to a host object for adding an electronic window system to a host object, said leaf-extension member pair comprising;

an extension member having an attachment structure at a first end thereof for attaching said extension member to the host object and an attachment structure at a second end thereof, said extension member comprising an electronic structure for conducting the bi-directional transmission of electrical signals;

an orientation member having a first attachment structure at a first end thereof and a second attachment structure at a second end thereof, said orientation member comprising an electronic structure for conducting the bi-directional transmission of electrical signals, said orientation member being pivotally attached at said first end thereof to said extension member at said second end of said extension member, forming an orientation member-extension member pivotal attachment structure, and having an orientation member-extension member pivotal axis of rotation thereof; and a leaf member having a plurality of faces and perimeter features including opposing edges and an attachment structure between said opposing edges, said leaf member further comprising an electronic structure for at least one of (a) capturing, (b) storing, (c) accessing, (d) displaying, and (e) transmitting and receiving, information electronically, said second end of said orientation member being pivotally attached to said leaf member between said opposing edges of said leaf member at said leaf member attachment structure and having a leaf member-orientation member pivotal axis of rotation therefore;

such that said leaf member-orientation member pivotal axis of rotation is parallel to said orientation member-extension member pivotal axes of rotation and said leaf-extension member pair can transmit and receive electrical signals bi-directionally, and wherein when said extension member first end is attached to the host object, said leaf member may be moved about said orientation member, and said orientation member moved about said extension member, allowing said leaf member to be positioned in any one of a plurality of locations, at least two of said plurality of locations being to either side of said orientation member-extension member pivotal attachment structure, wherein the orientation of said face and perimeter features of said leaf may be preserved when placed in said each of said two locations.

3. The combination comprising a host object and a leaf-extension member pair, forming a host object electronic window system, wherein said host object comprises an electronic object with at least one host object coupling structure for the bi-directional transmission of electrical signals, where said host object further comprises an electronic structure for at least one of (a) capturing, (b) storing, (c) accessing, (d) displaying, and (e) transmitting and receiving information electronically, and said leaf-extension member pair comprises:

an extension member having attachment structures at first and second ends thereof, said extension member comprising an electronic structure for conducting the bi-directional transmission of electrical signals, where said extension member first end is attached to said host object at said host object coupling structure;

an orientation member having first and second orientation member attachment structures, and comprising a structure for conducting the bi-directional transmission of electrical signals, said orientation member being pivotally attached at said first end thereof to said extension member at said second end of said extension member, thereby forming an orientation member-extension member pivotal attachment structure, and having an orientation member-extension member pivotal axis of rotation thereof; and a leaf member having a plurality of faces and perimeter features including opposing edges and an attachment structure between said opposing edges, said leaf member further comprising an electronic structure for at least one of (a) capturing, (b) storing, (c) accessing, (d) displaying, and (e) transmitting and receiving, information electronically, said second end of said orientation member being pivotally attached to said leaf member at said leaf member attachment structure, and having a leaf member-orientation member pivotal axis of rotation therefore;

such that said leaf member-orientation member pivotal axis of rotation is parallel to said orientation member-extension member pivotal axis of rotation and said leaf-extension member pair can transmit and receive electrical signals to and from said host object, and wherein said leaf member may be moved about said orientation member, and said orientation member moved about said extension member, allowing said leaf member to be positioned in any one of a plurality of locations, at least two of said plurality of locations being to either side of said orientation member-extension member pivotal attachment structure, where the orientation of said face and perimeter features of said leaf may be preserved when placed in said each of said two locations.

4. The host object, leaf-extension member pair combination of claim 3 wherein said host object is an electronic book.

5. The host object leaf-extension member pair combination of claim 3 wherein said leaf member and said host object further comprise means for identifying the positional location of said leaf member relative to said host object, for monitoring the use of said leaf by said host object and the use of said host object by said leaf.

6. The host object leaf-extension member pair combination of claim 3 where said extension member is pivotally attached to said host at said extension member first attachment structure and said leaf member can be positioned in any one of a plurality of locations about said host, at least for of said locations being substantially non-overlapping, adjoining locations, each of said four locations being substantially along side at least one of the other said four locations, and where the orientation of said face and said perimeter features of said leaf may be preserved in all four of said four locations.

7. A leaf-extension member pair for attachment to a host object for adding an electronic window system to a host object, said leaf-extension member pair comprising:

an extension member having attachment structures at first and second ends thereof;

an orientation member having first and second orientation member attachment structures, and pivotally attached at a first end thereof to said extension member at said second end of said extension member, forming an orientation member-extension member pivotal attachment structure, and having an orientation member-extension member pivotal axis of rotation therefore; and a leaf member having a plurality of faces and perimeter features including opposing edges and further comprising an electronic structure for at least one of (a) capturing, (b) storing, (c) accessing, and (d) displaying, information electronically, and (e) transmitting and receiving information by wirefree electronic transmission, said orientation member being pivotally attached to said leaf member between said opposing edges of said leaf member at said second end of said orientation member and having a leaf member-orientation member pivotal axis of rotation therefore;

such that said leaf member-orientation member pivotal axis of rotation is parallel to said orientation member-extension member pivotal axis of rotation, and wherein;

when said extension member first end is attached to the host object, said leaf member may be moved about said orientation member, and said orientation member moved about said extension member, allowing said leaf member to be positioned in any one of a plurality of locations, at least two of said locations being to either side of said orientation member-extension member pivotal attachment structure, where the orientation of said face and perimeter features of said leaf may be preserved when placed in said each of said two locations.

8. The combination comprising a host object and a leaf-extension member pair, forming a host object electronic window system wherein, said host object comprises an electronic object further comprising a structure capable of at least one of (a) capturing, (b) storing, (c) accessing, (d) displaying, and (e) the wirefree transmitting and receiving, information electronically, said host object having at least one host object coupling structure, and said leaf-extension member pair comprises:

an extension member having attachment structures at first and second ends thereof, where said extension member first end is attached to said host object at said host object coupling structure;

an orientation member having first and second orientation member attachment structures, said orientation member being pivotally attached at said first end thereof to said extension member at said second end of said extension member, forming an orientation member-extension member pivotal attachment structure, and having an orientation member-extension member pivotal axis of rotation thereof; and a leaf member having a plurality of faces and perimeter features including opposing edges and further comprising an electronic structure for at least one of (a) capturing, (b) storing, (c) accessing, and (d) displaying, information electronically, and (e) the wirefree transmitting and receiving information, said orientation member being pivotally attached to said leaf member between said opposing edges of said leaf member at said second end of said orientation member, and having a leaf member-orientation member pivotal axis of rotation therefore;

such that said leaf member-orientation member pivotal axis of rotation is parallel to said orientation member-extension member pivotal axes of rotation, and wherein said leaf member may be moved about said orientation member, and said orientation member moved about said extension member, allowing said leaf member to be positioned in any one of a plurality of locations, at least two of said locations being to either side of said orientation member-extension member pivotal attachment structure, where the orientation of said face and perimeter features of said leaf may be preserved when placed in said each of said two locations.

9. The host object leaf-extension member combination of claim 8 wherein said leaf member and said host object further comprise means for identifying the positional location of said leaf member relative to said host object, for monitoring the use of said leaf by said host object and the use of said host object by said leaf.

10. The leaf-extension member host object combination of claim 8 where said extension member is pivotally attached to said host at said extension member first attachment structure and said leaf member can be positioned in any one of a plurality of locations about said host, at least four of said plurality of locations being adjoining locations, each of said four locations being along side at least one of the other said four locations, and where the orientation of said face and said perimeter features of said leaf may be preserved in all four of said four locations.

11. An attachment for a stationary object, said attachment comprising:

a substantially rigid support member having at least a first rotationally pivotable section capable of slidably receiving a structure, and a second section substantially orthogonal to said first section, said second section being capable of being coupled to the stationary object; and a surface having a face and perimeter features, and comprising a structure capable of slidably coupling to said first rotationally pivotable section of said support member; wherein:

said structure of said surface when slidably coupled to said rotationally pivotable structure of said support member forming an orientation maintaining means for allowing said surface to be slidably and rotationally moved relative to said support member; such that:

when said support member is coupled to said stationery object, said surface may be positioned in any one of at least two substantially coplanar, non-overlapping and adjacent locations, with said surface retaining its face and perimeter orientations in both locations.

12. In combination, a leaf attachment and a book, said book having a binding structure with a cover attached thereto, said leaf attachment comprising:

a mounting surface having a face, and perimeter features including opposing edges;

an orientation member having perimeter features and having opposing attachment locations, said opposing attachment locations comprising first and second orientation member attachment locations; and an extension member having face and perimeter features and having two or more attachment locations, two of said two or more attachment locations comprising first and second extension member attachment locations; wherein:

said orientation member first attachment location is pivotally hinged to said mounting surface between said opposing edges of said mounting surface, thereby joining said mounting surface and said orientation member, said pivotal hinge having an orientation member-mounting surface pivotal axis line of rotation therefore, which pivotal axis line of rotation is located away from said opposing edges of said mounting surface, thereby dividing said mounting surface into two sections, and pivotally hinged at said second orientation member attachment location to said extension member at said second of said extension member attachment locations said pivotal hinge having an orientation member-extension member pivotal axis line of rotation therefore, said mounting surface, said orientation member, and said extension member being attached with said orientation-member mounting surface pivotal axis line of rotation parallel to said orientation member-extension member pivotal axis line of rotation, said extension member first attachment location being attached substantially adjacent to said book binding structure, such that, said mounting surface may be placed in a plurality of locations at least two of said plurality of locations being first and second substantially coplanar positions, said two positions being to either side of said orientation member-extension member pivotal hinge, where the preservation of orientation of said mounting surface face and perimeter features may be preserved in both positions.

13. In combination, a leaf attachment and a book, said book having a binding structure with a cover attached thereto, said leaf attachment comprising:

a mounting surface having perimeter features including opposing edges and a mounting surface width, between those edges;

an orientation member having perimeter features and having first and second opposing attachment locations and an orientation member width between those attachment locations, said opposing attachment locations comprising first and second orientation member attachment locations; and an extension member having face and perimeter features including opposing ends and having at least two opposing attachment locations, and an extension member width, between those opposing attachment locations, said opposing attachment locations comprising first and second extension member attachment locations; wherein:

said orientation member width and said mounting surface width are not greater than said extension member width; and, wherein:

said extension member first attachment location is pivotably attached substantially adjacent said book binding structure, and said orientation member is pivotally attached at said second orientation member attachment location to said extension member at said second of said extension member attachment locations, thereby forming an orientation member-extension member pivotal hinge having an orientation member-extension member pivotal axis of rotation therefore, and said orientation member is pivotably hinged at said orientation member first attachment location to said mounting surface at a location between said opposing edges of said mounting surface and substantially away from said opposing edges of said mounting surface, said pivotal hinge having an orientation member-mounting surface pivotal axis of rotation therefore, said mounting surface, orientation member, and extension member being attached with said orientation-member mounting surface pivotal axis of rotation parallel to said orientation member-extension member pivotal axis of rotation, such that:

said mounting surface may be placed in any one of a plurality of positions, at least two of said plurality of positions being a first position to one side of said orientation member-extension member pivotal hinge and a second position to the other side of said orientation member-extension member pivotal hinge, one along side the other, where said first position is a position with said mounting surface substantially overlapping said extension member, and said second position is a position with said mounting surface coplanar with and substantially non-overlapping said extension member, where the orientation of said mounting surface perimeter features may be preserved in both of said two positions.

14. In combination, a leaf attachment and a book, said book having a binding structure with a cover attached thereto, said leaf attachment comprising:

a mounting surface having a mounting surface face, and perimeter features including opposing edges and a mounting surface width between those edges;

an orientation member having perimeter features and having first and second opposing attachment locations and an orientation member width between those attachment locations, said opposing attachment locations comprising first and second orientation member attachment locations; and an extension member having face and perimeter features including opposing ends and having at least two opposing attachment locations, and an extension member width, between those opposing attachment locations, said opposing attachment locations comprising first and second extension member attachment locations; wherein:

said orientation member width and said mounting surface width are not greater than said extension member width; and, wherein:

said extension member first attachment location is attached substantially adjacent said book binding structure, and said orientation member is pivotally attached at said second orientation member attachment location to said extension member at said second of said extension member attachment locations thereby forming an orientation member-extension member pivotal hinge, having an orientation member-extension member pivotal axis of rotation therefore, and said orientation member is pivotably hinged at said orientation member first attachment location to said mounting surface at a location between said opposing edges of said mounting surface and substantially away from said opposing edges of said mounting surface, thereby joining said mounting surface and said orientation member, said pivotal hinge having an orientation member-mounting surface pivotal axis of rotation therefore, said mounting surface, orientation member, and extension member being attached with said orientation-member mounting surface pivotal axis of rotation parallel to said orientation member-extension member pivotal axis of rotation, such that:

said mounting surface may be placed in any one of a plurality of positions, at least two of said plurality of positions being a first position to one side of said orientation member-extension member pivotal hinge and a second position to the other side of said orientation member-extension member pivotal hinge, one along side the other, said first position being a position with said mounting surface substantially overlapping said extension member, and said second position is a position being a position with said mounting surface coplanar with and substantially non-overlapping said extension member, where the orientation of said mounting surface face and perimeter features may be preserved in both of said two positions, and further, where said mounting surface, said orientation member and said extension member are formed as an integral structure and where at least the combination of said mounting surface and said orientation member is made of a flexible piece of material, and where said mounting surface-orientation member combination is formed from said flexible piece of material as a folded construction with said orientation member-mounting surface pivotal axis of rotation formed in said flexible piece of material as a hinged fold, where the hinge effect of said hinged fold is created solely by the inherent flexibility of the material itself.

* * * * *

UNITED STATES PATENT AND TRADEMARK OFFICE

CERTIFICATE OF CORRECTION

PATENT NO. : 5,316,341

DATED : May 31, 1994

INVENTOR(S) : David C. Schwartz

It is certified that error appears in the above-indentified patent and that said Letters Patent is hereby corrected as shown below:

The Drawing Sheets, consisting of Figs. 1-66, should be deleted to be replaced with the drawing sheets, as shown on the attached pages.

Signed and Sealed this

Eleventh Day of October, 1994

*Attest:*

*Attesting Officer*

Bruce Lehman

BRUCE LEHMAN

*Commissioner of Patents and Trademarks*

192
190
191

161
180
35'
30
70
171
73
172
60
62
74
30
161
180
35
173
70
250
35
170
20
61
250
35'
G
H
1
2
3

FIG. 29
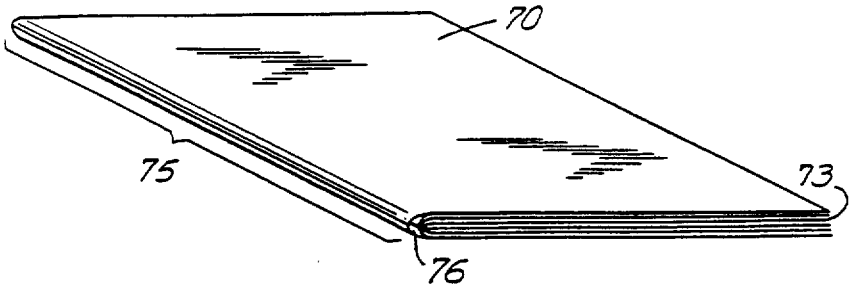
FIG. 30
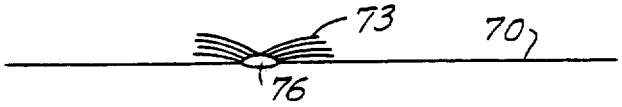
FIG. 31
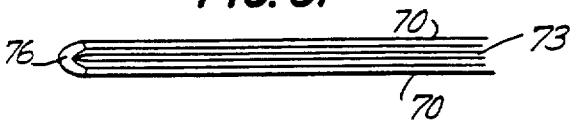
FIG. 32
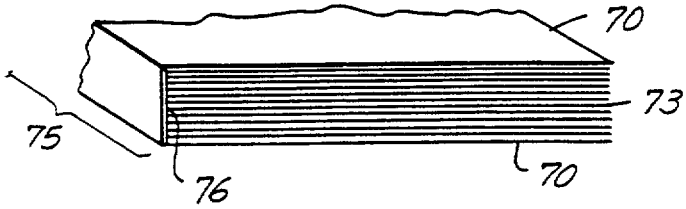
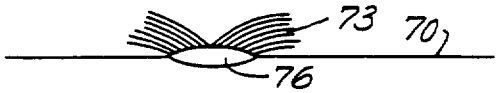
FIG. 33

30
35
22

30
35
21
22

30
35
21a
35a
21
22

30
39
21
22

30
30a
21
22

FIG. 62a
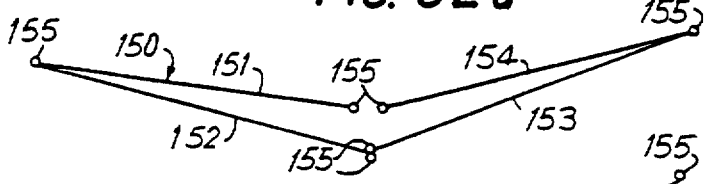
FIG. 62b
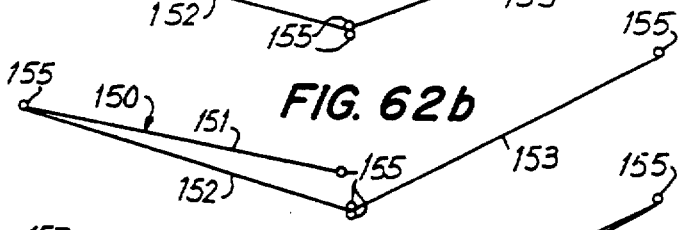
FIG. 62c
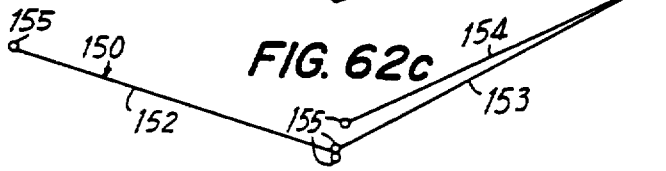
FIG. 62d
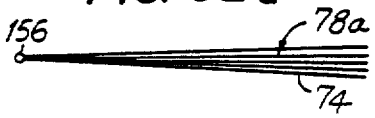
FIG. 62e
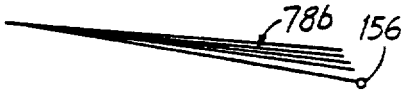
FIG. 62f
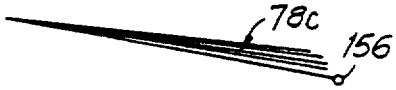
FIG. 62g
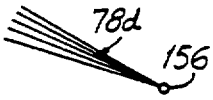
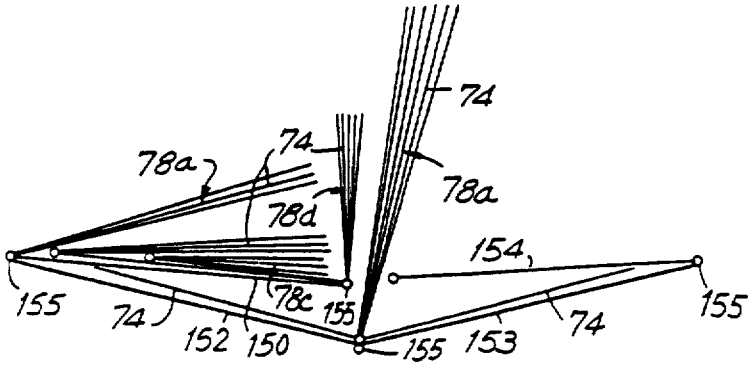
FIG. 63